US005619310A

United States Patent [19]

Todome

[11] Patent Number: 5,619,310

[45] Date of Patent: Apr. 8, 1997

[54] SYSTEM FOR SUPPRESSING ONE-SIDED MOVEMENT AND ZIGZAG RUNNING OF A CONVEYOR BELT IN AN IMAGE FORMING APPARATUS

[75] Inventor: Tuyoshi Todome, Kanagawa-ken, Japan

[73] Assignee: Kabushiki Kaisha Toshiba, Kawasaki, Japan

[21] Appl. No.: 466,872

[22] Filed: Jun. 6, 1995

Related U.S. Application Data

[63] Continuation-in-part of Ser. No. 205,851, Mar. 4, 1994, Pat. No. 5,481,338.

[30] Foreign Application Priority Data

| | | | |
|---|---|---|---|
| Mar. 5, 1993 | [JP] | Japan | 5-045014 |
| Mar. 25, 1993 | [JP] | Japan | 5-066304 |
| Mar. 25, 1993 | [JP] | Japan | 5-067097 |

[51] Int. Cl.[6] ..... G03G 5/00

[52] U.S. Cl. ..... 399/381; 198/806; 474/101

[58] Field of Search ..... 355/211–213, 271, 355/275, 308, 309; 198/785, 786, 804, 806, 807, 809, 810.04, 813, 814; 474/101, 102, 107

[56] References Cited

U.S. PATENT DOCUMENTS

| | | | |
|---|---|---|---|
| 4,174,171 | 11/1979 | Hamaker et al. | 198/806 X |
| 4,547,059 | 10/1985 | Nagayama et al. | 198/806 X |
| 4,627,702 | 12/1986 | Anderson | 355/212 |
| 4,961,089 | 10/1990 | Jamzadeh | 355/212 X |
| 5,078,263 | 1/1992 | Thompson et al. | 198/807 |
| 5,164,777 | 11/1992 | Agarwal et al. | 355/212 |
| 5,172,175 | 12/1992 | Sekino et al. | 355/277 |
| 5,248,027 | 9/1993 | Kluger et al. | 198/807 X |

FOREIGN PATENT DOCUMENTS

| | | |
|---|---|---|
| 64-31173 | 2/1989 | Japan . |
| 1-235979 | 9/1989 | Japan . |

OTHER PUBLICATIONS

Patent Absracts of Japan, vol. 13, No. 215 (P–874) May 19, 1989.

Patent Abstracts of Japan, vol. 13, No. 566 (P–976) Dec. 15, 1989.

European Search Report.

*Primary Examiner*—William J. Royer

*Attorney, Agent, or Firm*—Foley & Lardner

[57] ABSTRACT

An image forming apparatus includes an image former for forming an image on an image carrier, a conveyor belt for conveying an image receiving medium to the image carrier, a conveyor roller structure having a first roller with different diameter at both ends and taper size T expressed by T=(D–d)/L, wherein D is the diameter at the large diameter side, d is the diameter at the small diameter side and L is the length of the first roller, which is more than $2.341\times10^{-3}$ and a coefficient of static friction is less than 0.26. A second roller is provided opposite to the first roller, for moving the conveyor belt in a prescribed direction by rotating the first and the second rollers in a state where the conveyor belt is put over the first and the second rollers, and a transferring structure for transferring the image formed on the image carrier onto the image receiving medium.

20 Claims, 40 Drawing Sheets

SYSTEM FOR SUPPRESSING ONE-SIDED MOVEMENT AND ZIGZAG RUNNING OF A CONVEYOR BELT IN AN IMAGE FORMING APPARATUS

This application is a continuation-in-part of application Ser. No. 08/205,851, filed Mar. 4, 1994, now U.S. Pat. No. 5,481,338.

BACKGROUND OF THE INVENTION

1. Field of the Invention

The present invention relates to image forming apparatus which form images on an image receiving medium using a plurality of photosensitive drums such as a color copying machine, etc.

2. Description of the Related Art

There is a color copying machine comprising four photosensitive drums arranged in parallel. In this type of copying machine, four photosensitive drums are arranged and toner images in different colors are formed on the respective photosensitive drums using yellow, magenta, cyanic and black toners. Each of these toner images is transferred and formed on a single sheet of paper.

In the color copying machine using these four photosensitive drums, an image receiving medium placed on a conveyor belt is brought in contact with the four photosensitive drums one by one and respective toner images are transferred from the drums onto the image receiving medium.

Further, when forming an image other than color images, for instance, forming a black image only, no toner image is formed on the yellow, magenta and cyanic drums and a black toner image is formed and transferred onto an image receiving medium. Thus, an image only in black is obtained.

However, a conveyor belt is normally wound around driving rollers comprising rubber rollers and is moved by rotating the driving rollers. The largest reason for using rubber rollers is to prevent the conveyor belt from slipping against the driving rollers by making the coefficient of statical friction of the rubber rollers with the conveyor belt large.

Because, if the conveyor belt slips against the driving rollers, the moving distances of copying papers being conveyed by the conveyor belt changes, causing a color shift on the image receiving medium in the conveying direction. That is, in order to prevent the conveyor belt from slipping against the driving rollers, it is desirable to use soft rubber rollers with hardness of rubber lowered.

However, if a rubber roller is used, accuracy of the outer diameter of the driving roller drops and the softer a rubber roller is, the worse the accuracy of the outer diameter of the driving roller will become. If accuracy of the outer diameter of the driving roller drops, the peripheral speed of the roller changes, making the conveying speed of the conveyor belt irregular and finally, a color shift is caused on copying papers in the conveying direction.

When a conveyor belt is used for a long time, its surface becomes dirty as toners and paper powder of the image receiving medium attach thereon and therefore, the conveyor belt is cleaned with a belt cleaning device. However, this conveyor belt cleaning device cleans a belt by bringing a rubber blade in contact with the surface of the conveyor belt and a material having a high contact resistance against a rubber blade is used as the conveyor belt. Therefore, when a conveyor belt is rubbed by a rubber blade of a belt cleaning device which is kept in contact with the conveyor belt, electric charge is left. Unless this residual electric charge is neutralized, the residual potential of the conveyor belt becomes high and images are not satisfactorily transferred on the image receiving medium. Furthermore, a problem is also caused that ozone is generated if a corona discharger is used to neutralize the residual electric charge.

In this type of image forming apparatus, there was a problem that the conveying speed of a conveyor belt becomes irregular as its peripheral speed changes if the accuracy of the outer diameter of driving rollers drop and as a result, a color shift of images on an image receiving medium may be caused along the conveying direction of the image receiving medium.

Further, as described above, the image receiving medium is conveyed toward four photosensitive drums by a conveyor belt. However, if the conveyor belt is moved while meandering unwillingly, the image receiving medium is also conveyed while meandering correspondingly and there was a problem that the same images in different colors will be shifted as the images in different colors are transferred sequentially on the image receiving medium as a result of the meandering conveyance.

In order to solve This problem, a regulation plate is provided at both ends of the rollers over which a conveyor belt is put as disclosed in the Japanese Utility Model Laid-open Publication (JITSU-KAI-HEI) 4-7543. The conveyor belt is moved while keeping its both ends in contact with these regulation plates to prevent the conveyor belt from meandering.

In this construction, however, if a distance between two regulation plates provided at the rollers is not in accord with the width of a conveyor belt, a problem described below will be caused. That is, there will be a problem that at a place where the distance between two control plates is wide, it is possible for the conveyor belt to meander and at a place where the distance between two control plates is narrow, the conveyor belt may possibly run over one of the regulation plates and as a result, a color shift will be caused on images on the image receiving medium along the direction perpendicular to the conveying direction of the image receiving medium.

Further, in a conventional image forming apparatus, the rollers are rotated by transmitting the turning force of a motor to one of the rollers having parallel shafts over which a conveyor belt is put and a conveying force is provided by moving the conveyor belt in the rotating direction of the rollers. There was a problem that if the moving speed of the conveyor belt becomes irregular, it is not possible to transfer images from four photosensitive drums at a prescribed position and as a result, a color shift is caused on images on the image receiving medium. In view of this problem, construction to use driving rollers directly as the rotary shaft of a motor without using driving transmission gears, etc. which may cause irregular moving speed of a conveyor belt. That is, a driving roller and a motor are in one united body. There are a belt cleaner, photosensitive drums, image transfer rollers, etc. arranged while kept in contact with this conveyor belt along its surface. These arrangements, however, will become loads when driving the conveyor belt. Further, when processing jammed image receiving medium, the conveyor belt is separated from the state in contact with the photosensitive drums and pulled out of the body of the apparatus. Because of this construction, in order to pull out the conveyor belt easily it is necessary to lower the belt to a location where the motor does not come in contact with the photosensitive drums.

On the other hand, in order to drive a conveyor belt while overcoming loads, a motor needs a large torque. Generally, a motor large in size is used to improve its torque. However, because a roller and a motor for driving the conveyor belt are in one united body as described above, if a large motor is used, it becomes necessary to further lower the conveyor belt to prevent the photosensitive drums and the motor from contacting each other when processing jammed image receiving medium. Thus, there comes out a problem that the entire image forming apparatus will become large in size.

SUMMARY OF THE INVENTION

It is one of the objects of the present invention to provide an image forming apparatus which does not cause a color shift of images along the conveying direction of an image receiving medium.

Another object of the present invention is to provide an image forming apparatus which does not become large in size even when a motor generating a large torque is used for driving rollers over which a conveyor belt is put.

A further object of the present invention is to provide an image forming apparatus which does not cause a color shift of images along the direction perpendicular to the conveying direction of an image receiving medium.

According to the present invention, there is provided an image forming apparatus comprising means for forming images on a plurality of image carriers, a conveyor belt for carrying an image receiving medium, a driving roller on which the conveyor belt is mounted for driving the conveyor belt to convey the image receiving medium, a pressing roller for pressing the conveyor belt against the driving roller, and means for transferring the images from the image carriers to the image receiving medium conveyed by the conveyor belt.

Further, according to the present invention, there is provided an image forming apparatus comprising means for forming images on a plurality of image carriers, a conveyor belt for carrying an image receiving medium, a plurality of rollers on which the conveyor belt is mounted for moving the conveyor belt to convey the image receiving medium sequentially to the image carriers, an outer rotor type motor having a rotated outer housing provided to one of the rollers for driving the conveyor belt to move the conveyor belt by a friction of the rotated outer housing with the conveyor belt, and means for transferring the images from the image carriers to the image receiving medium conveyed by the conveyor belt.

Yet further, according to the present invention, there is provided an image forming apparatus comprising means for forming images on a plurality of image carriers; a conveyor belt having a first peripheral edge and a second peripheral edge opposing to the first peripheral edge for carrying an image receiving medium, the conveyor belt having a first length L1 at the first periperal edge and a second length L2 at the second peripheral edge shorter than the first length L1; a plurality of rollers on which the conveyor belt is mounted for moving the conveyor belt to convey the image receiving medium sequentially to the image carriers; a tensioning means for giving a tension to the conveyor belt so as to skid the conveyor belt toward the second peripheral edge when the conveyor belt is moved by the rollers; a regulation member for regulating the skid of the conveyor belt; and means for transferring the images from the image carriers to the image receiving medium conveyed by the conveyor belt.

Still further, according to the present invnetion, there is provided an image forming apparatus comprising means for forming images on a plurality of image carriers, a conveyor belt for carrying an image receiving medium, a plurality of rollers on which the conveyor belt is mounted for moving the conveyor belt to convey the image receiving medium sequentially to the image carriers, the rollers including at least one tensioning roller having a contact surface non-parallel to a remaining roller for giving a tension to the conveyor belt so as to skid the conveyor belt toward one end of the rollers when the conveyor belt is moved, a regulation member for regulating the skid of the conveyor belt, and means for transferring the images from the image carriers to the image receiving medium conveyed by the conveyor belt.

DETAILED DESCRIPTION OF THE PREFERRED EMBODIMENTS

Hereinafter, the preferred embodiments of the present invention will be described in detail with reference to the drawings.

A first embodiment will be described with reference to FIGS. 1 through 3.

Figure 1:
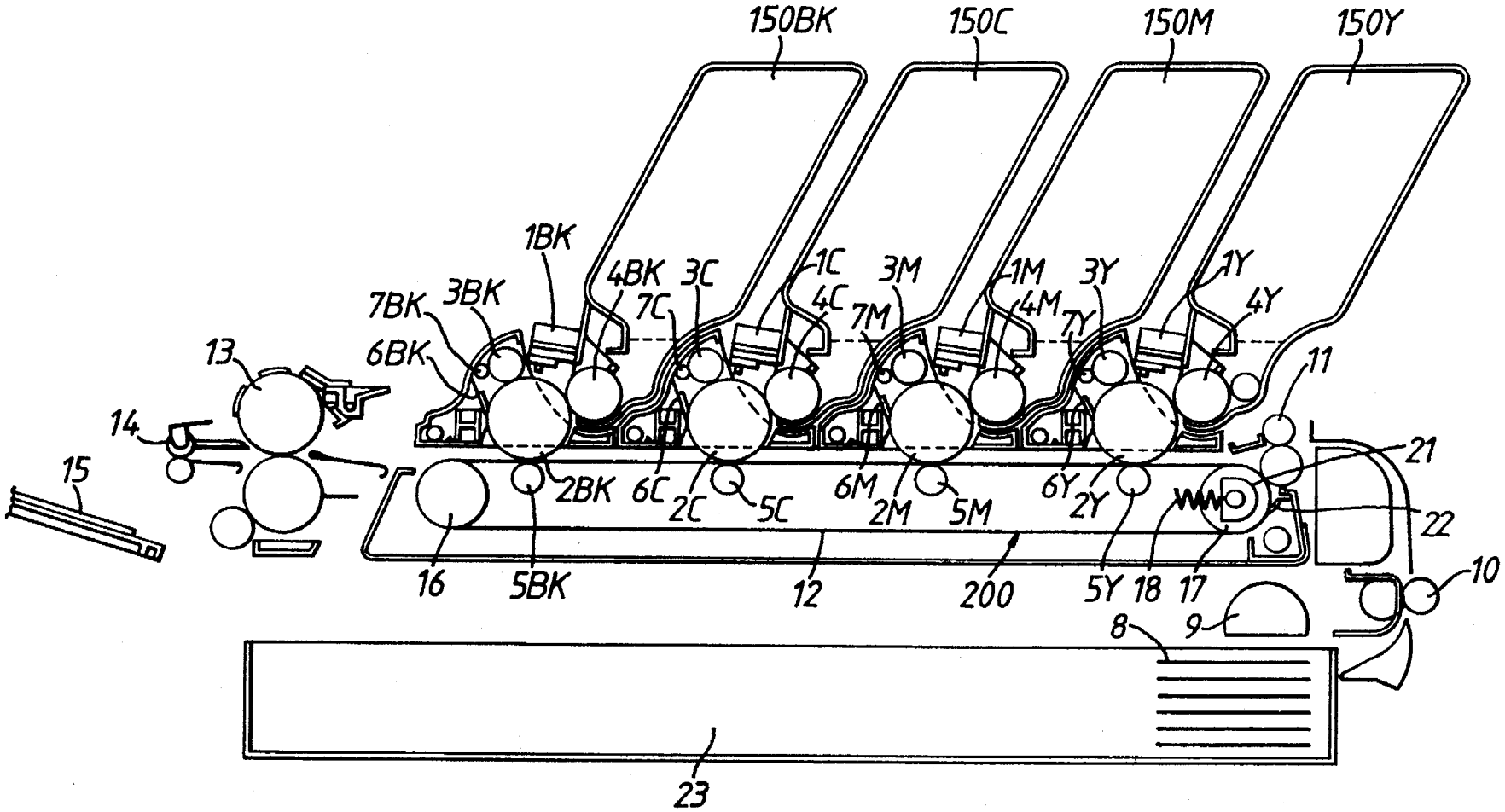
FIG. 1 is an outline diagram of full color image forming apparatus according to the present invention applied.

FIG. 1 shows the outline of the construction of a color copying machine as an image forming apparatus. In this color copying machine, four photosensitive drums 2Y, 2M, 2C and 2BK are arranged in parallel in this order as image carriers. Above these photosensitive drums, there are four image forming units 150Y, 150M, 150C and 150BK provided correspondingly for forming images on the respective photosensitive drums. Under these photosensitive drums there is a conveying means 200 provided for conveying an image receiving medium 8, e.g. a sheet of paper, to the photosensitive drums 2Y, 2M, 2C and 2BK. Transfer rollers 5Y, 5M, 5C and 5BK are arranged corresponding to the photosensitive drums 2Y, 2M, 2C and 2BK as image transfer means for transferring toner images formed on the photosensitive drums onto image receiving medium 8 conveyed by the conveying means 200.

Four sets of the image forming units 150Y, 150M, 150C and 150BK are composed of a recording unit comprising charging devices 3Y, 3M, 3C and 3BK, solid scanning heads 1Y, 1M, 1C and 1BK, developing devices 4Y, 4M, 4C and 4BK, cleaning devices 6Y, 6M, 6C and 6BK and discharging devices 7Y, 7M, 7C and 7BK respectively.

Now, a yellow image forming unit 150Y will be described. The solid scanning head 1Y outputs exposure light to the photosensitive drum 2Y according to yellow image data being sent from a printing controller (not shown). The solid scanning head 1Y is in such a construction that it has very small light emitting sections arranged at equal spaces in the direction of the axis of rotation of the photosensitive drum 2Y, that is, on the line in the main scanning direction.

Lighting of the individual light emitting sections on the line of the main scanning direction is controlled according to the on-off signals sent from a printing controller according to a pattern to be printed. A light image is exposed on the photosensitive drum 2Y corresponding to an original image from the light emitting sections on one for one basis. An LED head array of resolution 400 DPI was used for the solid scanning head 1Y.

The charging device 3Y which charges the surface of the photosensitive drum 2Y, the developer device 4Y, the transfer device 5Y, the cleaning device 6Y and the discharging device 7Y are sequentially arranged around the photosensitive drum 2Y.

The photosensitive drum 2Y is rotated and driven by a driving motor (not shown). The surface of the photosensitive drum 2Y is charged by the charging device 3Y which is composed of a conductive charging roller and provided in contact with the surface of the photosensitive drum 2Y. Further, the charging roller is rotating when kept in contact with the surface of the photosensitive drum 2Y.

The surface of the photosensitive drum 2Y is formed by an organic photoconductor. Normally, this photoconductor has a high resistance but has a nature to change specific resistance of a lighted portion when light is applied. When light is applied to the charged surface of the photosensitive drum 2Y from the solid scanning head 1Y corresponding to a yellow print pattern, an electrostatic latent image of the yellow image pattern is formed on the surface of the photosensitive drum 2Y.

The electrostatic latent image is a so-called negative latent image that is formed on the surface of the photosensitive drum 2Y through charging when specific resistance of the lighted surface of a photoconductor is dropped by the light applied from the solid scanning head 1Y to discharge electric charge on the surface of the photosensitive drum 2Y and on the other hand, electric charge of the portion to which no light was applied remains.

Thus, the light from the solid scanning head 1Y forms an image at an exposing positional location on the charged photosensitive drum 2Y and the photosensitive drum 2Y with a latent image formed rotates to a developing position. Then, the latent image on the photosensitive drum 2Y is turned to a toner image as a visible image, by the developing device 4Y.

The developing device 4Y contains a yellow toner containing a yellow dye formed of resin. This yellow toner is frictionally charged when stirred in the developing device 4Y and has an electric charge of the same polarity as that charged on the photosensitive drum 2Y. When the surface of the photosensitive drum 2Y passes through the developing device 4Y, the yellow toner is adhered electrostatically to the discharged latent image portion only and this latent image is developed by the yellow toner.

The photosensitive drum 2Y with the yellow toner image formed on it is rotating continuously and the yellow toner image is transferred onto the image receiving medium 8 on the conveyor belt 12, that is timely fed by the transfer device 5Y which is in the transfer position. The conveyor belt 12 is mounted on driving roller 16 and the driven roller 17. The driven roller 17 is held by the driven roller holder 21.

A paper supply means is composed of a pickup roller 9, a feed roller 10 and a register roller 11. The image receiving medium 8 taken out of a paper supply cassette 23 by the pickup roller 9 is conveyed to the register roller 11 by one sheet only by the feed roller 10. The register roller 11 feeds the image receiving medium 8 after properly correcting its position. The peripheral velocity of the register roller 11 and that of the conveyor belt 12 have been so set that they become equal to the peripheral velocity VO of the photosensitive drum 2Y. The image receiving medium 8 is conveyed to the transfer position of the photosensitive drum 2Y together with the conveyor belt 12 at a predetermined velocity equal to that of the photosensitive drum 2Y while being partially kept by the resister roller 11.

The yellow toner image on the photosensitive drum 2Y which is kept in contact with the image receiving medium 8 is removed from the photosensitive drum 2Y and transferred onto the image receiving medium 8 by the transfer device 5Y. As a result, the yellow toner image in a print pattern based on a yellow print signal is formed on the image receiving medium 8.

The transfer device 5Y is composed of a semiconductive transfer roller. This transfer roller 5Y supplies an electric field having the polarity reverse to a potential of the yellow toner adhered statically to the photosensitive drum 2Y through the back side of the conveyor belt 12. This electric field acts on the yellow toner image on the photosensitive drum 2Y through the image receiving medium 8 and as a result, the yellow toner image is transferred onto the image receiving medium 8 from the photosensitive drum 2Y.

The image receiving medium 8 with the yellow toner image thus transferred is conveyed sequentially to a magenta image forming unit 150M, a cyanic image forming unit 150C and further to a black image forming unit 150BK.

Further, the magenta image forming unit 150M, the cyanic image forming unit 150C and the black image forming unit 150BK contain a magenta (M), cyanic (C) and black (BK) color developers, respectively, instead of a yellow (Y) developer contained in a developing device 4Y for the yellow image forming unit 150Y. As these image forming units are constructed from the same components and their operations are all the same, the explanations of these image forming units will be omitted to make the explanation simple.

Now, the image receiving medium 8 with color images formed one over another while passing through the yellow, magenta, cyanic and black transfer positions is conveyed to a fixing device 13.

The fixing device 13 is composed of a heat roller with a heater incorporated therein which fixes the toner images in various colors on the image receiving medium 8 permanently by heating and fusing the color toners. The image receiving medium 8 with the fixed image is ejected on a receiving tray 15 by the exit roller 14.

On the other hand, the photosensitive drums 2Y, 2C and 2BK in respective colors passed through the transfer positions are driven and cleaned by cleaning devices 6Y, 6M, 6C and 6BK to remove residual toners and paper powder on the drums. Further, the potentials on the surfaces of the photosensitive drums 2Y, 2M, 2C and 2BK are regulated to a certain level. Then, a series of image forming processes from the charging devices 3Y, 3M, 3C and 3BK will begin.

After conveying the image receiving medium 8 to the fixing device 13, the conveyor belt 12 is cleaned by a cleaning device 22 to remove residual toners and paper powder adhered to the surface of the belt and conveys the next image receiving medium 8 when required.

Further, in the case of a unicolor print, the image forming by an image forming unit in a desired unicolor is carried out. At this time, other image forming units in colors other than the selected color do not perform their operations.

Next, a conveying means $\mathbf{200_1}$ in the first embodiment will be explained with reference to FIGS. 2 and 3.

The conveying means $\mathbf{200_1}$ is composed of an endless conveyor belt $\mathbf{12_1}$ which is put and extended over a parallelly provided driving roller $\mathbf{16_1}$ and a driven roller $\mathbf{17_1}$ with the middle section stretched opposing to the photosensitive drums 2Y, 2M, 2C and 2BK.

The driven roller $\mathbf{17_1}$ is pressed by a compression spring 18 (see FIG. 1), giving a tensile force to the conveyor belt $\mathbf{12_1}$.

The conveyor belt $\mathbf{12_1}$ is an endless type and is retained by the driving roller $\mathbf{16_1}$ at the fixing device 13 side and the driven roller $\mathbf{17_1}$ at the image receiving medium supply side. The driving roller $\mathbf{16_1}$ is given its driving force from a driving motor (not shown) and is driven so that a prescribed peripheral velocity of the photosensitive drum becomes equal to that of the belt.

On the other hand, the driven roller $\mathbf{17_1}$ has a mechanism at both sides of the roller, which makes the roller movable in the direction parallel to the image receiving medium conveying direction. That is, the driven roller $\mathbf{17_1}$ is pressed in the direction opposite to the image receiving medium conveying direction by the compression spring 18 to give a tensile force to the conveyor belt $\mathbf{12_1}$. The mechanism of the driven roller $\mathbf{17_1}$ which makes it possible to move in the direction parallel to the image receiving medium conveying direction is composed of a slot (not shown) provided on the frame and a driven roller holder (not shown) which slides in the slot and makes the driven roller $\mathbf{17_1}$ rotatable.

The driving roller $\mathbf{16_1}$ uses a roller with urethane rubber having a radial thickness of 1 mm baked to a metallic roller. The reason for using rubber on the surface is to prevent the conveyor belt $\mathbf{12_1}$ from slipping on the driving roller $\mathbf{16_1}$. As described above, the image receiving medium 8 is conveyed to four photosensitive drums 2Y, 2M, 2C and 2BK by the conveyor belt $\mathbf{12_1}$ and images on the respective drums are transferred onto the image receiving medium 8. As the image receiving medium 8 is moved by the same distance as the conveyor belt $\mathbf{12_1}$, if a slip is caused between the conveyor belt $\mathbf{12_1}$ and the driving roller $\mathbf{16_1}$, the image receiving medium 8 is forced to stay in a delayed position from a position where it is originally to be. This will cause the color shift on the images transferred one over another on the image receiving medium 8.

The use of the rubber type driving roller $\mathbf{16_1}$ increases a coefficient of static friction with the conveyor belt $\mathbf{12_1}$. To further increase its reliability, it is only necessary to increase the static friction coefficient. That is, it is needed to make the rubber soft and increase its thickness.

Further, it is needed to increase a contact pressure to the driving roller $\mathbf{16_1}$ by increasing a tensile force of the conveyor belt $\mathbf{12_1}$. However, when the rubber is made soft and its thickness is increased, manufacturing accuracy of the roller drops. As described previously, the image receiving medium 8 is conveyed by the conveyor belt $\mathbf{12_1}$. If accuracy of the outer diameter of the driving roller $\mathbf{16_1}$ is bad, a difference will be caused in the peripheral velocity of the conveyor belt $\mathbf{12_1}$ and that of the peripheral surface of the driving roller $\mathbf{16_1}$ according to which the belt is moved.

That is, coarse accuracy of the outer diameter of the driving roller $\mathbf{16_1}$ means that a radial size at a first position in the axial direction of the driving roller $\mathbf{16_1}$ is different from that at a second position. The driving roller $\mathbf{16_1}$ is rotated by a driving force transmitted through its shaft and the rotating peripheral velocity differs at the first and second positions of which radial sizes differ from each other. The conveying velocity of the conveyor belt $\mathbf{12_1}$ which is wound around the first position is also different from that of the second position. A difference in these conveying velocities causes the color shift of the transferred images.

Therefore, a roller which has the accurate outer diameter and a large coefficient of static friction with the conveyor belt $\mathbf{12_1}$ is desirable as a driving roller. Generally, a rubber roller is inferior to a metallic roller when viewed from accuracy of the outer diameter. On the other hand, when viewed from coefficient of static friction, a rubber roller is superior to a metallic roller.

A metallic roller is used for the driving roller $\mathbf{16_1}$ and the driven roller $\mathbf{17_1}$ uses a metallic roller en which the conveyor belt $12_1$ is mounted. A pinch roller $25_1$ composed of a rubber roller is pressed against the driving roller $16_1$ at the fixed position from the outside of the conveyor belt $12_1$ so that the conveyor belt $12_1$ is wound around the driving roller $16_1$ at a winding angle above 180°.

Figure 2:
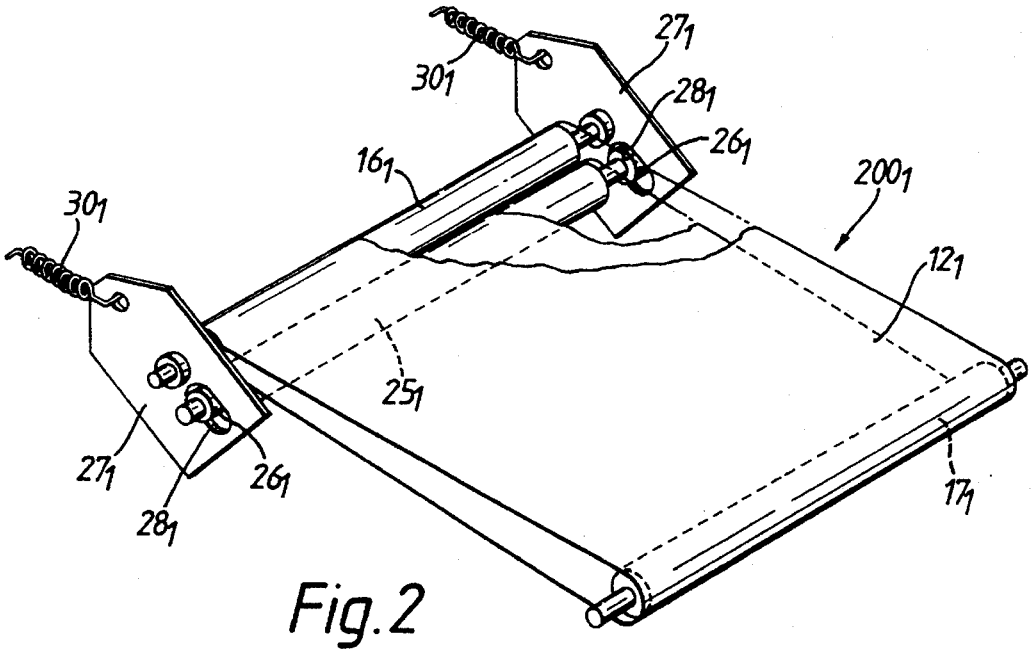
FIG. 2 is a perspective view of a conveying means using a pinch roller showing the first embodiment of the present invention.
Figure 3:
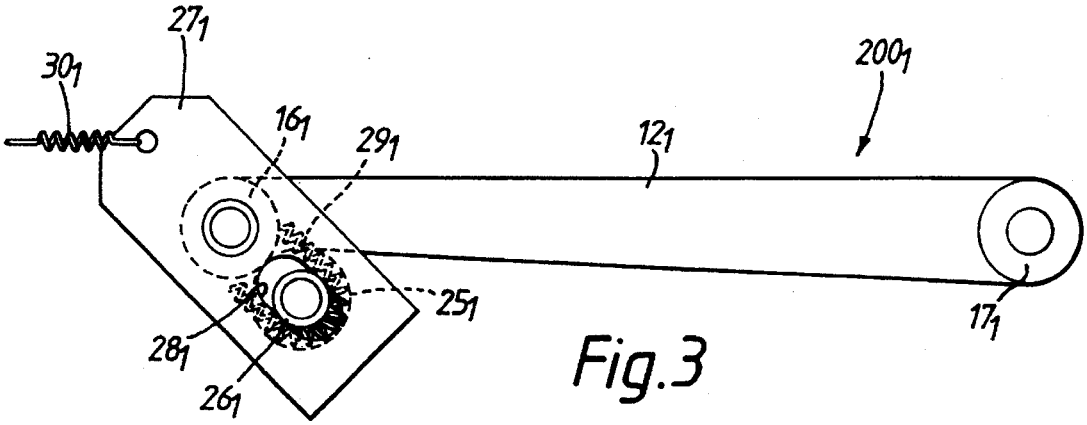
FIG. 3 is a front view of the conveying means using the pinch roller shown in FIG. 2.

FIG. 2 shows a prospective view of a system using the pinch roller $25_1$ and FIG. 3 shows its front view. Both ends of the shaft of the pinch roller $25_1$ are fixed to a bearing $26_1$ in the rotatable state. This bearing $26_1$ is put into a slot $28_1$ of the pinch roller holder $27_1$. This slot $28_1$ is provided in a state where the direction of the driving roller $16_1$ becomes long. Therefore, the pinch roller $25_1$ is movable in the direction to come in contact with/separate from the driving roller $16_1$ while rotating.

A tension spring $29_1$ is hooked on this bearing $26_1$ in the direction to apply a pressure to the rotation shaft of the driving roller. A tension spring $30_1$ is hooked on the pinch roller holder $27_1$ in the direction to have the pinch roller $25_1$ press the conveyor belt $12_1$ inward. Therefore, the pinch roller $25_1$ presses the conveyor belt $12_1$ against the driving roller $16_1$ and rolls the conveyor belt $12_1$ inward. A pressure to press the conveyor belt $12_1$ against the driving roller $16_1$ is set larger than the pressure to roll in the conveyor belt $12_1$ so that it does not move away from the driven roller $17_1$ when the pinch roller $25_1$ rolls the conveyor belt $12_1$ inward.

In this embodiment, a pressure to press the conveyor belt $12_1$ against the driving roller $16_1$ was set at 6 to 7 kg and a pressure to roll in the conveyor belt $12_1$ at 3 to 5 kg. This pressure to roll in the conveyor belt $12_1$ directly becomes a tensile force of the conveyor belt. The driving roller $16_1$ can be composed of a metallic roller using the pinch roller $25_1$ as described above and therefore, the driving roller $16_1$ of good outer diameter accuracy can be used. Further, when a metallic roller is used as the driving roller $16_1$, it is possible to drive the conveyor belt $12_1$ by the pinch roller $25_1$ without slipping against the driving roller $16_1$.

Next, the conveying means $200_2$ in the second embodiment will be described with reference to FIGS. 4 and 5.

In the second embodiment, a conveying means $200_2$ is composed in such a construction that metallic rollers are used for driving roller $16_2$ and driven roller $17_2$ over which a conveyor belt $12_2$ is put and the position of the driving roller $16_2$ only is fixed. A pinch roller $25_2$ composed of a rubber roller is pressed against the driving roller $16_2$ from the outside of the conveyor belt $12_2$.

The driven roller $17_2$ is provided with a mechanism at the shaft of both sides of the roller to make the roller movable in the direction parallel to the conveying direction of the image receiving medium 8. That is, the driven roller $17_2$ is pressed by a compression spring $18_2$ in the direction reverse to the conveying direction of the image receiving medium 8 to apply a tensile load to the conveyor belt $12_2$.

The mechanism to make the driven roller $17_2$ movable in the direction parallel to the conveying direction of the image receiving medium 8 is composed of a slot provided on the frame and a driven roller holder $21_2$ which is able to slide in the slot and holds the driven roller $17_2$ in a rotatable state.

Figure 4:
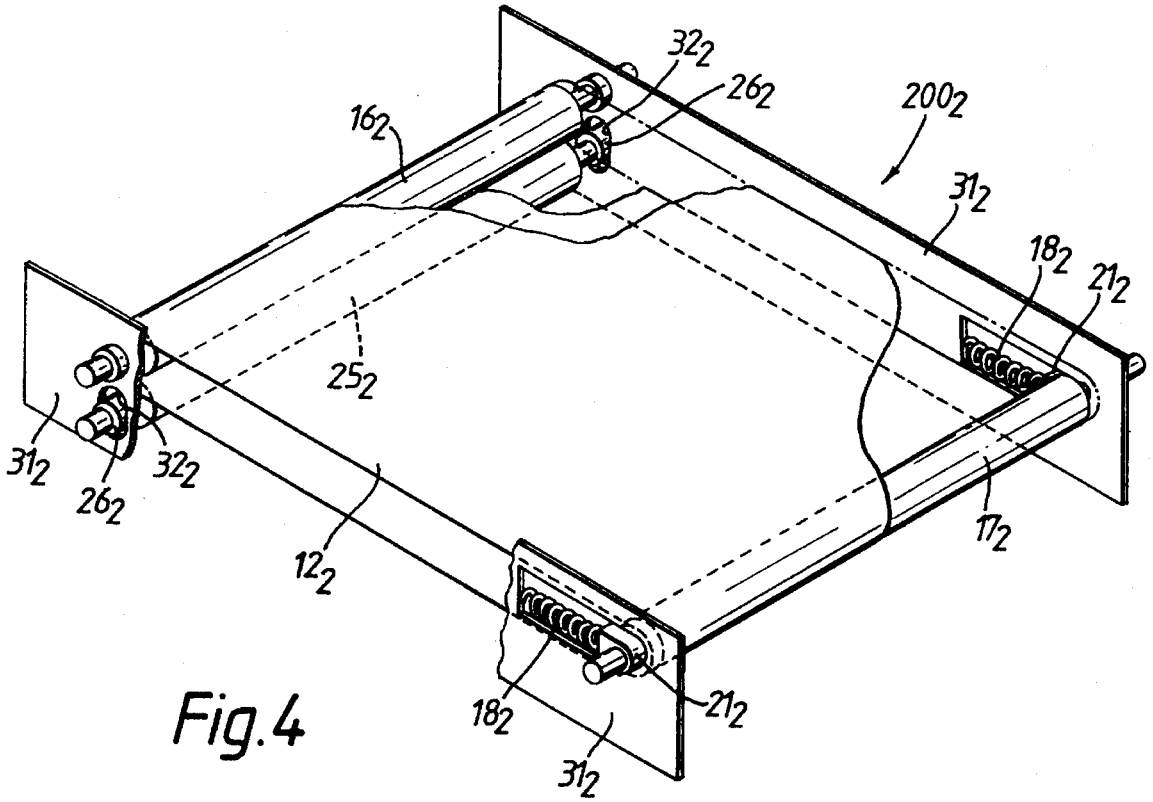
FIG. 4 is a perspective view of the conveying means using the pinch roller showing the second embodiment of the present invention.
Figure 5:
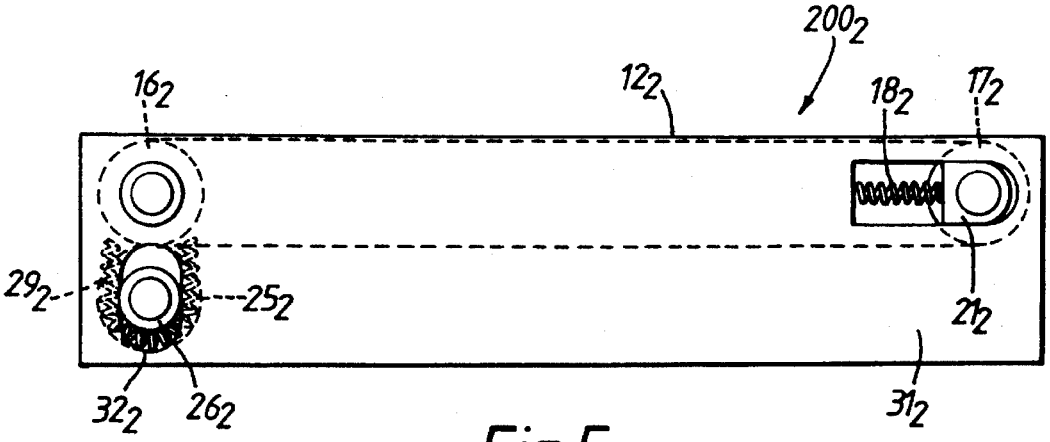
FIG. 5 is a front view of the conveying means using the pinch roller shown in FIG. 4.

FIG. 4 shows a perspective view of a system using a pinch roller and FIG. 5 shows its front view. Both ends of the shaft of the pinch roller $25_2$ are fixed to a bearing $26_2$ in the rotatable state. This bearing $26_2$ is fitted into a slot $32_2$ of a belt frame $31_2$. This slot $32_2$ is provided in a state where the direction of the driving roller $16_2$ becomes long. Therefore, the pinch roller $25_2$ is movable in the direction to come in contact with/separate from the driving roller $16_2$ while rotating.

A tension spring $29_2$ (see FIG. 5) is hooked on this bearing $26_2$ in the direction to apply a pressure to the driving roller $16_2$. Therefore, the pinch roller $25_2$ presses the conveyor belt $12_2$ against the driving roller $16_2$.

In the second embodiment, a pressure to press the conveyor belt $12_2$ against the driving roller $16_2$ was set at 6 to 7 kg and a force to apply tensile load to the conveyor belt $12_2$ by the compression spring $18_2$ was set at 3 to 5 kg. As a metallic roller can be used for the driving roller $16_2$, a driving roller in good outer diameter accuracy can be used. Further, even when a metallic roller is used for the driving roller $16_2$, it is possible to move the conveyor belt $12_2$ by the pinch roller $25_2$ without slipping against the driving roller $16_2$.

As described above, use of the pinch roller $25_2$ in a simple construction makes it possible to prevent the conveyor belt $12_2$ from slipping against the driving roller $16_2$ and eliminate an image color shift on the image receiving medium in the conveying direction due to the slip of the conveyor belt.

Next, a conveying means $200_3$ in the third embodiment will be described with reference to FIGS. 6 and 7.

In the third embodiment, a metallic roller is used for a driving roller $16_3$ and a driven roller $17_3$ on which a conveyor belt $12_3$ is put. These rollers $16_3$ and $17_3$ are fixed and a winding roller $33_3$, which is a rubber roller, is arranged while pressing it from the outside of the conveyor belt $12_3$. The winding angle of the conveyor belt to the driving roller is set at below 180°.

Figure 6:
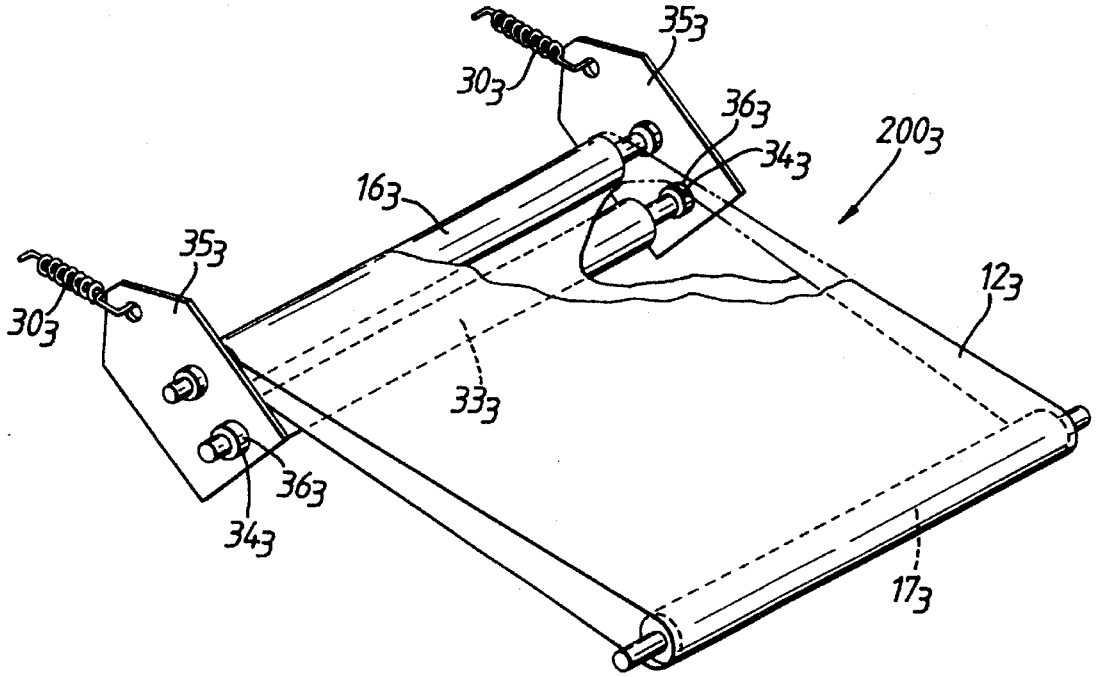
FIG. 6 is a perspective view of the conveying means using a winding roller showing the third embodiment of the present invention.
Figure 7:
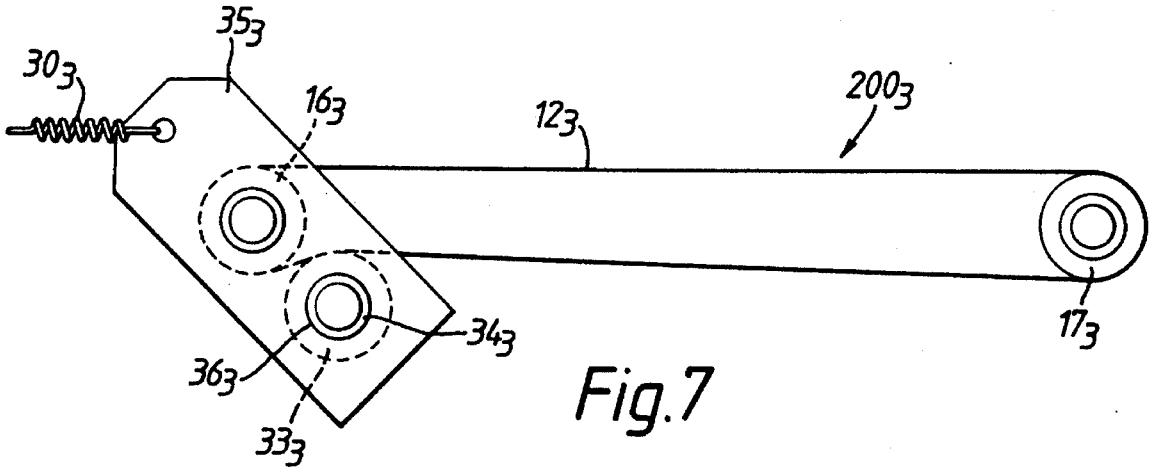
FIG. 7 is a front view of the conveying means using the winding roller shown in FIG. 6.

FIGS. 6 shows a perspective view of a system using the winding roller $33_3$ and FIG. 7 shows its front view. Reference number $34_3$ shows a pair of winding roller bearings, $35_3$ shows a pair of winding roller holders and $36_3$ shows holes provided on the winding roller holders $35_3$. The rotary shafts at both sides of the winding roller $33_3$ are fixed to the bearings $34_3$ in a rotatable state. The bearings $34_3$ are fitted in the holes $36_3$ of the winding roller holders $35_3$, respectively.

These holes $36_3$ are provided at positions parallel to the shaft of the driving roller $16_3$. Each or the winding roller holders $35_3$ is provided with a tensile spring $30_3$ which gives a tensile force to the conveyor belt $12_3$ by pressing the winding roller $33_3$ against the inside of the conveyor belt $12_3$. Therefore, the winding roller $33_3$ is able to bring the conveyor belt $12_3$ in contact with the driving roller $16_3$ at a winding angle above 180°. A tensile force to be generated on the conveyor belt $12_3$ when the winding roller $33_3$ rolls the conveyor belt $12_3$ in was so set that it becomes 3 to 5 kg.

Next a conveying means $200_4$ in the fourth embodiment will be described with reference to FIGS. 8 and 9.

In the fourth embodiment, a metallic roller is used for a driving roller $16_4$ and a driven roller $17_4$ over which a conveyor belt $12_4$ is put, and only the position of the driving roller $16_4$ is fixed. A winding roller $33_4$ which is a rubber roller, is fixed to press the conveyor belt $12_4$ from its outside at the center of the driving roller $16_4$ and the driven roller $17_4$.

The driven roller $17_4$ is provided with a mechanism which makes it movable in the direction parallel to the conveying direction of the image receiving medium 8 at the shaft at both sides of the roller. That is, the driven roller $17_4$ is pressed by a compression spring $18_4$ in the direction reverse to the conveying direction of the image receiving medium 8 to apply a tensile load to the conveyor belt $12_4$.

The mechanism to make the driven roller $17_4$ movable in the direction parallel to the conveying direction of the image receiving medium 8 is composed of slot $32_4$ provided on the frame $31_4$ and a driven roller holder $21_4$ which is able to slide in the slot $32_4$ and holds the driven roller $17_4$ in the rotatable state.

Figure 8:
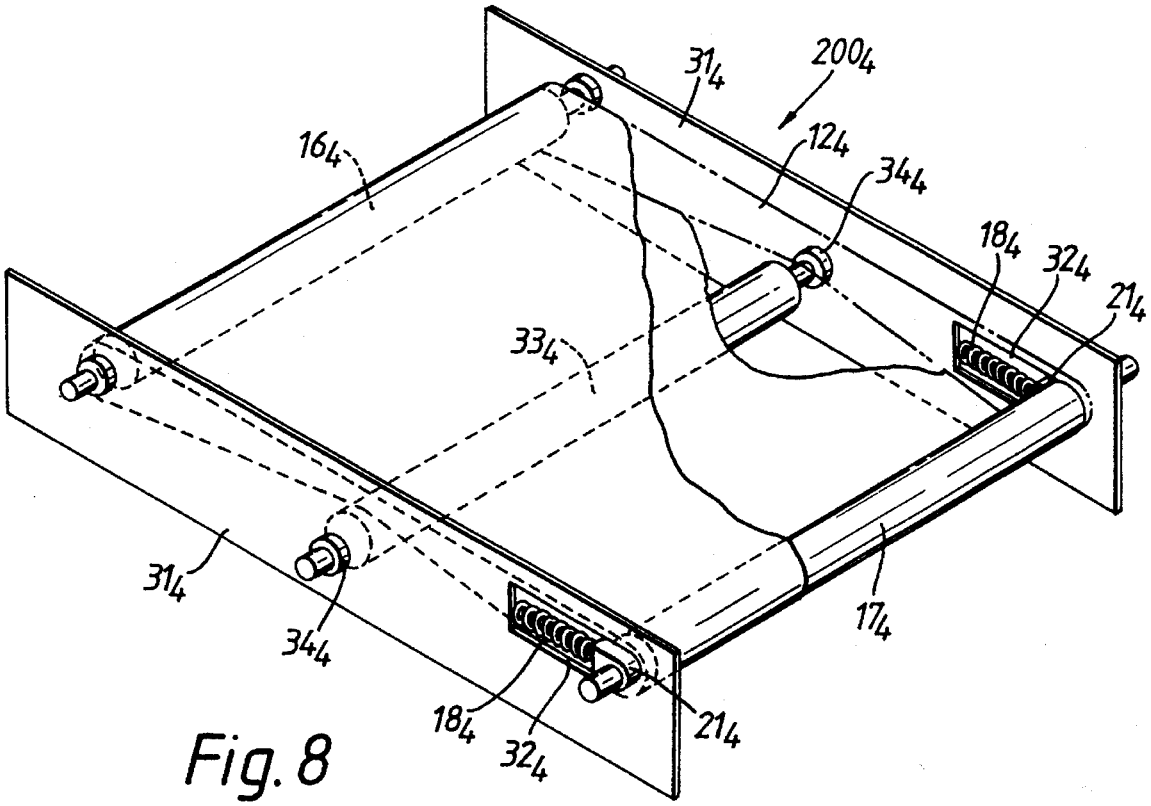
FIG. 8 is a perspective view of the conveying means using a winding roller showing the fourth embodiment of the present invention.
Figure 9:
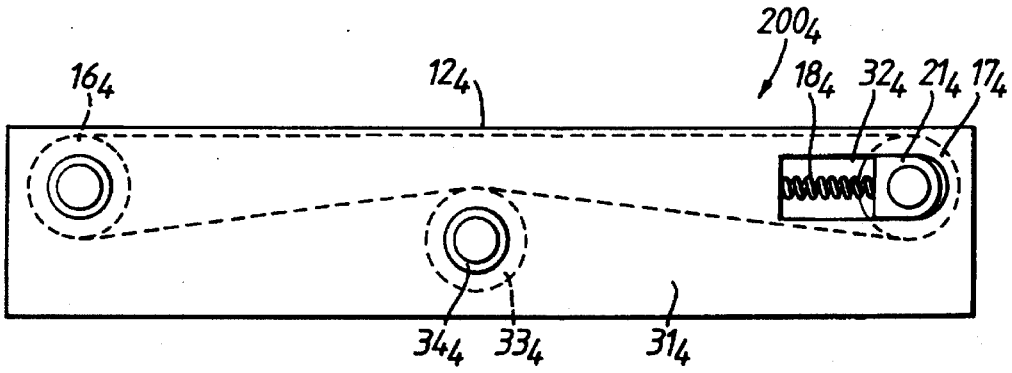
FIG. 9 is a front view of the conveying means using the winding roller shown in FIG. 8.

FIG. 8 shows a perspective view of a system using a winding roller $33_4$ and FIG. 9 shows its front view. Reference number $34_4$ shows a bearing of the winding roller $33_4$ and $31_4$, shows a belt frame. Both ends of the shaft of the winding roller $33_4$ are fixed to bearings $34_4$ in a rotatable state. The bearing $34_4$ is fitted in a hole provided on the belt frame $31_4$. This hole is provided at a position where the winding roller $33_4$ presses the conveyor belt $12_4$ against the inside and it is parallel to the driving roller $16_4$. Therefore, the winding roller $33_4$ is able to bring the conveyor belt $12_4$ in contact with the driving roller $16_4$ at a winding angle above 180°.

In this fourth embodiment, the compression spring $18_4$ is compressed as the conveyor belt $12_4$ is pressed inward by the winding roller $33_4$ to give a tensile load of 3 to 5 kg to the conveyor belt $12_4$.

As a metallic roller can be used for the driving roller $16_4$ when the winding roller $33_4$ is used as described above, it becomes possible to use the driving roller $16_4$ in good outer diameter accuracy. Further, even when a metallic roller is used for the driving roller $16_4$, a large contact area between the driving roller $16_4$ and the conveyor belt $12_4$ can be made available by the winding roller $33_4$ and therefore, it is possible to drive the conveyor belt $12_4$ without slipping against the driving roller $16_4$.

As described in detail in the above, use of the winding roller $33_4$ in very simple construction makes it possible to hove the conveyor belt $12_4$ at a constant velocity without slipping between the conveyor belt $12_4$ and the driving roller $16_4$. Accordingly, it is also possible to eliminate the color shift on the formed images transferred on the image receiving medium 8 in the conveying direction of the conveyor belt $12_4$.

Next, a conveying means $200_5$ in the fifth embodiment will be described with reference to FIGS. 10 and 11.

Figure 10:
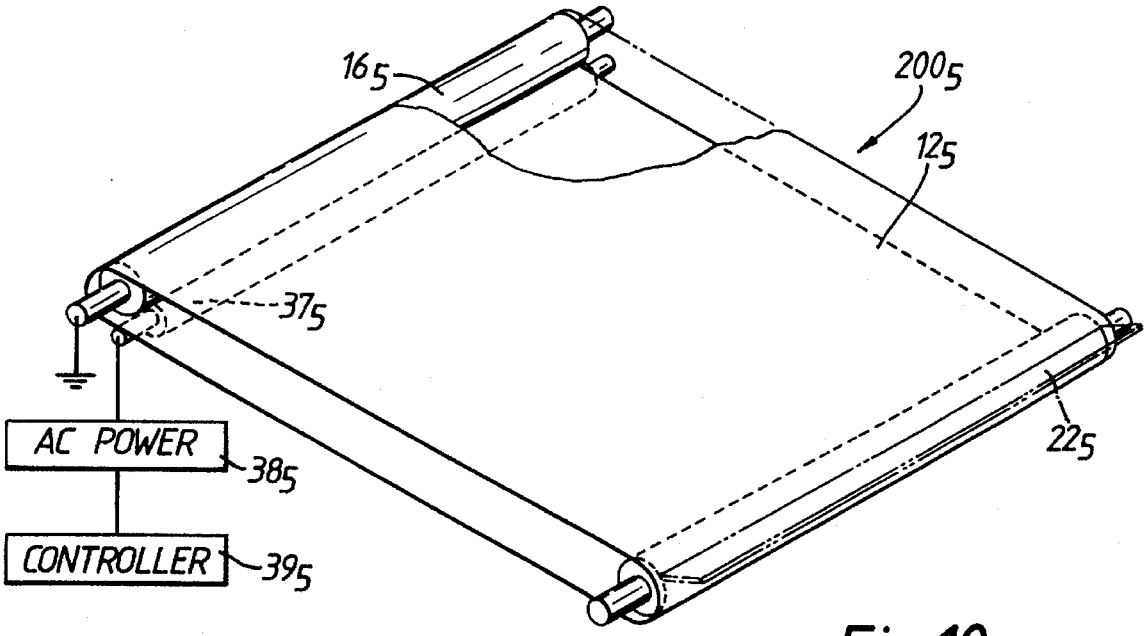
FIG. 10 is a perspective view of the conveying means with a discharging roller provided showing the fifth embodiment of the present invention.
Figure 11:
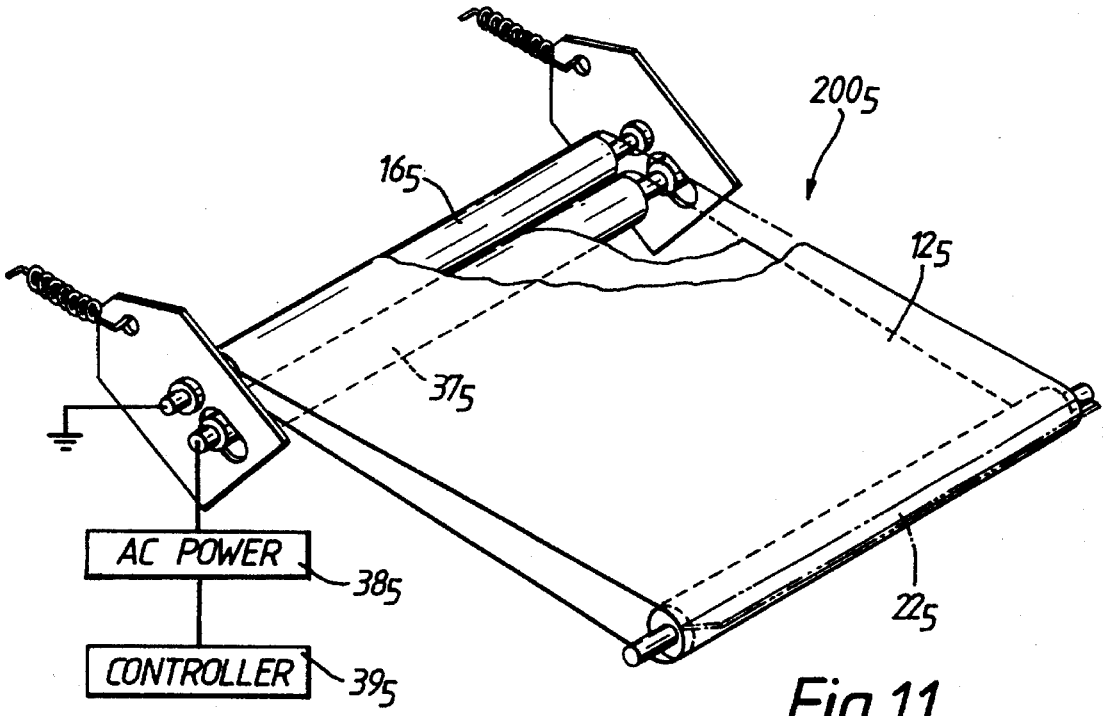
FIG. 11 is a prespective view of the conveying means with the discharging roller shown in FIG. 10 provided as the pinch roller shown in the first embodiment.

FIG. 10 shows a perspective view of a system using a discharging roller $37_5$. Reference number $38_5$ is an AC power supply unit and $39_5$ is a controller. A driving roller $16_5$ is composed of a metallic roller with a conductive rubber wound around it and therefore it is conductive. The driving roller $16_5$ is electrically earthed. A conveyor belt $12_5$ is wound around the driving roller $16_5$ and a conductive metallic discharging roller $37_5$ is provided in contact with the conveyor belt $12_5$.

The discharging roller $37_5$ is arranged in contact with the conveyor belt $12_5$. In this embodiment, the metallic discharging roller $37_5$ is used but is not limited to a roller if it is conductive. For instance, a conductive brush, a conductive brush roller or a conductive plastic roller can be used. The discharging roller $37_5$ is connected to an AC power supply unit $38_5$ which is an AC voltage supply means for supplying AC voltage.

The AC power supply unit $38_5$ is connected to the controller $39_5$ which is a control means for controlling the AC power supply unit $38_5$. The conveyor belt $12_5$ passes through this discharging roller $37_5$ with the rotation of the driving roller $16_5$. The controller $39_5$ controls the AC power supply unit $38_5$ to supply AC voltage to the discharging $37_5$ according to a preset program. As a result, the surface of the conveyor belt $12_5$ charged to plus and the back side charged to minus are neutralized. Thereafter, the conveyor belt $12_5$ is moved to a belt cleaning device $22_5$ in the neutralized state. Thus, when the conveyor belt $12_5$ is discharged and moved to the belt cleaning device $22_5$, the belt can be easily cleaned. Further, as a result of this discharging, the image transfer can be made under the same charged condition of the conveyor belt $12_5$ and it is unnecessary to change transfer voltage in a continuous image transfer.

As an example of application, it is possible to use the pinch roller $25_1$ described in the first embodiment as the discharging roller $37_5$. In this case, as the characteristic of the pinch $25_1$, a material having a high coefficient of friction is needed and when a conductive rubber roller is used for the pinch roller $25_1$, it becomes possible to construct a pinch roller which also serves as a discharging roller.

Further, in this case it is also necessary to make the pinch roller bearing or the pinch roller holder using an electrically insulated material in order to prevent the discharging voltage from flowing to the driving roller through the bearing.

As described in detail in the above, according to this fifth embodiment, it is possible to discharge the surface of the conveyor belt by a very simple mechanism without generating ozone.

Next, a conveying means $200_6$ in the sixth embodiment will be described with reference to FIGS. 12 to 16.

Figure 12:
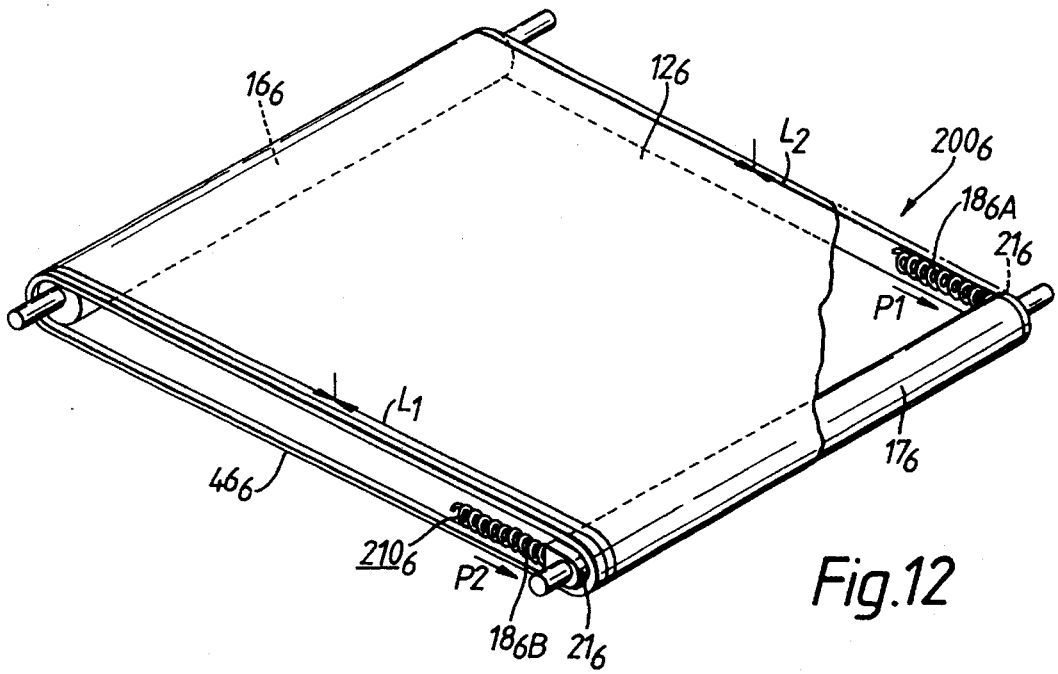
FIG. 12 is a perspective view showing the sixth embodiment of the present invention less a part of the conveying means which is its essential part.

FIG. 12 shows the outline of the construction of a conveying means $200_6$. Reference number $12_6$ shows a conveyor belt, $16_6$ shows a driving roller, $17_6$ shows a driven roller, $46_6$ shows a regulation belt, $18_6$A and $18_6$B show a first compression spring and a second compression spring to give a tensile force to the conveyor belt $12_6$, and $21_6$ shows a driven roller bearing. The regulation belt $46_6$ is mounted or formed along an inner side at one end of the conveyor belt $12_6$. The endless type conveyor belt $12_6$ is driven by the driving roller $16_6$ and the driven roller $17_6$. The driven roller $17_6$ gives a tensile force to the conveyor belt $12_6$ when its bearing $21_6$ is pressed by the first and the second compression springs $18_6$A and $18_6$B.

When a cause for generating a skid of the conveyor belt $12_6$ was investigated to reveal that it was largely affected by a difference in pressures generated by the first and the second compression springs $18_6$A and $18_6$B. The results of this test are shown in FIGS. 13 and 14.

Figure 13:
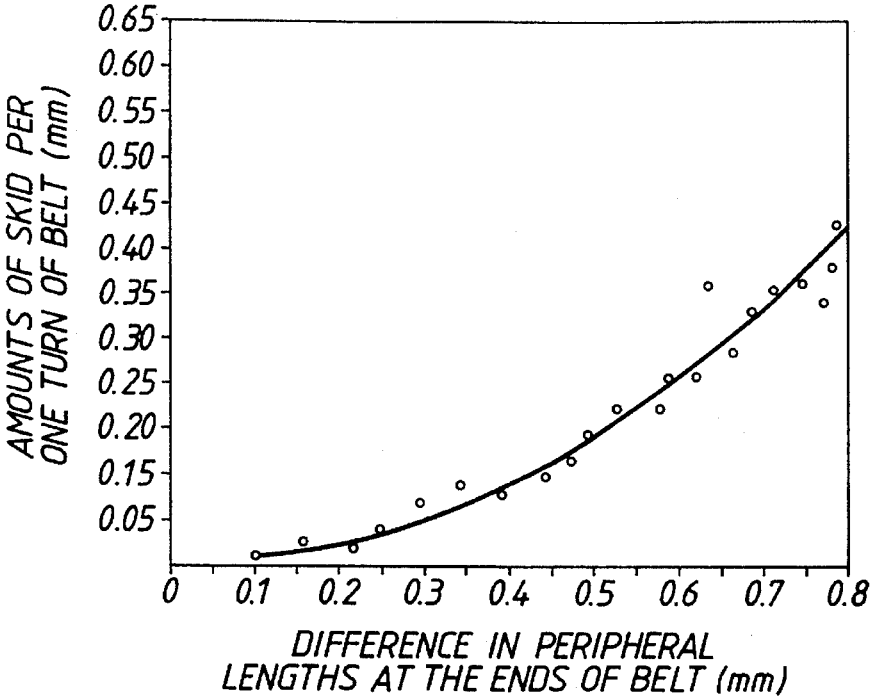
FIG. 13 is a graph showing a test result of difference in peripheral lengths and amount of skid movement of the conveyor belt.

FIG. 13 shows the test result of amounts of skid per one turn of an endless type conveyor belt which was prepared by cutting a belt into several pieces in trapezoidal shape intentionally giving different peripheral lengths and connecting their ends to an endless conveyor belt. The axis of abscissa shows differences in peripheral lengths at the ends of a belt and the axis of ordinate shows amount of skid per one turn of the belt.

In this test, for the purpose of making clear an effect of only peripheral length of the belt, a precisely prepared weight is used for giving a tensile force to the belt. Further, the shorter peripheral length side was made as the plus side of skid direction of the belt. As a result, it is seen that the larger a difference in peripheral lengths becomes, the larger the skid becomes. Furthermore, it is also seen that the skid progresses at the shorter peripheral length side of the belt.

Figure 14:
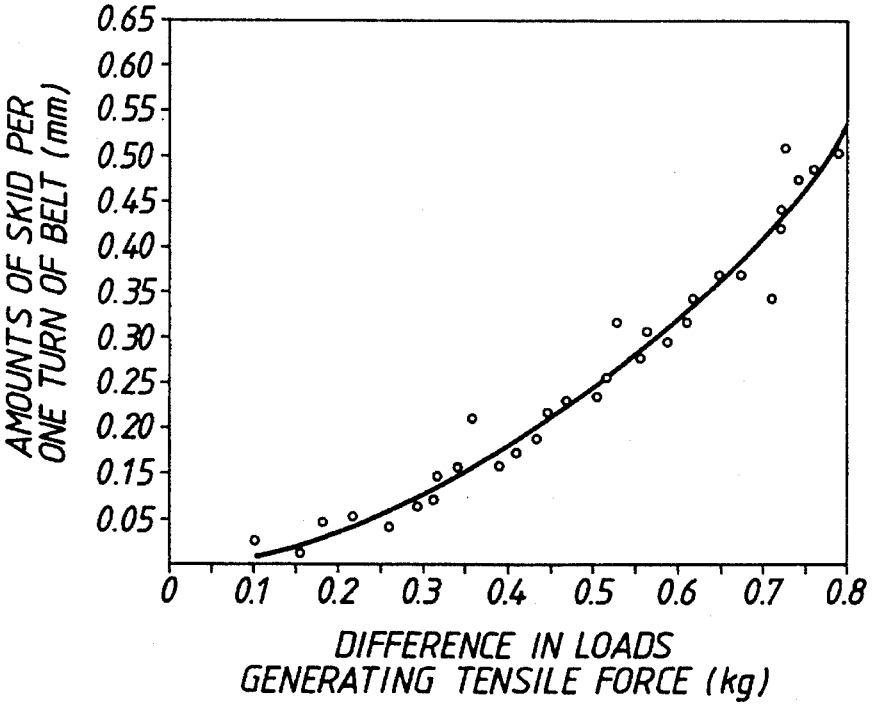
FIG. 14 is a graph showing a test result of weighing and skid amount of the conveyor belt.

On the other hand, shown in FIG. 14 is an amount of skid per one turn of the belt measured by changing a difference in loads applied at both sides, and a difference in spring loads generating a tensile force is shown. The axis of abscissa shows differences in spring loads generating tensile force and the axis of ordinate shows amount of skid per one turn of the belt on the axis of ordinates.

The graph in FIG. 14 shows "Difference in Spring Loads Generating Tensile Force". In this test, for the purpose of conducting the test by making the load difference clear, a precisely prepared weight was used.

Further, for the purpose of investigating an effect of load difference only, a belt manufactured precisely in micron unit on an experimental basis was used. Further, the side of the belt having a larger tensile force generating spring load applied was made as the plus side of skid direction of the belt.

As a result, it is seen that the larger a load difference becomes, the larger the degree of skid becomes correspondingly. Further, it is also seen that the skid of the belt progresses at the side with a larger belt tensile force generating spring load.

Now, these two test results can be summarized as follows:

(1) The skid of the belt progresses at the short peripheral length side.

(2) The skid of the belt progresses at the large load side.

On the other hand, it is impossible to make the peripheral lengths of the conveyor belts $12_6$ completely equal on all actual apparatus. Further, it is also impossible to completely eliminate fluctuations of the first and the second compression springs $18_6$A and $18_6$B.

It was decided to control the direction of skid of the conveyor belt $12_6$ based on the above results in this embodiment.

That is, as illustrated in FIG. 12, the endless type conveyor belt $12_6$ put ever the driving roller $16_6$ and the driven roller $17_6$ is made in the construction having a difference in its peripheral lengths at both sides of L1>L2 when the peripheral lengths at both sides are L1 and L2.

As a means for giving a tensile force to the conveyor belt $12_6$, a tensioning mechanism $210_6$ is composed of a first and a second compression springs $18_6$A and $18_6$B which are a first and a second tensioning members. That is, the first compression spring $18_6$A having a strong pressure P1 is arranged at the shorter peripheral length L2 side of the conveyor belt $12_6$ and the second compression spring $18_6$B having a weak pressure P2 (P1>P2) is arranged at the longer peripheral length L1 side.

As a result of this construction, the conveyor belt $12_6$ skids always to the first compression spring $18_6$A side having a strong pressure P1 at the shorter peripheral length L2 side.

On the other hand, a regulation belt $46_6$ is provided along the peripheral edge of the conveyor belt $12_6$ with the second compression spring $18_6$B having a weak pressure P2 arranged at the longer peripheral length L1 side. And, by bringing this regulation belt $46_6$ in contact with the end of the driven roller $17_6$ (or the driving roller $16_6$), the skid of the conveyor belt $12_6$ is prevented.

Figures 15A, 15B, 15C:
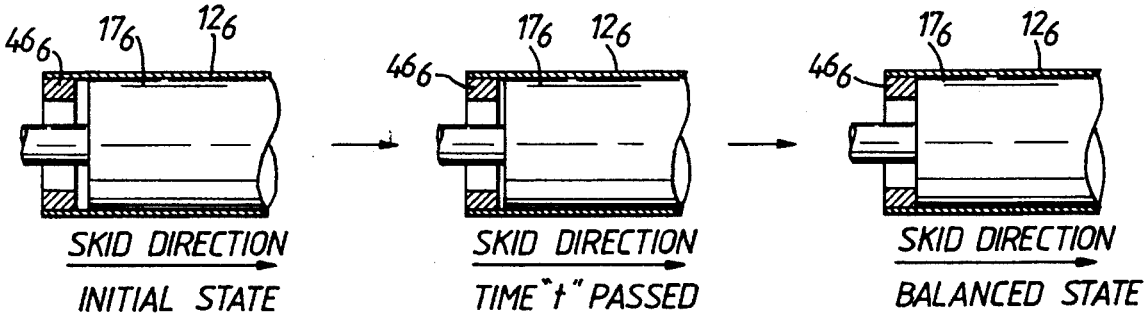
FIG. 15A through 15C are cross-sectional views showing the positional relation between the conveyor belt and the regulation belt.

The construction of this regulation belt $46_6$ is as shown in FIGS. 15A to 15C. That is, this regulation belt $46_6$ is in the thick belt shape and provided along the back side of the peripheral edge of the conveyor belt $12_6$ with the second compression spring $18_6$B arranged.

As the conveyor belt $12_6$ always skids to the first compression spring $18_6$A side having the strong pressure P1 at the shorter peripheral length L2 side, after a time "t" passed shown in FIG. 15B from the initial state shown in FIG. 15A, the regulation belt $46_6$ runs against the end of the driven roller $17_6$ to prevent the further movement of the conveyor belt, which is then brought in the balanced state.

Figure 16:
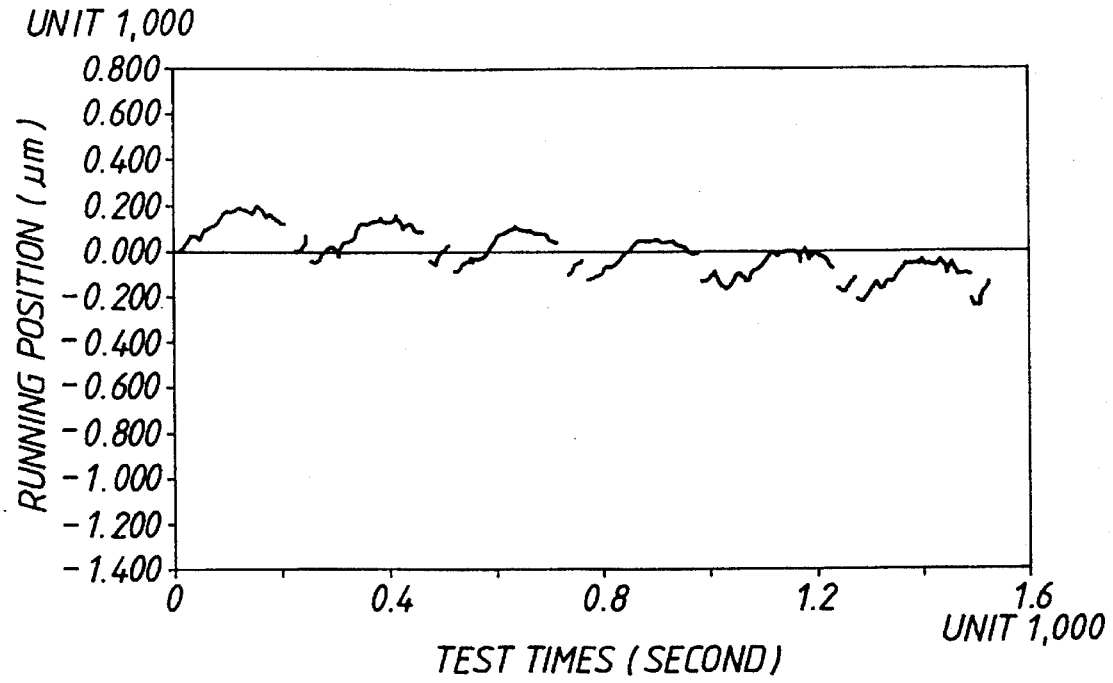
FIG. 16 is a graph showing the state of skid movement of the conveyor belt when the construction of the sixth embodiment is not adopted.

FIG. 16 shows the result of the skid of the conveyor belt when the measures described above were not taken and FIG. 17 shows the result of the skid of the conveyor belt when the measures described above were taken.

As the results of this test, running times of the belt shown in "Test Time (Second)" are plotted on the axis of abscissas and "Running Position (μm)" showing amounts of the skids of the belt are plotted on the axis of ordinates.

As clear from these test results, the amount of the skid of the belt which was traveled without setting its mounting and pressure was large, the color shift of images on the image receiving medium 8 tends to occur in the direction perpendicular to the moving direction of the conveyor belt $12_6$. However, the skid of the conveyor belt is very small when the belt was traveled with its mounting and pressure set, and it can be seen that the conveyor belt $12_6$ was in the stable running state scarcely causing the color shift of images on the image receiving medium 8 in the direction perpendicular to the moving direction of the conveyor belt $12_6$.

Figure 17:
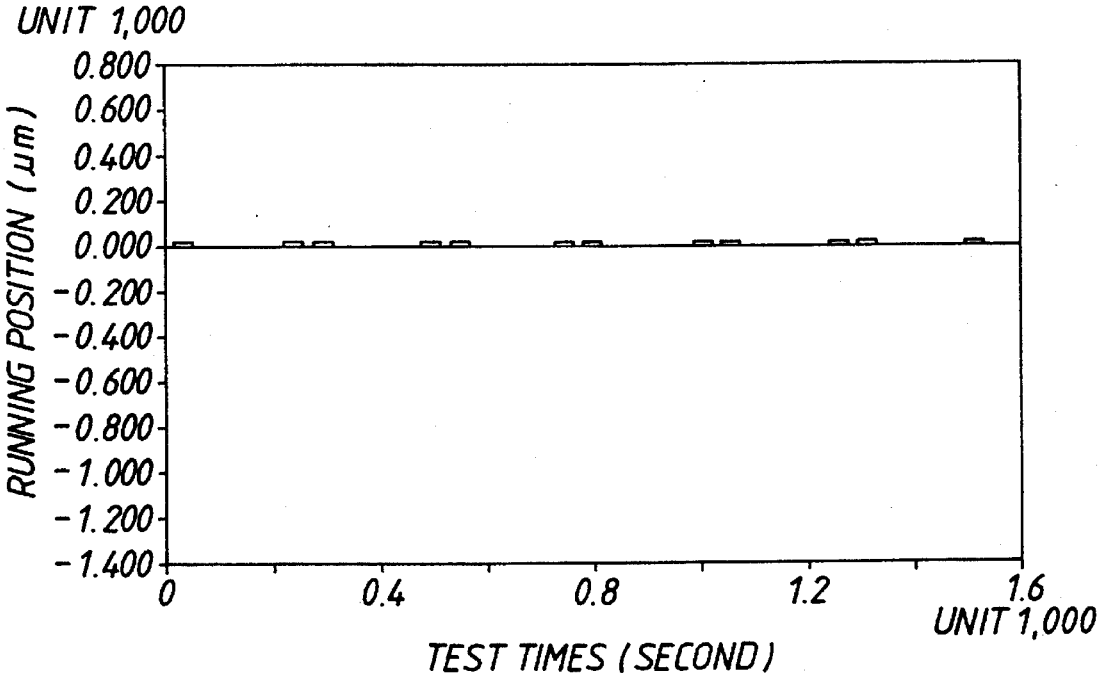
FIG. 17 is a graph showing the state of skid movement of the conveyor belt when the construction of the sixth embodiment is adopted.

The test results shown in FIGS. 16 and 17 are one example. A further statistic test revealed that the same effect is obtained up to a difference in peripheral lengths of 2 mm of both sides of a belt if a difference in pressures applied is suppressed to accuracy of 1 kg according to the construction in the sixth embodiment. Accuracy of length ±0.01 mm and pressure ±50 g was demanded for a conventional belt and therefore, when a belt in this construction is used, it is possible to effectively control and restrain the skid direction without demanding high accuracy.

As described above, the conveying means in the sixth embodiment is capable of controlling the skid of the conveyor belt $12_6$ in a very simple construction.

Next, a conveying means $200_7$ in the seventh embodiment will be described with reference to FIGS. 18 to 23.

Figure 18:
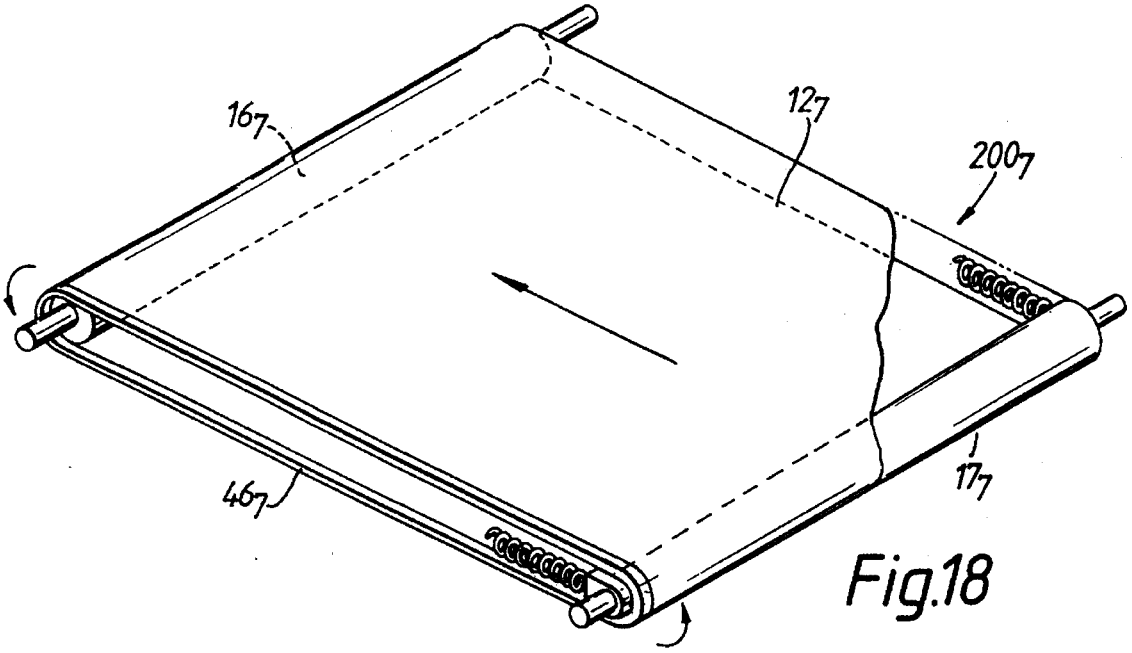
FIG. 18 is a perspective view showing the seventh embodiment of the present invention less a part of the conveying means which is its essential part.
Figure 19:
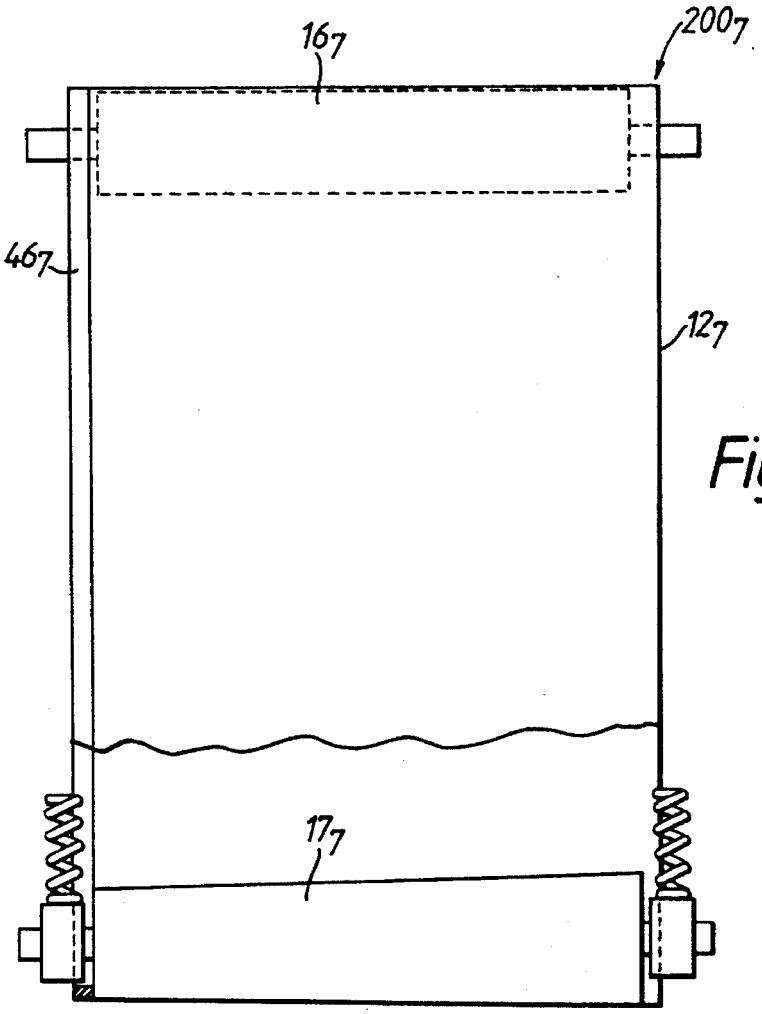
FIG. 19 is a plan view of the seventh embodiment less a part of the conveying means.

As illustrated in FIGS. 18 and 19, a tapered roller $17_7$ is used as a driven roller. This roller is tapered so that its diameter is increased gradually to a large diameter from one end to another end. The regulation belt $46_7$ is positioned at the small diameter side of the tapered roller $17_7$ and mounted along the back side of the peripheral edge of a conveyor belt $12_7$ in the same manner as in FIGS. 15A to 15C.

When the conveyor belt $12_7$ is put over driving roller $16_7$ and the tapered roller $17_7$ which is a driven roller, the conveyor belt $12_7$ skids toward the large diameter of the tapered roller $17_7$.

Figure 20:
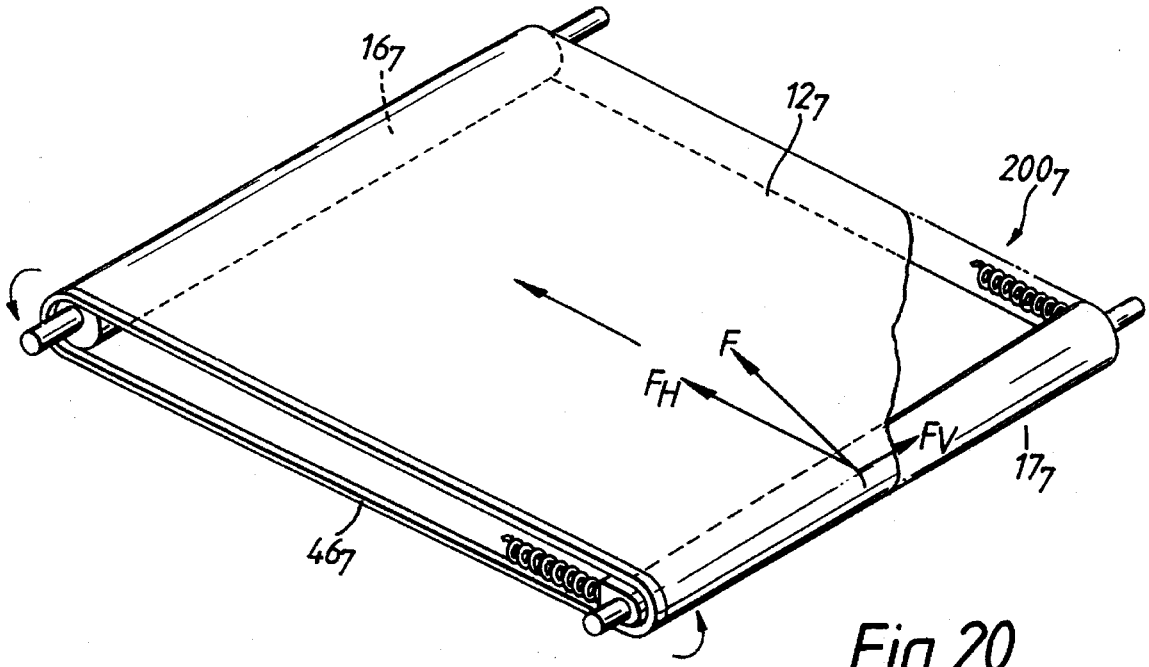
FIG. 20 is a perspective view for explaining the skid movement of the conveyor belt in the seventh embodiment.

In this case, on the conveyor belt $12_7$ being pulled along the tapered roller $17_7$, a tensile force F acting in the vertical direction is first generated on its inclined portion, which is above the inclined portion of the tapered roller $17_7$ as illustrated in FIG. 20. When the conveyor belt $12_7$ is moving, the tensile force F is divided into FH in the belt conveying direction and $F_V$ in the vertical direction and these divided forces act on the conveyor belt. The direction $F_V$ vertical to the conveying direction of the belt is the direction toward the large diameter of the tapered roller $17_7$ and the conveyor belt $12_7$ is moved one-sidedly toward the direction of the large diameter of the tapered roller $17_7$ by this force $F_V$. That is, the direction of the skid of the conveyor belt $12_7$ can be controlled using the tapered roller $17_7$ as a driven roller.

If the direction of the skid can be controlled, a single piece of the belt $46_7$ is sufficient to restrain progress of the skid. That is, it can be achieved by providing the regulation belt $46_7$ only at the inside of the conveyor belt $12_7$ at its small diameter side.

That is, the conveyor belt $12_7$ skids toward the large diameter side but when the conveyor belt $12_7$ moves one-sidedly for a certain amount, the skid regulation belt $46_7$ is slid to the roller end surface of the small diameter side of the tapered roller $17_7$, stopping the further skid at a position where the skid force of the conveyor belt $12_7$ is balanced with the rubber repulsive force of the belt $46_7$.

Once these forces are balanced each other, the conveyor belt $12_7$ is moved continuously in this balanced stated.

Figure 21:
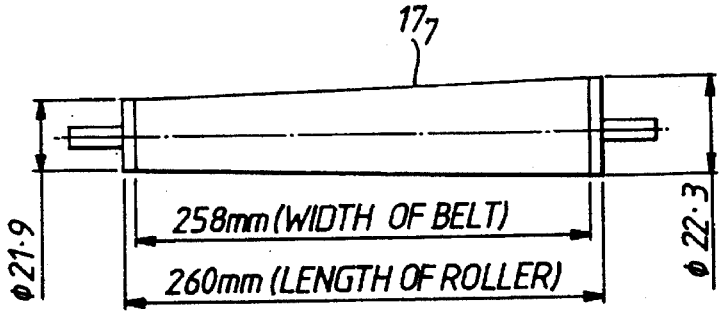
FIG. 21 is a front view for explaining the size and tapered state of a tapered roller used in the seventh embodiment.

FIG. 21 shows a definite dimensional relation of the shape of the tapered roller $17_7$ and the conveyor belt $12_7$ which were used in the seventh embodiment. That is, the tapered roller $17_7$ is 260 mm long and the conveyor belt $12_7$ put on this tapered roller $17_7$ is 258 mm wide. The diameter of the large diameter portion of this tapered roller $17_7$ is 22.3 mm and that of the small diameter portion is 21.9 mm. Therefore, as shown by the following expression, this tapered roller $17_7$ has a taper of 0.001538.

$$22.3-21.9/260=0.001538$$

Figure 22:
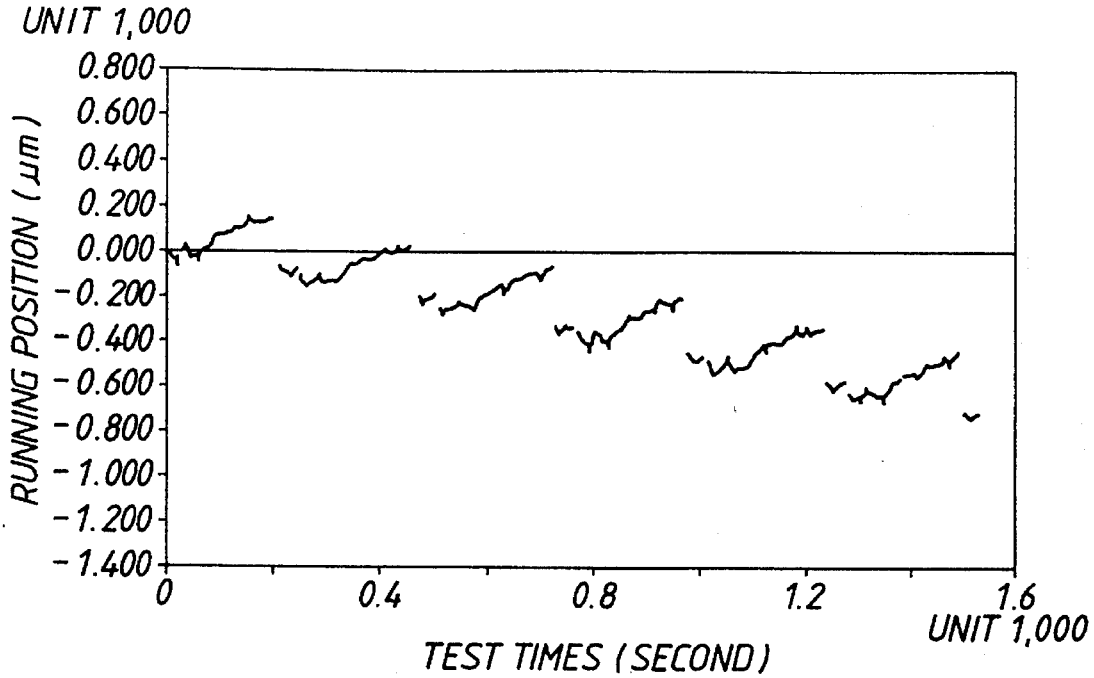
FIG. 22 is a graph showing the state of skid movement of the conveyor belt when the construction of the seventh embodiment is not adopted.
Figure 23:
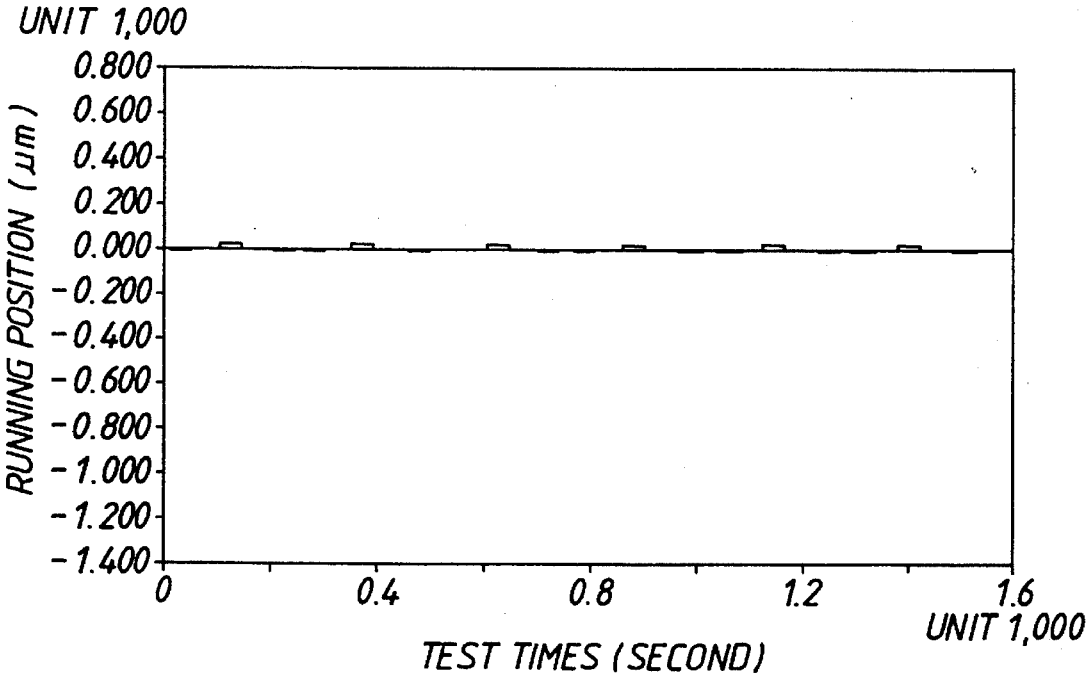
FIG. 23 is a graph showing the state of skid movement of the conveyor belt when the construction of the seventh embodiment is adopted.

FIG. 22 shows the test result of skid of the conveyor belt when no measures described above were taken and FIG. 23 shows the test result of skid of the conveyor belt when the measures described above were taken.

As the result of this test, "Test Times (Sec.)" showing the running times of the conveyor belt were plotted on the axis of abscissas and "Running Positions (μm)" showing amount of skid of the conveyor belt were plotted on the axis of ordinates.

Therefore, the skid of the conveyor belt when it was moved without raking any measure is large while the color shift of images on the image receiving medium 8 tends to occur in the direction perpendicular to the moving direction of the conveyor belt $12_7$. However, it is seen that the skid of the conveyor belt when it was moved with the tapered roller $17_7$ and the regulation belt $46_7$ provided is very small and the belt ran in the stable state scarcely causing the color shift of images on the image receiving medium 8 in the direction perpendicular to the moving direction of the conveyor belt $12_7$.

The tapered roller $17_7$ shown in this seventh embodiment is not needed to be applied as a driven roller, and when used as a third roller other than the driving roller $16_7$ and the driven roller $17_7$, its effect will not be changed. Further, it is also not required to have the tapered roller $17_7$ act from the inside of the conveyor belt $12_7$ and its effect is not changed even when it was acted on the surface of the conveyor belt $12_7$.

Further, in this seventh embodiment the tapered roller $17_7$ was described as a driven roller and its small diameter side end surface was explained as the surface contacting the regulation belt $46_7$. However, not limited to these usages, the end surface of the driving roller $16_7$ may be used as the skid prevention surface and even when a roller having an original skid prevention surface is provided, its effect will not be changed.

As described above, the skid of the conveyor belt $12_7$ can be controlled by a mechanism in very simple construction.

Next, a conveying means $200_8$ in the eighth embodiment will be described with reference to FIGS. 24 to 28.

Figure 24:
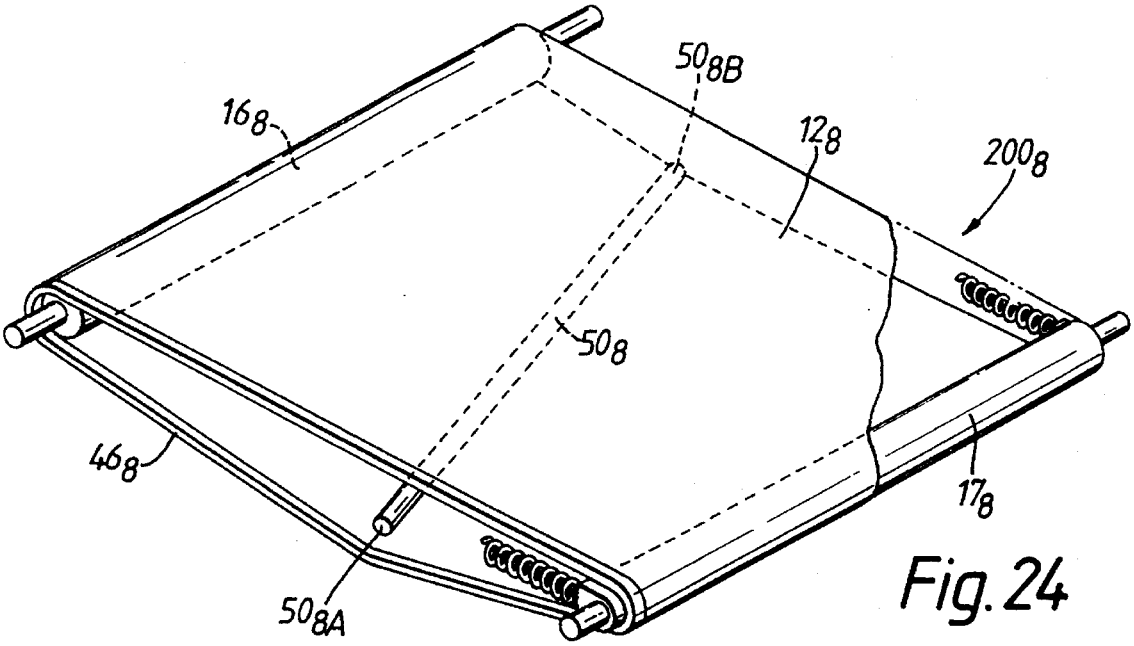
FIG. 24 is a perspective view showing the eighth embodiment less a part of the conveying means which is its essential part.
Figure 25:
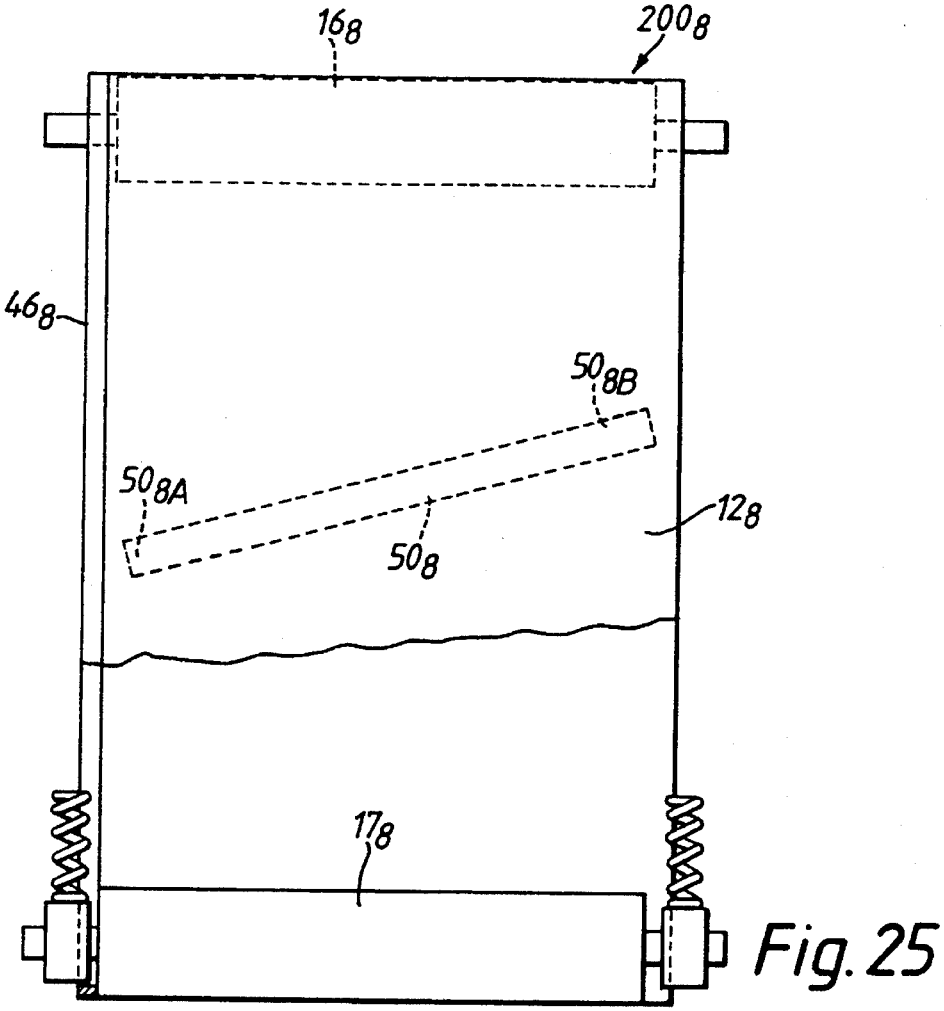
FIG. 25 is a plan view showing the eighth embodiment less a part of the conveying means.

As illustrated in FIGS. 24 and 25, between the driving roller $16_8$ and the driven roller $17_8$ arranged parallel to each other, there is a diagonal roller $50_8$ arranged diagonally to these rollers $16_8$ and $17_8$. That is, it is arranged so that its one end $50_8$A is close to the driven roller $17_8$ and another end $50_8$B is close to the driving roller $16_8$.

Further, this diagonal roller $50_8$ is arranged slightly below the plane surface connecting a driving roller $16_8$ and a driven roller $17_8$ and functions as a skid moving direction control roller. A conveyor belt $12_8$ is put over these driving roller $16_8$, the diagonal roller $50_8$ and the driven roller $17_8$. On the other hand, a regulation belt $46_8$ is provided along the side edge of the conveyor belt $12_8$ having a longer distance between the driving roller $16_8$ and the diagonal roller $50_8$. The regulation belt $46_8$ is in the construction as illustrated in FIGS. 15A to 15C.

In the conveying means $200_8$ in this construction, when moved, the conveyor belt $12_8$ progressively skids toward the end having a shorter distance between the diagonal roller $50_8$ and the driving roller $16_8$, that is, the conveyor belt $12_8$ skids to the end $50_8$B of the diagonal roller $50_8$.

Figure 26:
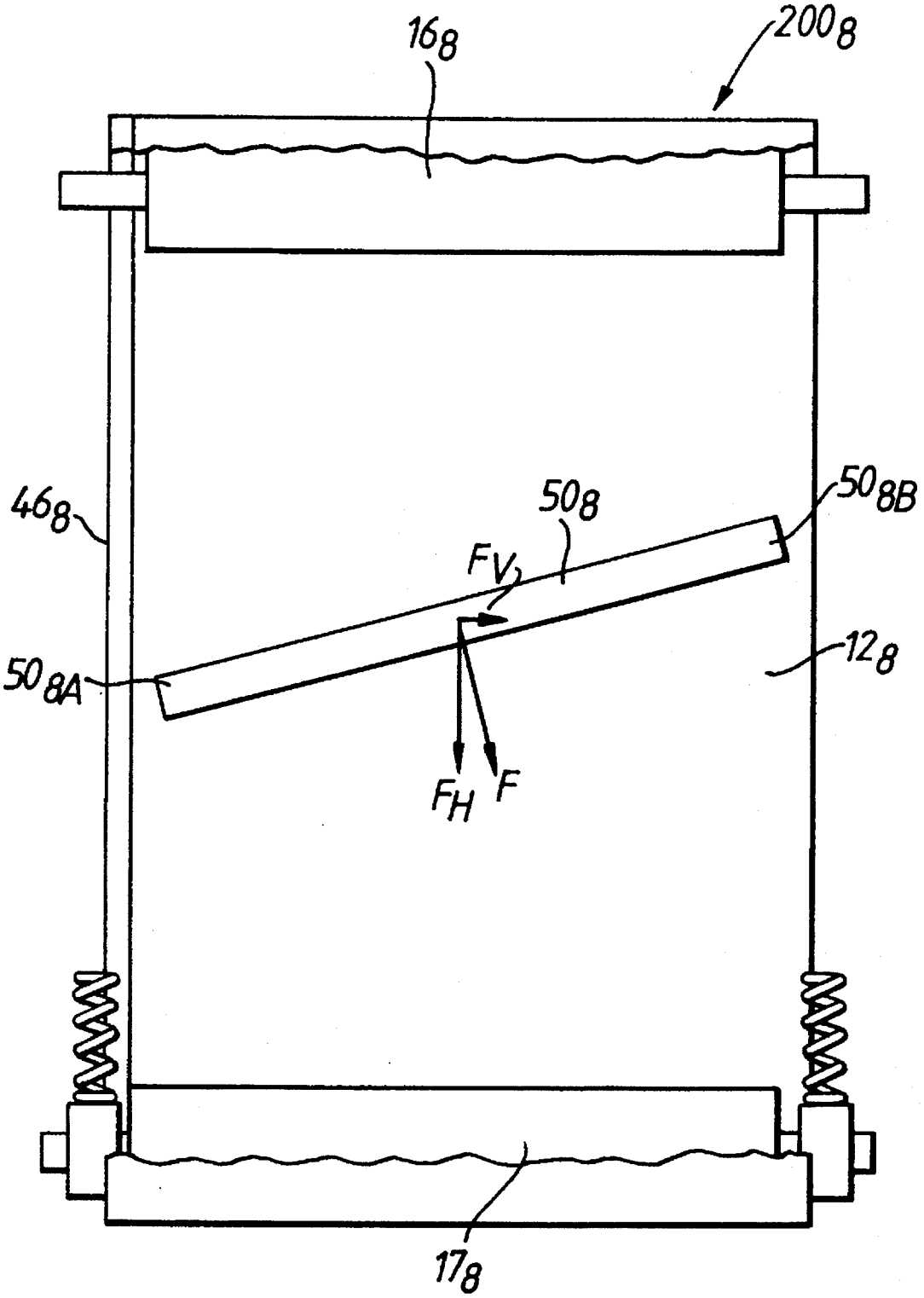
FIG. 26 is a perspective view for explaining the skid movement of the conveyor belt in the eighth embodiment.

As illustrated in FIG. 26, the conveyor belt $12_8$ is first twisted by the diagonal roller $50_8$ and a tensile force F is generated in the direction vertical to the central axis of rotation of the diagonal roller $50_8$. In actual operation, this force F is divided into two forces which act in the belt conveying direction $F_H$ and in the direction $F_V$ vertical to the belt conveying direction. The direction $F_V$ of the divided force is the direction for the shorter distance between the diagonal roller $50_8$ and the driving roller $16_8$ and by this force, the conveyor belt $12_8$ is given a force to move skiddingly in the direction of a shorter distance between the diagonal roller $50_8$ and the driving roller $16_8$. That is, the conveyor belt $12_8$ skids to the end $50_8$B side of the diagonal roller $50_8$.

That is, it is possible to control the direction of skid of the conveyor belt $12_8$ by providing the diagonal roller $50_8$ which is not parallel to the driving roller $16_8$.

If the direction of skid of the conveyor belt can be controlled, a single piece of the regulation belt $46_8$ which controls progress of the skid is able to create its effect. That is, this is achieved when the belt $46_8$ is provided only at the inside of the conveyor belt edge which has a long distance between the diagonal roller $50_8$ and the driving roller $16_8$.

That is, the conveyor belt $12_8$ skids to the side with a shorter distance between the diagonal roller $50_8$ and the driving roller $16_8$ according to the diagonal roller $50_8$. However, if the conveyor belt $12_8$ moved skiddingly by a certain amount, the regulation belt $46_8$ slides to the end surface of the driven roller $17_8$ and the skid of the conveyor belt is stopped at a position where the skid moving force of the conveyor belt $12_8$ is balanced with the rubber repulsive force of the regulation belt $46_8$. Once both forces are balanced with each other, the conveyor belt $12_8$ continuously moves in this balanced state.

Figure 27:
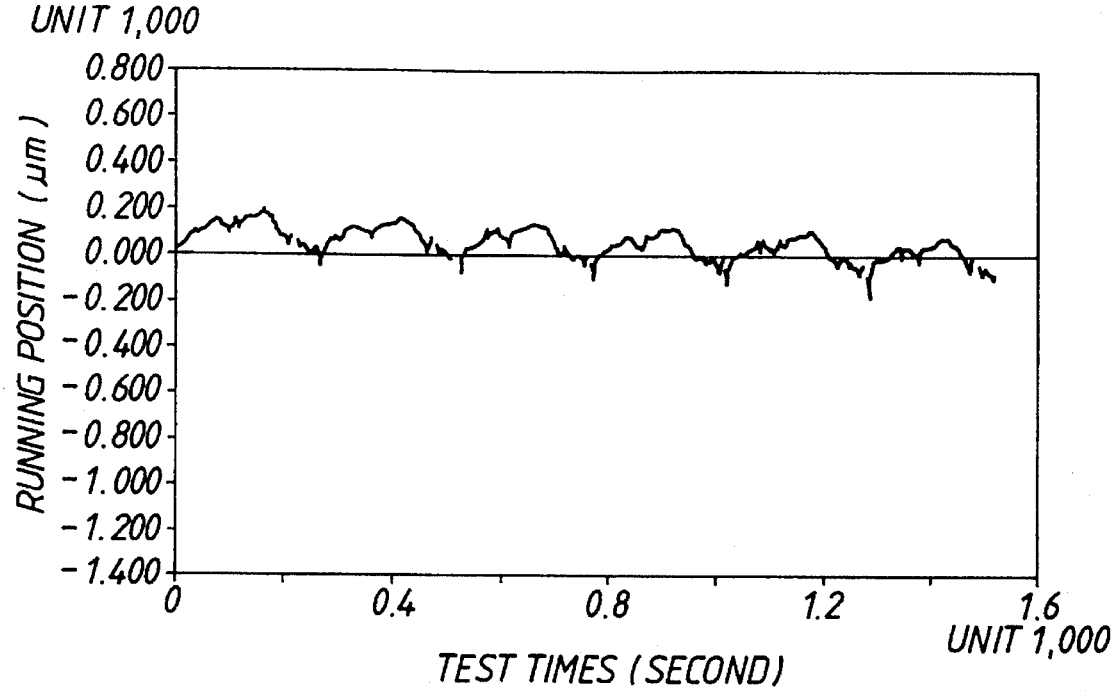
FIG. 27 is a graph showing the state of skid movement of the conveyor belt when the construction of the eighth embodiment is not adopted.
Figure 28:
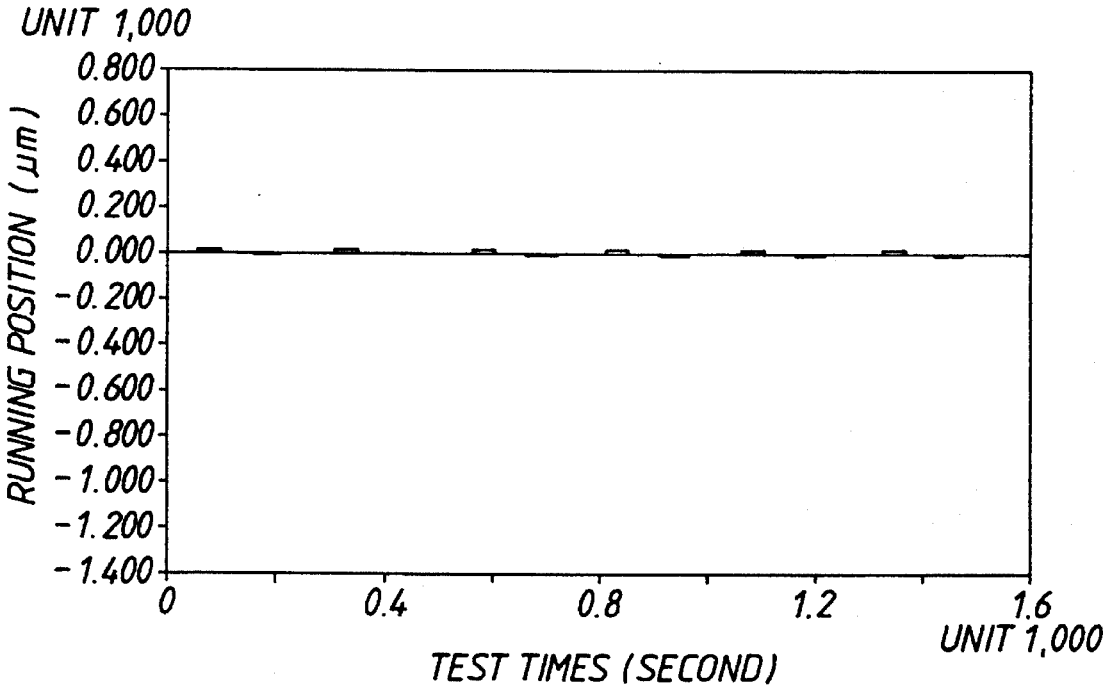
FIG. 28 is a graph showing the state of skid movement of the conveyor belt when the construction of the eighth embodiment is adopted.

FIG. 27 shows the test result of the skid of the conveyor belt when no measures described above was taken and FIG. 28 shows the test result when the measures described above were taken.

As the result of this test, "Test Times (Sec.)" showing the running times of the conveyor belt were plotted on the axis of abscissas and "Running Positions (μm)" showing the amounts of the skids of the conveyor belt were plotted on the axis of ordinates.

Therefore, the skid of the conveyor belt without taking no measure is large and the color shift of the images on the image receiving medium 8 tends to occur in the direction perpendicular to the moving direction of the conveyor belt $12_8$. However, the skid of the conveyor belt is very small when it was moved with the diagonal roller $50_8$ and the regulation belt $46_8$ provided and it can be seen that the conveyor belt $12_8$ was running in the stable state scarcely causing the color shift on the images on the image receiving medium 8 in the direction perpendicular to the moving direction of the conveyor belt 8.

In this eighth embodiment, the diagonal roller $50_8$ was arranged at the loose side of the conveyor belt $12_8$. However, the effect of the diagonal roller $50_8$ does not change even when the diagonal roller $50_8$ is arranged at the tension side of the conveyor belt if a space is available.

Further, it is not necessary to have the diagonal roller $50_8$ act from the inside of the conveyor belt $12_8$ and its effect does not change even when the diagonal roller $50_8$ is forced to act on the surface of the conveyor belt $12_8$.

Further, the end surface of the driven roller $17_8$ has been explained to be the surface contacting the regulation belt $46_8$ in this eighth embodiment. However, the end surface of the driving roller $16_8$ may be used as the skid control surface or when a roller having an original skid control surface is provided separately, its effect does not change at all.

As described above, the skid of the conveyor belt $12_8$ can be controlled by a system in very simple construction.

Next, a conveying means $200_9$ in the ninth embodiment will be described with reference to FIGS. 29 to 34.

Figure 29:
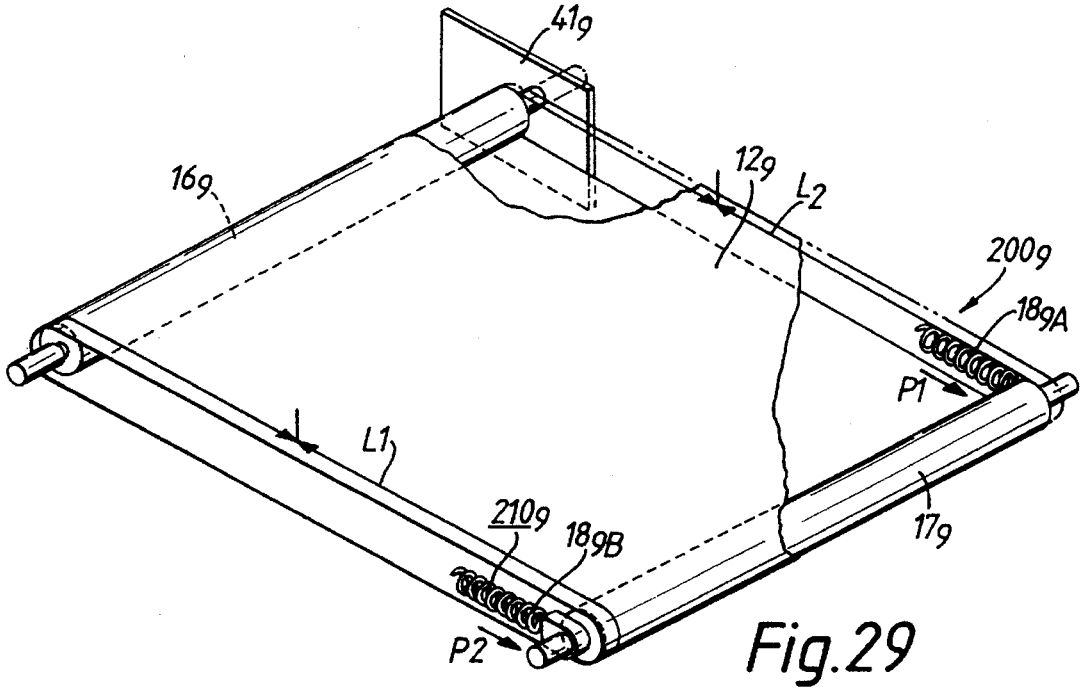
FIG. 29 is a perspective view showing the ninth embodiment of the present invention less a part of the conveying means which is its essential part.

As illustrated in FIG. 29, the conveying means $200_9$ is in the construction of L1>L2 when the peripheral lengths of both edges of an endless conveyor belt $12_9$ put over the driving roller $16_9$ and the driven roller $17_9$ are L1 and L2.

As a means to give a tension to the conveyor belt $12_9$, a tensioning mechanism $210_9$ is provided, which is composed of a first and a second compression springs $18_9$A and $18_9$B as a first and a second tensioning members, respectively. That is, the first compression spring $18_9$A having a strong pressure P1 is arranged at the L2 side of a short peripheral length of the conveyor belt $12_9$ and the second compression spring $18_9$B having a weak pressure P2 (P1>P2) is arranged at the L1 side of the long peripheral length.

As described in the sixth embodiment, as a result of this construction, the conveyor belt $12_9$ always skids toward the length L2 side where the compression spring $18_9$A side having a strong pressure P1 is arranged.

On the other hand, a regulation plate $41_9$ is provided along the edge of the conveyor belt $12_9$ with the compression spring $18_9$A having a strong pressure P1 at the L2 side of a short peripheral length.

The regulation plate $41_9$ kept in contact with the edge of the conveyor belt $12_9$ prevents the skid of the conveyor belt $12_9$.

Figures 30A, 30B, 30C:
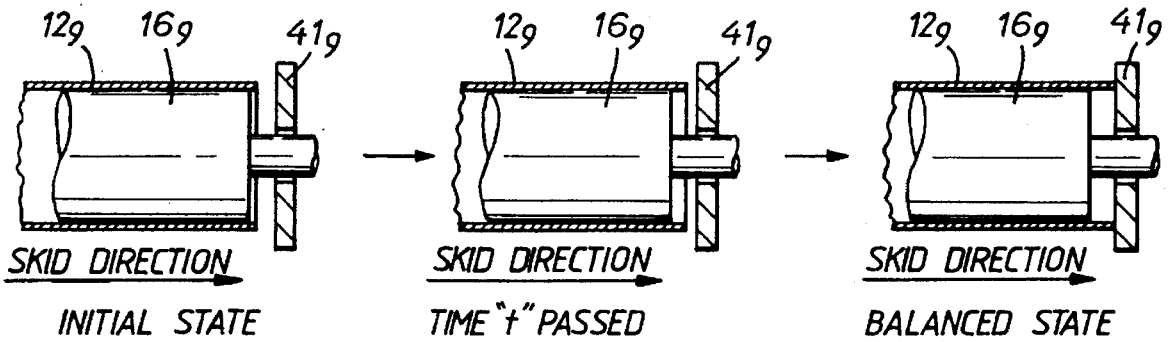
FIGS. 30A through 30C are cross-sectional views showing the positional relation of the conveyor belt and the regulation plate.

That is, as illustrated in FIGS. 30A to 30C, the regulation plate $41_9$ is arranged to penetrate the rotary shaft of the driving roller $16_9$. As the conveyor belt $12_9$ always skids toward the first compression spring $18_9$A having a strong pressure P1 at the L2 side of a short peripheral length, after elapsing "t" time shown in FIG. 30B, the edge of the conveyor belt $12_9$ runs against the surface of the regulation plate $41_9$, preventing the further movement of the conveyor belt $12_9$ and the conveyor belt $12_9$ is kept in the balanced state.

Figure 31:
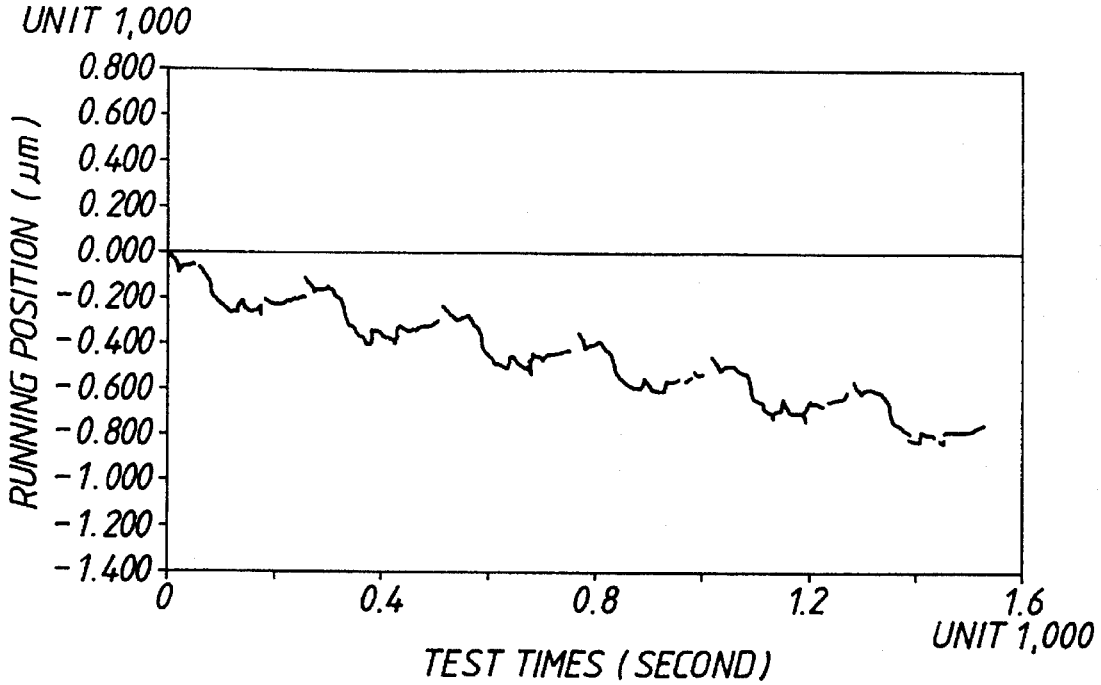
FIG. 31 is a graph showing the state of skid movement of the conveyor belt when the construction of the ninth embodiment is not adopted.

FIG. 31 shows the state of skid of the conveyor belt when it was run without the belt mounting and pressure setting made as described above and FIG. 32 shows the same when the conveyor belt was run with the belt mounted and pressure setting made as described above. As the results of this test, "Test Times (Sec.)" showing the running time of the conveyor belt is plotted on the axis of abscissas and "Running Positions (μm)" showing amount of skid of the belt is plotted on the axis of ordinates.

As clear from these test results, the amount of the skid of the conveyor belt is large when it was run without belt mounting and pressure setting made as described above and the color shift of the images on the image receiving medium 8 tends to occur in the direction perpendicular to the moving direction of the conveyor belt $12_9$. However, it can be seen that it is very small when the belt was run with the belt mounting and pressure setting made as described and the conveyor belt was in the stable running state with scarcely causing the color shift of the image on the image receiving medium 8 in the direction perpendicular to the moving direction of the conveyor belt $12_9$.

Figure 32:
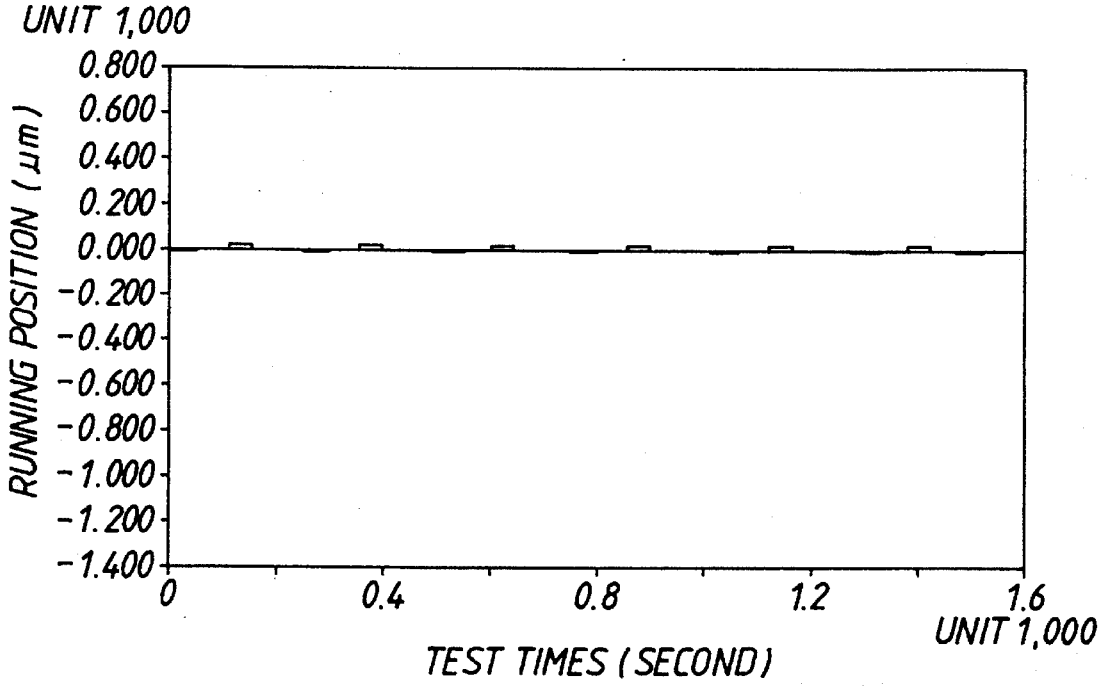
FIG. 32 is a graph showing the state of skid movement of the conveyor belt when the construction of the ninth embodiment is adopted.

The test results shown in FIG. 31 and 32 are only one example. Further statistical tests conducted revealed that the same results are obtainable according to the construction of the conveying means in this ninth embodiment if a difference in peripheral lengths of both side edges of the belts is suppressed to 1.5 mm and a difference of pressures applied is suppressed to 0.8 kg. As for accuracy of the conveyor belt, ±0.01 mm for length and ±50 g were so far demanded and therefore, when this construction is used, it is possible to effectively control and restrain the direction of skid without demanding high accuracy for the conveyor belt.

Figure 33:
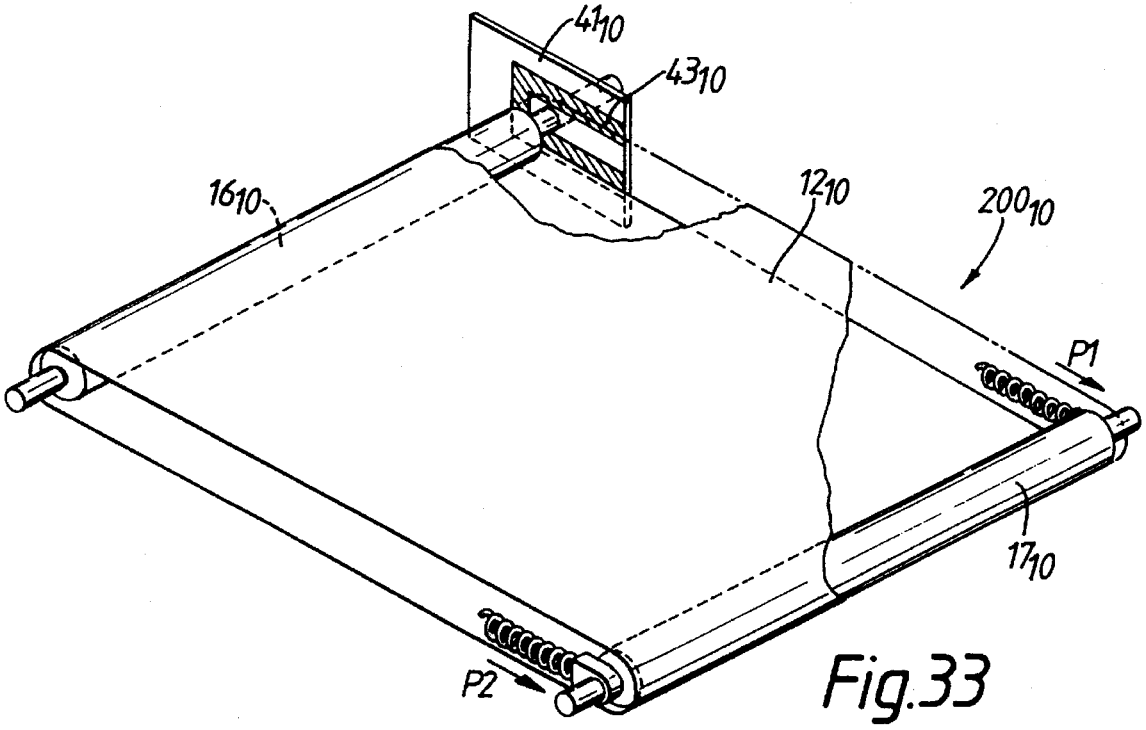
FIG. 33 is a perspective view showing the tenth embodiment of the present invention less a part of the conveying means which is its essential part.

FIG. 33 shows a conveying means $200_{10}$ in the tenth embodiment. In order to make the edges of a conveyor belt $12_{10}$ and a regulation plate $41_{10}$ easy to slide, a surface $43_{10}$ treated with a low frictional resistance is provided in their contacting area. A test result of frictional resistance of an unprocessed stainless steel plate with a PET film was 0.665. On the other hand, the coefficient of friction of an ordinary iron plate with a fluorine coating is 0.657 and therefore, it is possible to obtain an equivalent coefficient of friction from a fluorine coated iron plate even when an expensive stainless steel having a low frictional surface resistance is not used. Further, needless to say, a more low coefficient of frictional resistance can be obtained if stainless steel is coated with fluorine.

Figure 34:
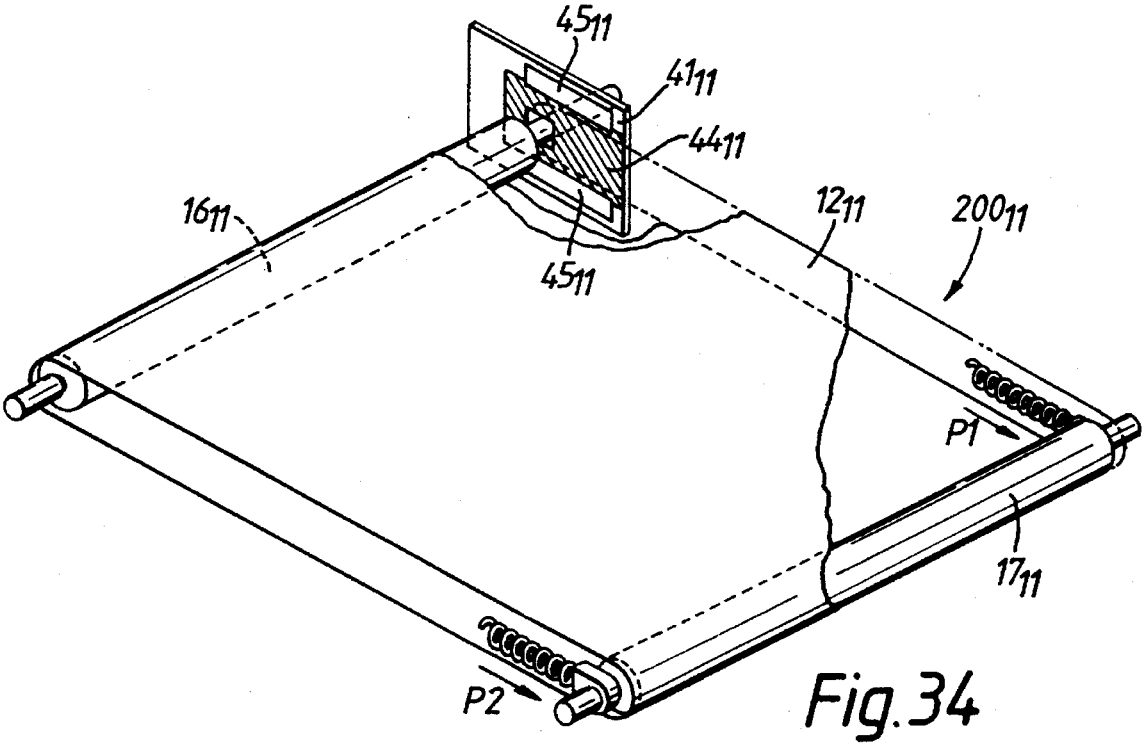
FIG. 34 is a perspective view showing the eleventh embodiment of the present invention less a part of the conveying means which is its essential part.

FIG. 34 shows a conveying means $200_{11}$ in the eleventh embodiment and a sheet $44_{11}$ of a low coefficient of friction is inserted between a skid control plate $41_{11}$ and the edge of a conveyor belt $12_{11}$. The sheet $44_{11}$ of a low coefficient of friction is in somewhat large size and fixed to the skid control plate $41_{11}$ by fixing adhesive tape $45_{11}$. Further, the method for fixing the sheet $44_{11}$ is not restricted and any other method can be used. In the embodiments 9 to 11, regulation plates. $41_9$ to $41_{11}$ are provided to the driving rollers $16_9$ to $16_{11}$ but they may be provided to the driven rollers $17_9$ to $17_{11}$ or along the entire edge of the conveyor belts $12_9$ to $12_{11}$.

As described above, in the ninth to the eleventh embodiments, an effective control of skid of the conveyor belt can be achieved when the conveyor belt $12_9$ to $12_{11}$ is so arranged that the conveyor belt is running while at least a part of it is kept in contact with the regulation plate $41_9$ to $41_{11}$.

Next, a conveying means $200_{12}$ in the twelfth embodiment will be described with reference to FIGS. 35 to 38.

Figure 35:
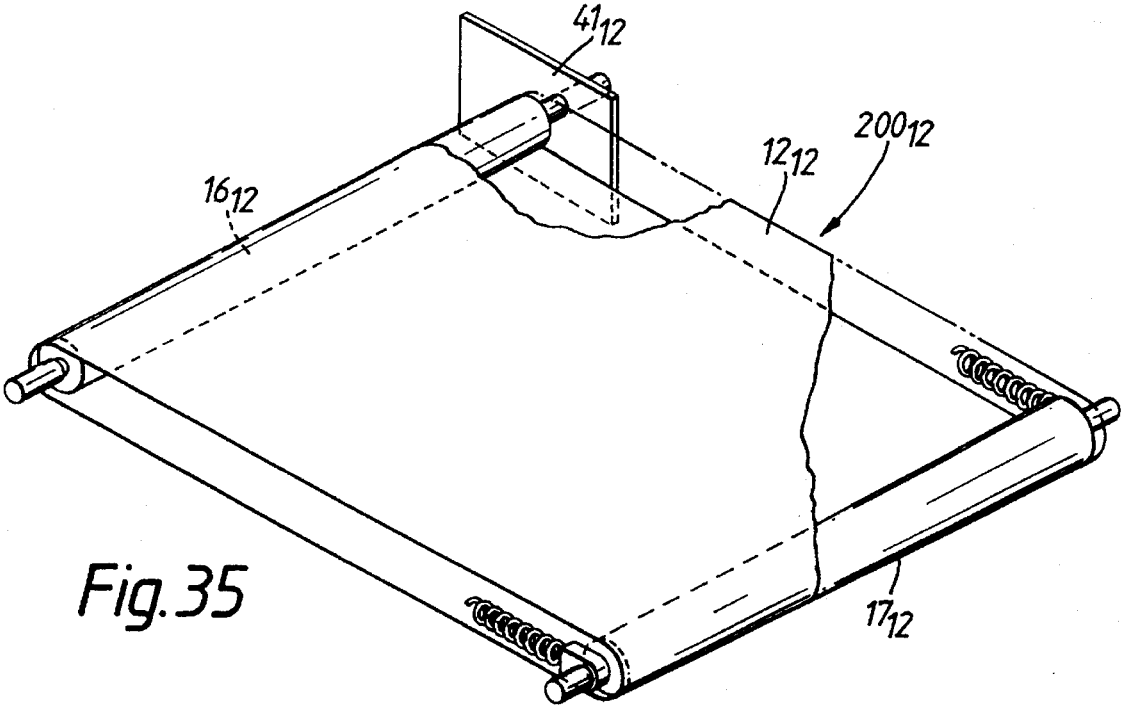
FIG. 35 is a perspective view showing the twelfth embodiment of the present invention less a part of the conveying means which is its essential part.
Figure 36:
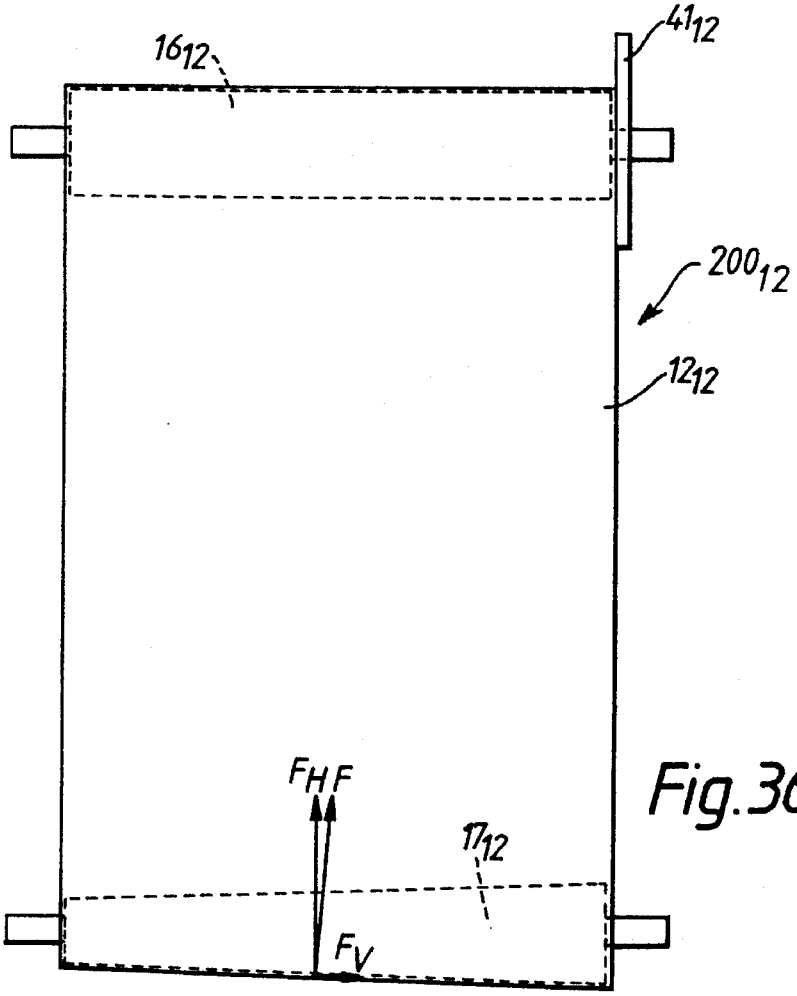
FIG. 36 is a perspective view for explaining the skid movement of the conveyor belt in the twelfth embodiment.

As illustrated in FIGS. 35 and 36, a tapered roller $17_{12}$ of which diameter becomes larger gradually from one end to another end is used as a driven roller. A regulation plate $41_{12}$ is provided along one edge of a driving roller $16_{12}$ at the same side as the large diameter side of the tapered roller $17_{12}$.

When the conveyor belt $12_{12}$ is put over the driving roller $16_{12}$ and the tapered roller $17_{12}$, which is a driven roller, the skid will progress toward the larger diameter of the tapered roller $17_{12}$ when the conveyor belt is moved as described in the seventh embodiment.

That is, as illustrated in FIG. 36, a tensile force F vertical to the inclined portion that is the tapered portion of the tapered roller $17_{12}$ is first generated on the conveyor belt $12_{12}$ being pulled along the tapered roller $17_{12}$.

When the conveyor belt $12_{12}$ is moving, this tensile force F is split into two: $F_H$ acting in the belt conveying direction and $F_V$ acting in the direction vertical to the belt conveying direction. The direction $F_V$ of the split force vertical to the belt conveying direction is the direction toward the larger diameter of the tapered roller $17_{12}$ and by this force $F_V$, the conveyor belt $12_{12}$ is moved one-sidedly in the direction of the larger diameter of the tapered roller $17_{12}$. That is, the direction of skid of the conveyor belt $12_{12}$ is controlled using the tapered roller $17_{12}$ as a driven roller and the movement is regulated by the regulation plate $41_{12}$ provided at the larger diameter side of the tapered roller $17_{12}$.

When the skid of the conveyor belt $12_{12}$ progressed to a certain amount, the regulation plate $41_{12}$ and the outer edge or the conveyor belt slide and the skid is stopped at a position where the skid moving force of the conveyor belt $12_{12}$ is balanced with a reactive force of the regulation plate $41_{12}$. Once both forces are balanced, the conveyor belt $12_{12}$ is moved in this balanced state.

Figure 37:
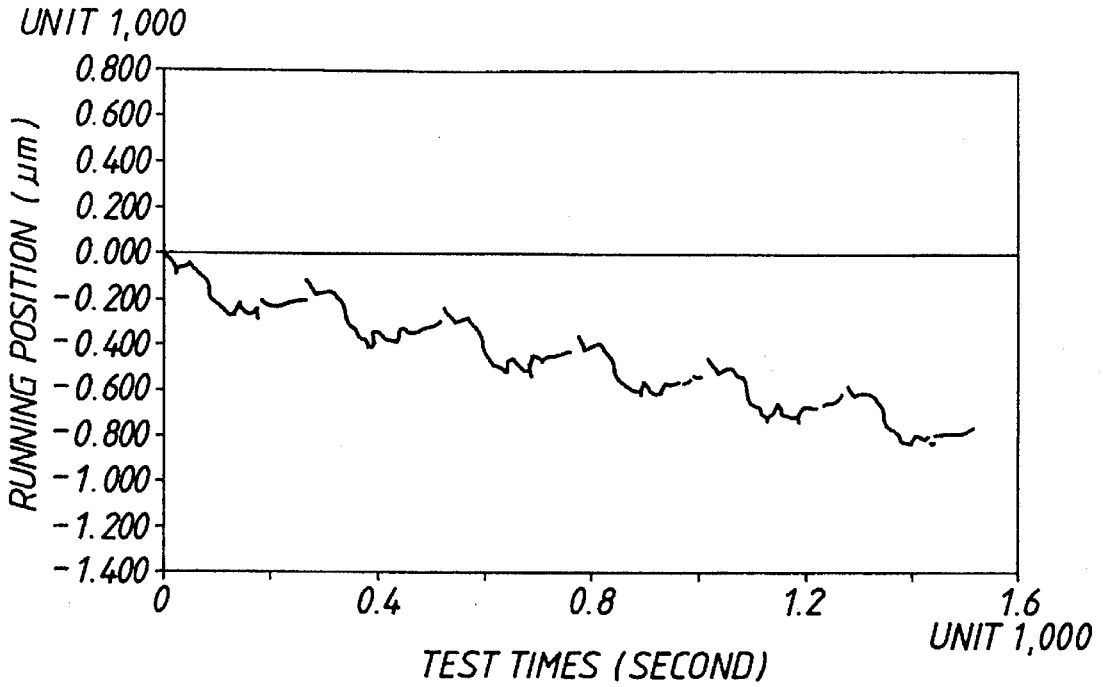
FIG. 37 is a graph showing the state of skid movement of the conveyor belt when the construction of the twelfth embodiment is not adopted.
Figure 38:
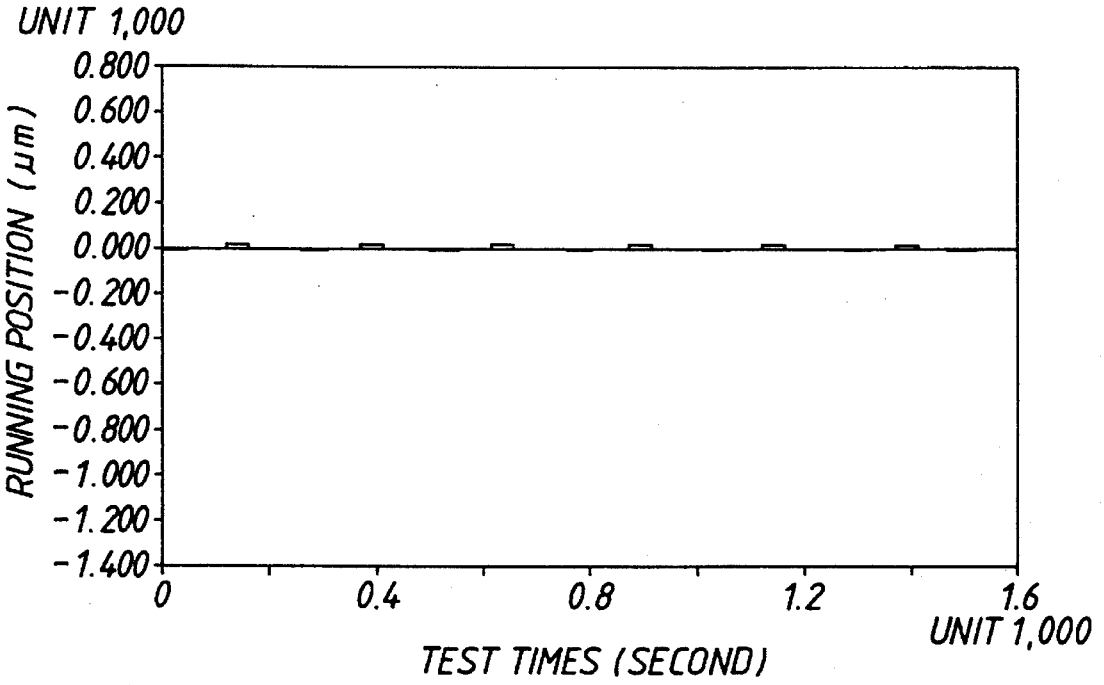
FIG. 38 is a graph showing the state of skid movement of the conveyor belt when the construction of the twelfth embodiment is adopted.

FIG. 37 shows the test result of the skid moving state when the conveyor belt was run with no measure taken and FIG. 38 shows the test result of the skid moving state when the conveyor belt was run with the tapered roller $17_{12}$ and the regulation plate $41_{12}$ provided.

As the results of this test, "Test Times (Sec.)" showing running times of the conveyor belt is plotted on the axis of abscissas and "Running Position (μm)" showing the amount of skid of the belt is plotted on the axis of ordinates.

As can be seen from these test results, the amount of skid of the conveyor belt is large and the color shift of the images on the image receiving medium 8 tends to occur in the direction perpendicular to the moving direction of the conveyor belt when no measure was taken. But, the amount of skid is very small when the conveyor belt $12_{12}$ was run with the tapered roller $17_{12}$ and the regulation plate $41_{12}$ provided and the conveyor belt is in the stable running state without scarcely causing the color shift of the images on the image receiving medium 8 in the direction perpendicular to the moving direction of the conveyor belt.

The tapered roller $17_{12}$ shown in the twelfth embodiment is not necessarily to be used as a driver but can be used as a third roller other than the driving roller $16_{12}$ and the driven roller as its effect will not be changed. Further, it is also not necessary to have the tapered roller $17_{12}$ act from the inside of the conveyor belt and its effect will not be changed even when it is acted on the surface side of the conveyor belt $12_{12}$.

As described above, it is possible to efficiently suppress the skid of the conveyor belt by a system in very simple construction.

Next, a conveying means $200_{13}$ in the thirteenth embodiment with reference to FIGS. 39 to 42.

Figure 39:
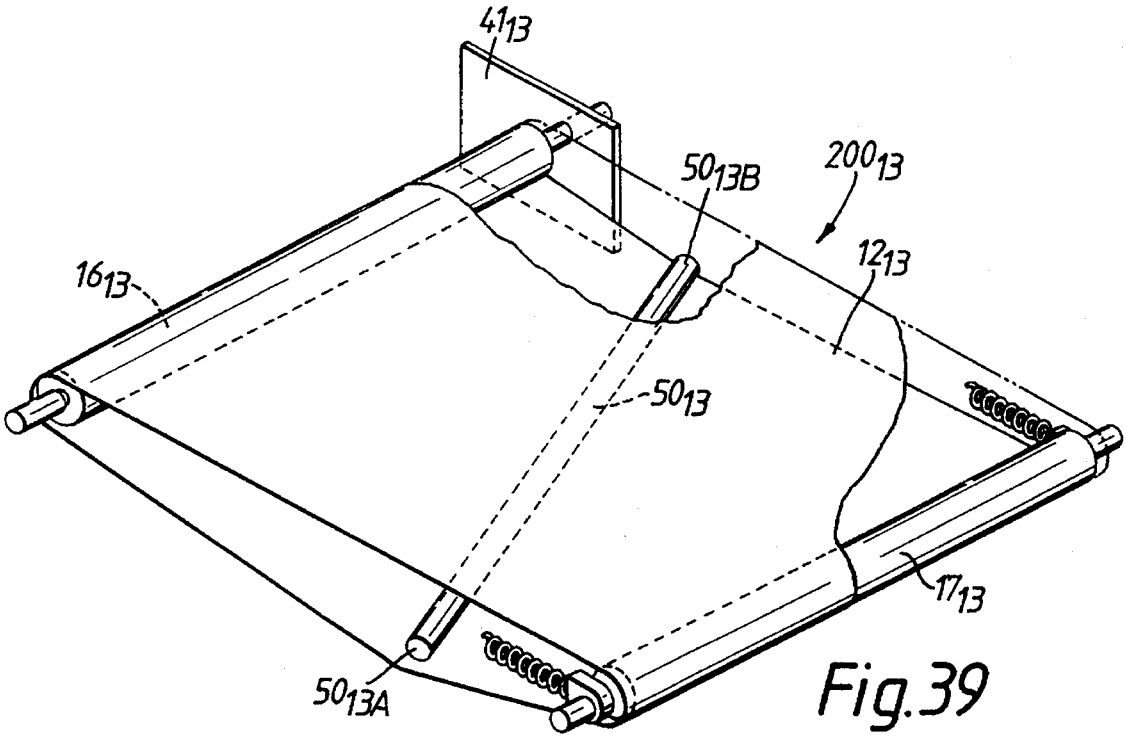
FIG. 39 is a perspective view showing the thirteenth embodiment less a part of the conveying means which is its essential part.
Figure 40:
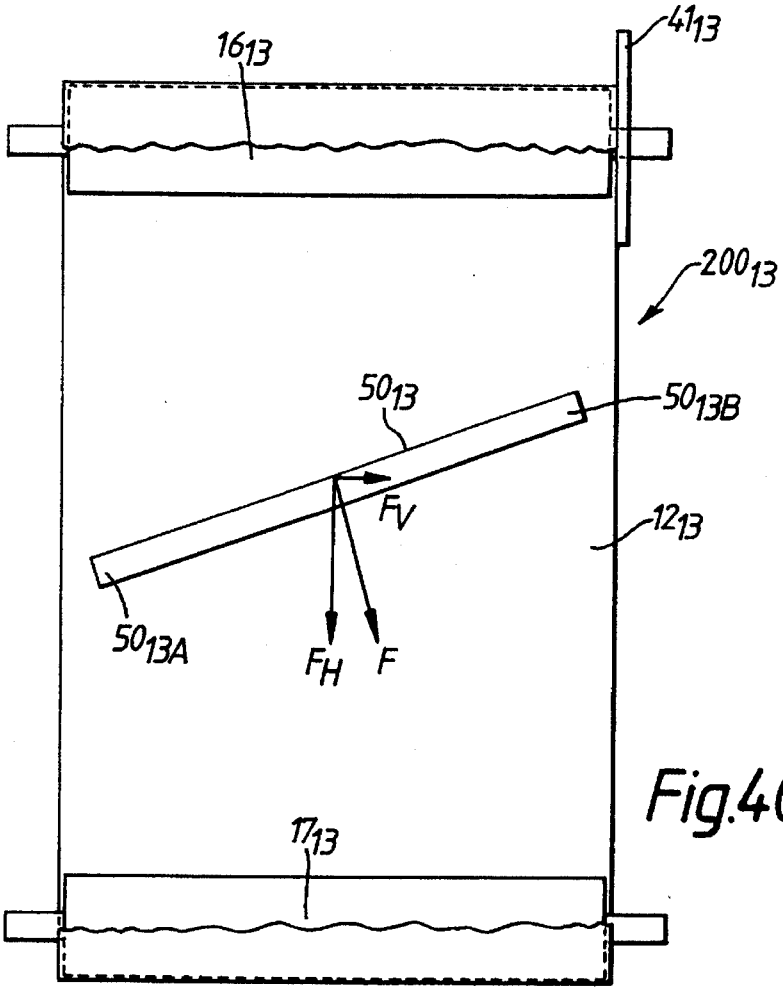
FIG. 40 is a perspective view for explaining the skid movement of the conveyor belt in the thirteenth embodiment.

As illustrated in FIGS. 39 and 40, there is a diagonal roller $50_{13}$ provided between a parallelly arranged driving roller $16_{13}$ and a driven roller $17_{13}$ not parallelly but diagonally to these rollers $16_{13}$ and $17_{13}$. That is, the diagonal roller is so arranged that one end $50_{13}$A of the diagonal roller $50_{13}$A is close to the driven roller $17_{13}$ side and another end $50_{13}$B is close to the driving roller $16_{13}$. Furthermore, this diagonal roller $50_{13}$ is arranged at a position somewhat below the plane surface connecting the driving roller $16_{13}$ and the driven roller $17_{13}$ and functions as a skid control roller. The conveyor belt $12_{13}$ is put over the driving roller $16_{13}$, the diagonal roller $50_{13}$ and the driven roller $17_{13}$. On the other hand, a regulation plate $41_{13}$ is provided along one side edge of the conveyor belt where a distance between the diagonal roller $50_{13}$ and the driving roller $16_{13}$ is short. The regulation plate $41_{13}$ is in the construction as illustrated in FIGS. 30A to 30C.

In the construction described above, the conveyor belt $12_{13}$ moves one-sidedly toward the end of the diagonal roller $50_{13}$ of which distance to the driving roller $16_{13}$ is short. That is, the conveyor belt $12_{13}$ moves one-sidedly toward the end $50_{13}$B of the diagonal roller $50_{13}$.

In this case, as illustrated in FIG. 40, the conveyor belt $12_{13}$ is first twisted by the diagonal roller $50_{13}$ and a tensile force F is generated in the direction perpendicular to the central axis of rotation of the diagonal roller $50_{13}$. In actual operation, this force F is split and acts in the belt conveying direction FH and the direction $F_V$ vertical to the belt conveying direction. The direction $F_V$ of a force split in the direction vertical to the belt conveying direction is a direction of a short distance of the diagonal roller $50_{13}$ to the driving roller $16_{13}$ and by this force the conveyor belt $12_{13}$ is given a force to move one-sidedly in the direction of a short distance of the diagonal roller $50_{13}$ to the driving roller $16_{13}$. That is, the conveyor belt $12_{13}$ moves skiddingly to the end $50_{13}$B side of the diagonal roller $50_{13}$.

That is, it is possible to control the skid direction of the conveyor belt $12_{13}$ by providing the diagonal roller $50_{13}$ which is not parallel to the driving roller $16_{13}$ and to control the further skid by the regulation plate $41_{13}$.

In other words, the conveyor belt $12_{13}$ moves skiddingly to the short distance side between the diagonal roller $50_{13}$ and the driving roller $16_{13}$ following the diagonal roller $50_{13}$ but when the conveyor belt $12_{13}$ moves skiddingly to a certain distance, the outer peripheral edge of the conveyor belt slides on the regulation plate $41_{13}$ and the skid of the belt is stopped at a position where the skidding force of the conveyor belt $12_{13}$ is balanced with the reaction of the regulation plate $41_{13}$. Once both forces are balanced, the conveyor belt $12_{13}$ moves continuously while kept in this balanced state.

Figure 41:
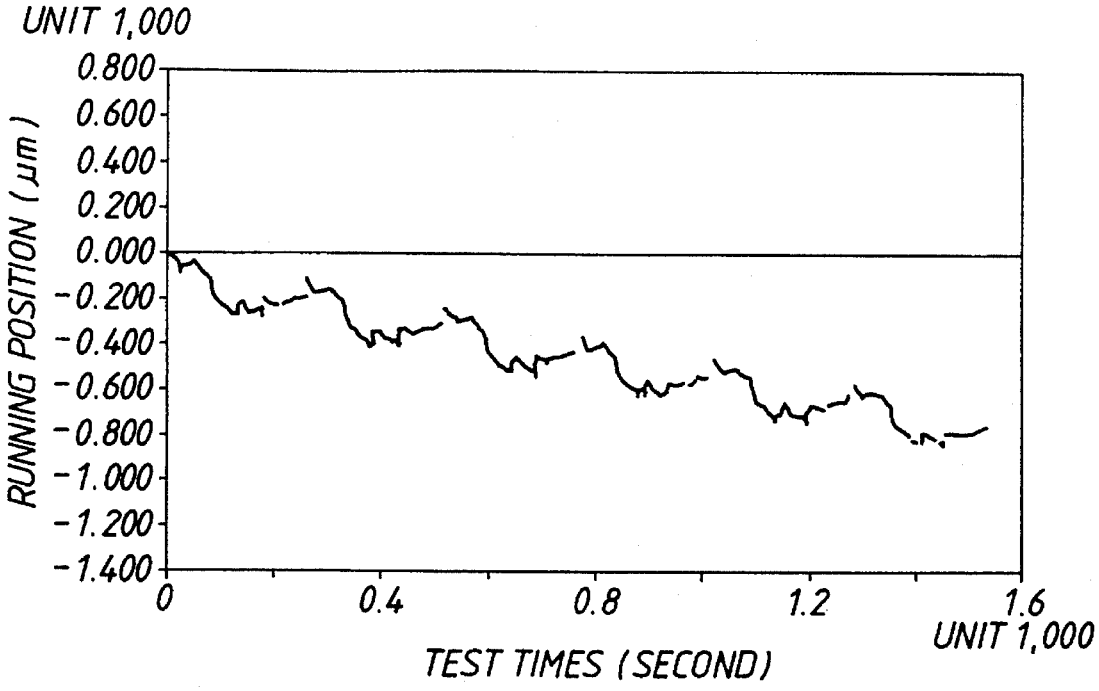
FIG. 41 is a graph showing the state of skid movement of the conveyor belt when the construction of the thirteenth embodiment is not adopted.
Figure 42:
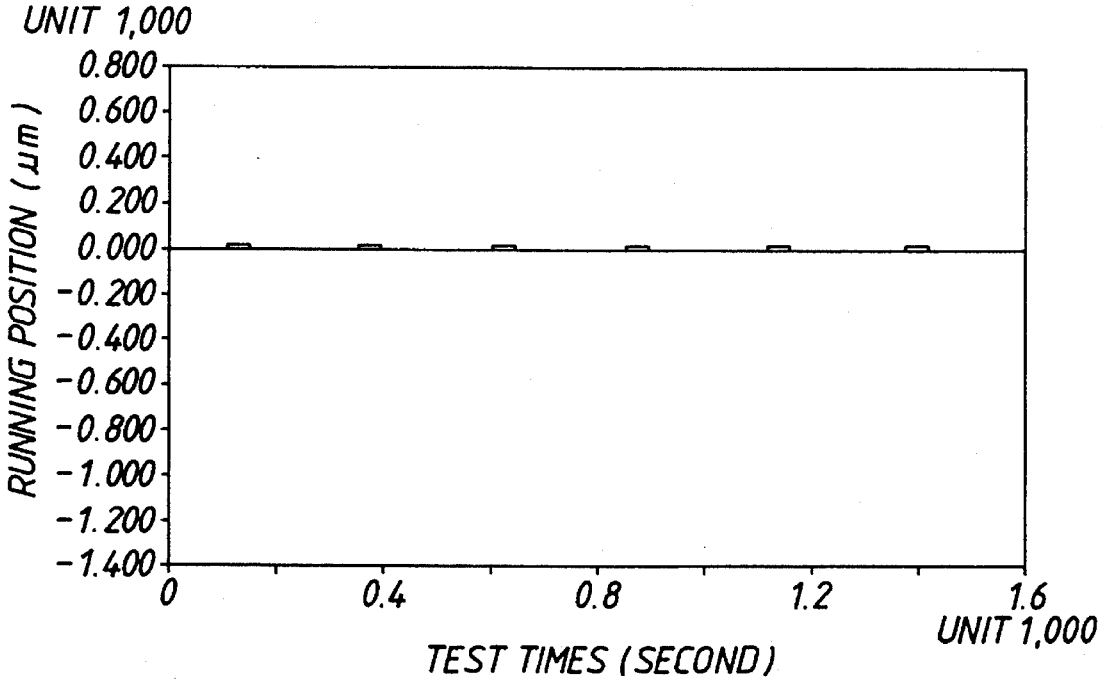
FIG. 42 is a graph showing the state of skid movement of the conveyor belt when the construction of the thirteenth embodiment is adopted.

FIG. 41 shows the test result of the skid of the conveyor belt when the measures described above were not taken and FIG. 42 shows the same with the measures described above taken.

As the results of this test, "Test Time (Sec.)" showing the belt running times is plotted on the axis of abscissas and "Running Positions (μm)" showing amount of skid of the belt is plotted on the axis of ordinates.

Therefore, skid of the conveyor belt arranged without taking any measure is large and the color shift of the images tends to occur on the images on the image receiving medium 8 in the direction perpendicular to the moving direction of the conveyor belt $12_{13}$. However, the skid of the conveyor belt $12_{13}$ is very small when the diagonal roller $50_{13}$ and the regulation plate $41_{13}$ are arranged and it is seen that the conveyor belt $12_{13}$ is in the stable running state scarcely causing the color shift of the image on the image receiving medium 8 in the direction perpendicular to the moving direction of the conveyor belt.

In the thirteenth embodiment, the diagonal roller $50_{13}$ was arranged at the loose side of the conveyor belt $12_{13}$. However, the effect of the diagonal roller $50_{13}$ will not be changed even when it is arranged at the stretched side of the conveyor belt $12_{13}$ if a space is available.

Further, it is not necessary to have the diagonal roller $50_{13}$ act from the inside of the conveyor belt $12_{13}$ and the effect of the diagonal roller $50_{13}$ does not change when the diagonal roller $50_{13}$ is forced to act on the surface side of the conveyor belt $12_{13}$.

As described above, it is possible to suppress the skid of the conveyor belt $12_{13}$ by a system in very simple construction.

Next, a conveying means $200_{14}$ in the fourteenth embodiment with reference to FIGS. 43 to 50.

Here, only those portions differing from the construction illustrated in FIG. 1 are referred to in the description of the first embodiment will be described and the explanation of the same portions will be omitted.

Figure 43:
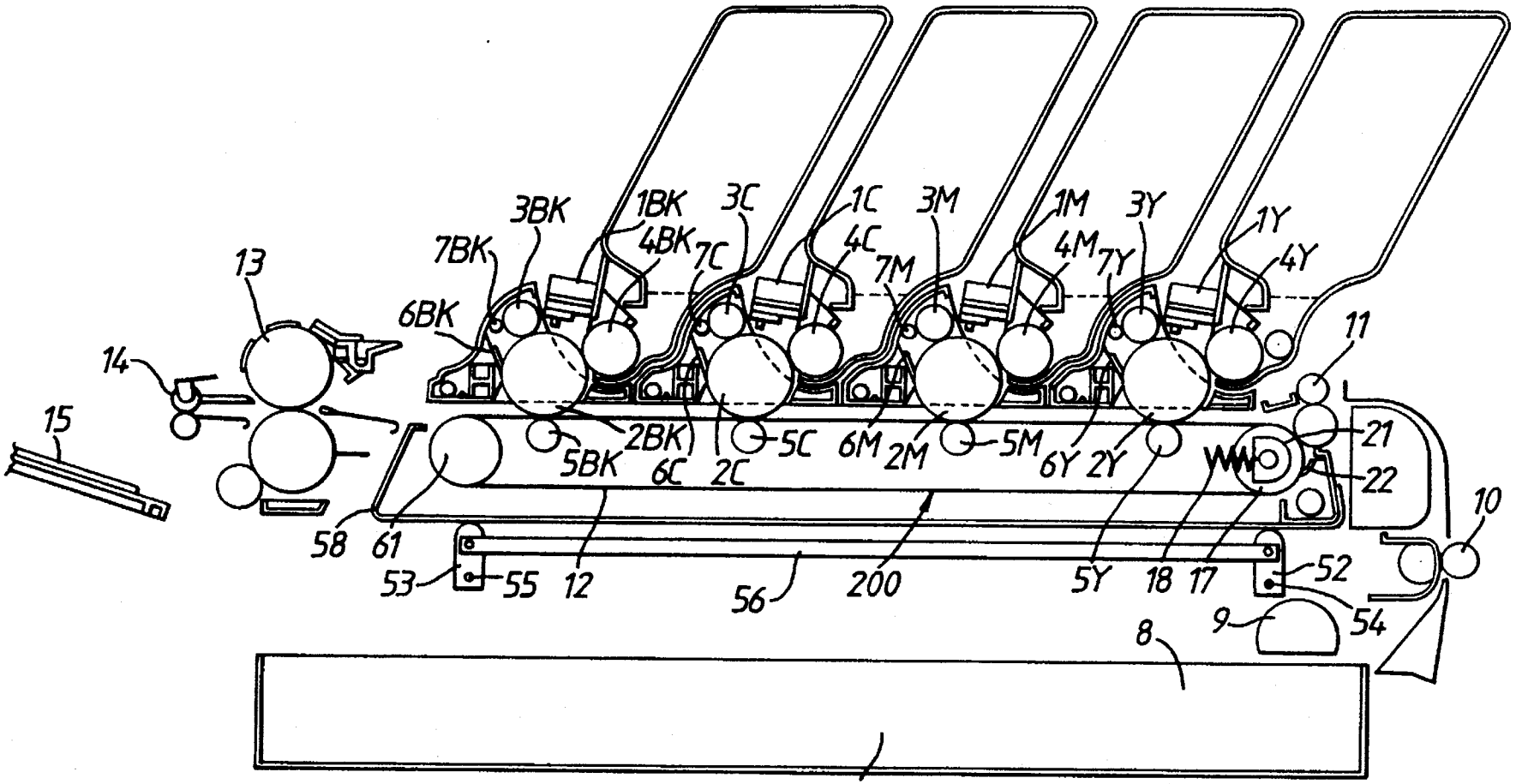
FIG. 43 is an outline diagram of full-color image forming apparatus showing the fourteenth embodiment of the present invention.
Figure 44:
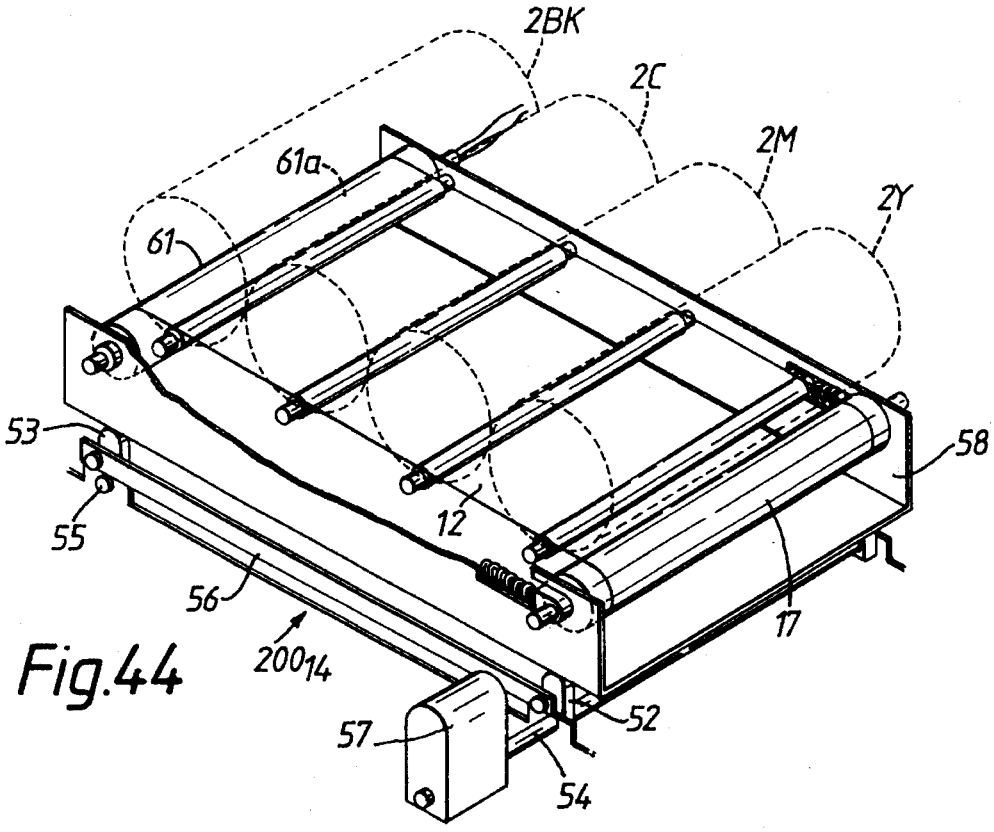
FIG. 44 is a perspective view showing the construction of the conveyor belt unit of the full-color image forming apparatus shown in FIG. 43.

FIGS. 43 and 44 show the state where a belt unit frame 58 is lifted by a lifting lever in the image forming operation so that the photosensitive drums 2Y, 2M, 2C and 2BK and the conveyor belt 12 are brought in contact with each other in the prescribed state.

Figure 45:
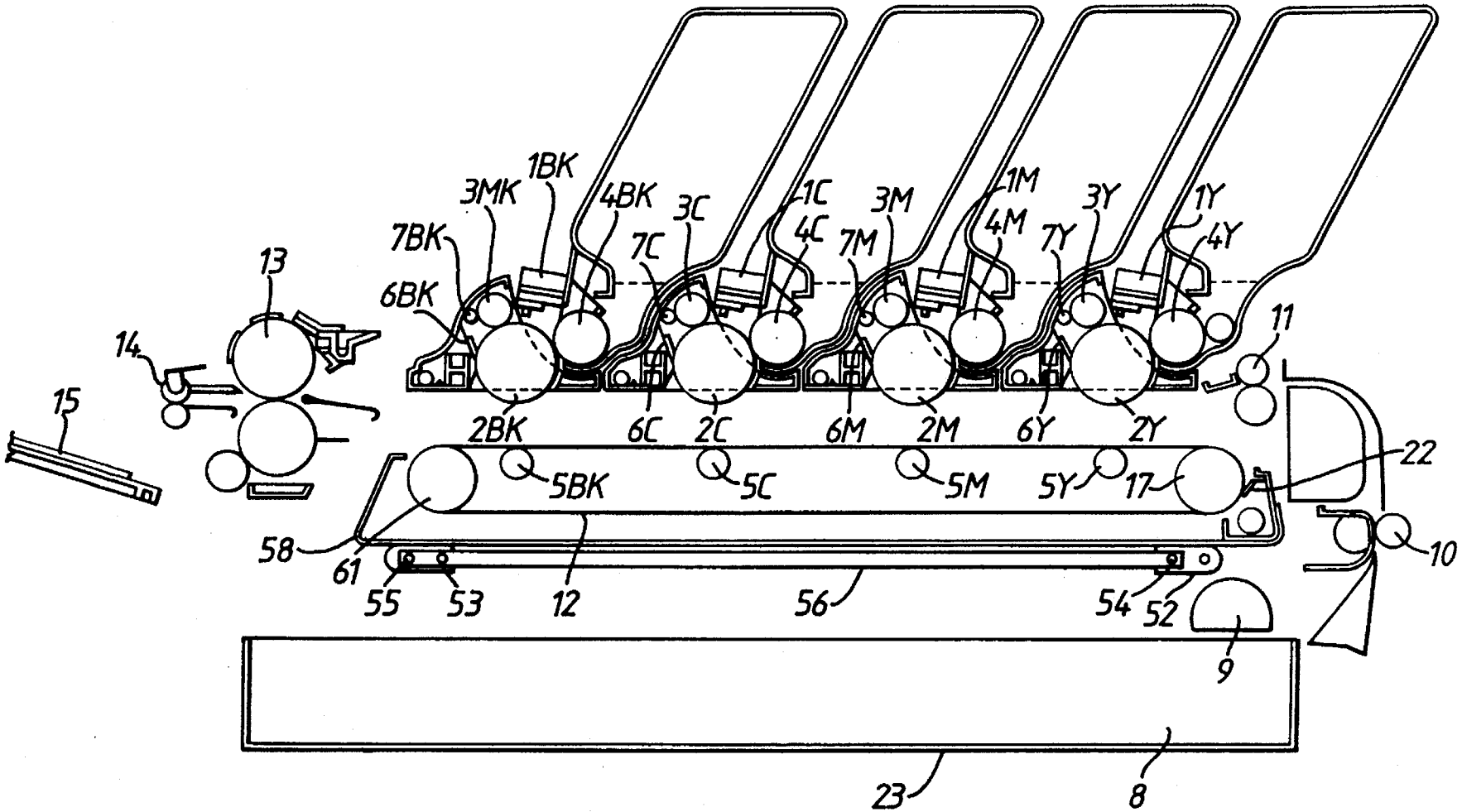
FIG. 45 is an outline diagram showing the state of the conveyor belt unit separated from the photosensitive drums shown in FIG. 44.

FIG. 45 shows the state where the lifting lever was lowered and the conveyor belt 12 was separated from the photosensitive drums 2Y, 2M, 2C and 2BK. Under this state where the conveyor belt 12 is separated from the photosensitive drums 2Y, 2M, 2C and 2BK, the conveyor belt unit including the conveyor belt 12 can be pulled out of the body of the image forming apparatus to the outside. If the image receiving medium 8 is jammed in the apparatus, the belt unit including the conveyor belt 12 is pulled out of the body of the apparatus to the outside when taking out this jammed image receiving medium 8.

The belt unit is supported by a first lifting lever 52 provided at the front and rear sides of the paper supply side and a second lifting lever 53 provided at the front and rear sides of the paper exit side, total four levers. The first lifting levers 52 provided at the front and the rear sides illustrated in the figure are connected by a first rotating shaft 54 and rotate at the same angle. Further, the second lifting levers 53 at the front and the rear sides shown in the figure are connected by the second rotating shaft 55 and rotate at the same angle. Further, the first lifting levers 52 and the second lifting levers 53 are connected mutually at the front side and the rear side, respectively. The first rotating shaft 54 is provided with a handle 57 at its end. The first rotating shaft 54 and second rotating shaft 55 are supported in the rotatable state on the body of the apparatus. When the handle 57 is rotated, the first rotating shaft 54 rotates and thus, the first lifting levers 52 at the front and the rear sides are rotated. When the first lifting lever 52 is rotated, the connecting link 56 is pulled in the rotating direction, and the second lifting lever 53 is rotated. The belt unit frame 58 is lifted to the photosensitive drums 2Y, 2M, 2C and 2BK side when the first and the second lifting levers 52 and 53 are rotated.

In the image forming, the image forming apparatus is kept in the state where the handle 57 is rotated, that is, the belt unit frame 58 is lifted. The lifting levers have been designed to have lengths so that the conveyor belt 12 and the photosensitive drums 2Y, 2M, 2C and 2BK are maintained in the prescribed state where they are kept in contact with each other. In processing the jammed image receiving medium 8, when the handle 57 is rotated in the reverse direction To make the lifting levers level, the belt unit frame 58 goes down and the photosensitive drums 2Y, 2M, 2C and 2BK are separated from the conveyor belt 12 as illustrated in FIG. 45.

For a motor for driving the conveyor belt 12, an outer roller motor, which is in a construction that the motor body is contained in a roller and its housing is rotated, was adopted. Hereinafter, this motor will be described by referring it as a roller-in motor 61.

The conveyor belt 12 is put over a roller 61*a*, which is a rotating housing of the roller-in motor 61, and the driven roller 17, which is rotated with the movement of the conveyor belt.

Figure 46:
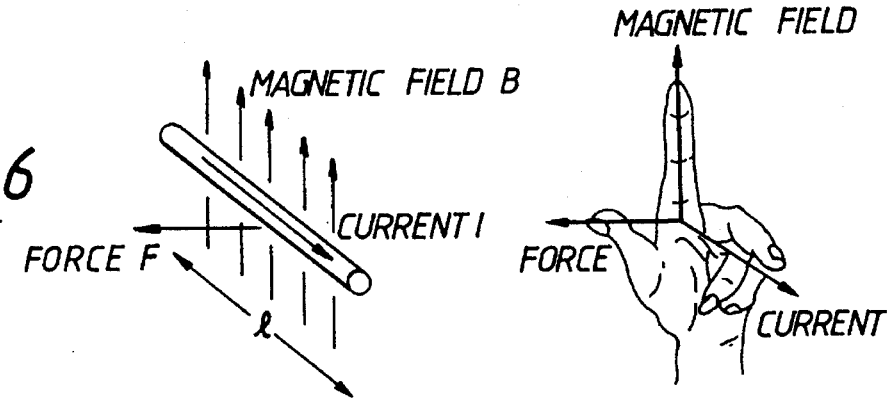
Fig.46 PRIOR ART
FIG. 46 is an explanatory diagram showing Fleming's left hand rule.
Figure 47:
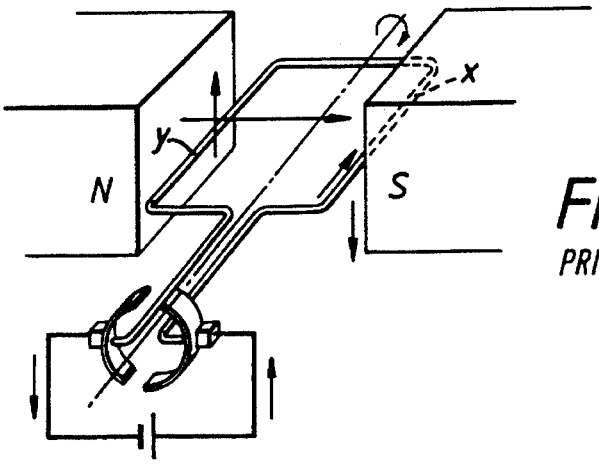
Fig.47 PRIOR ART
FIG. 47 is an explanatory diagram showing the principle of operation of a DC motor.

First, the principle of the motor will be briefly described. FIG. 46 is a diagram showing Fleming's left hand rule and FIG. 47 is a diagram showing the principle of a DC motor.

Motors called electric motors are all in a construction to run by converting electric energy into mechanical energy and generating turning force (torque) by electromagnetic force. The most basic electromagnetic force is according to Fleming's left hand rule illustrated in FIG. 46 and when current I is flown through a conductor in length l placed in the magnetic field B, a force F acting on the conductor is obtained.

A motor is manufactured on the basis of this principle and a DC motor illustrated in FIG. 47 rotates according to the principle described below. When a current is applied to a coil in the magnetic field in the direction shown in the figure, a downward force acts on a conductor x and an upward force acts on a conductor y and these conductors x, y are rotated clockwise. However, if this state is left as it is, the directions of the downward and upward forces are reversed when the conductors x, y are rotated to the opposite side and they are not rotated. So, when the conductors x, y are moved from under the N pole to the S pole and from under the S pole to the N pole, the current direction is reversed by a rectifier mechanism comprising commutator segments connected to the rotating conductors x, y and fixed brushes which are slide contacting the commutator segments, thus generating turning forces in the same direction. Actual motors are in a construction that a number of conductors and commutator segments are provided in order to increase the space utilization rate and to make generation of torque smooth and conductors are contained in the grooves of cores.

Figure 48:
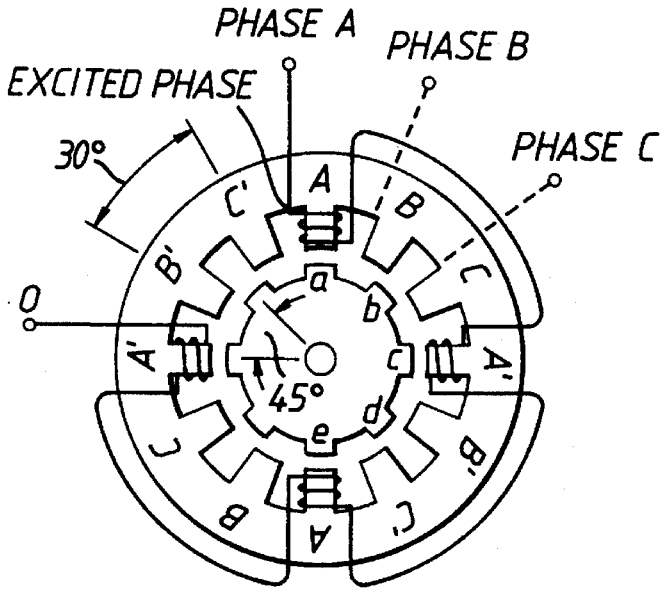
FIG. 48 is a diagram showing the principal construction of a stepping motor.
Figure 49:
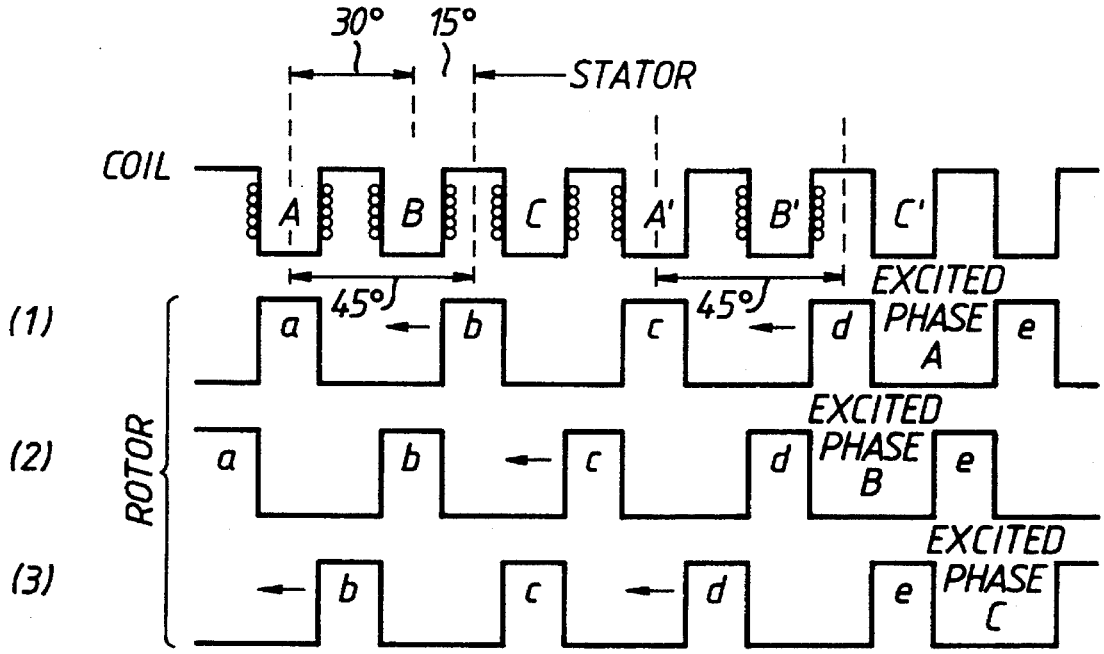
FIG. 49 is an explanatory diagram showing the principle of operation of the stepping motor shown in FIG. 48.

FIG. 48 shows a diagram of the principle of construction of a stepping motor used in this fourteenth embodiment and FIG. 49 shows a diagram of the principle of operation of the stepping motor. The stepping motor is a motor that rotates one step at a time at a fixed angle to input pulse and is also called a pulse motor or a step motor. In FIG. 49, if the phase A only is excited, magnetic flux becomes maximum when the rotor tooth comes under the tooth of the winding of phase A and the motor stops at the position (1). When the excitation is switched to the phase B successively, a force acts in the arrow direction and the motor stops at the position (2) and when snitched to the phase C, the motor proceeds to the position (3). Thus, the motor rotates a fixed step at a time (the basic step) when the excitation of the phase A/B/C is repeated.

In this fourteenth embodiment, the roller-in motor which is composed of this stepping motor is used. To be concrete, this motor is in such a construction that the outer rotor is rotated with the motor shaft fixed. This motor is generally called as an outer rotor type motor. When this outer rotor type motor is used, the outer rotor can be used as a roller. Further, the cross sectional area becomes small as the motor body is housed in the roller but the depth of the motor can be extended to the roller length. Therefore, a more cross sectional area can be obtained by an area corresponding to the depth although magnetic flux of an inner magnet per unit becomes small. It is generally said that in order to get an increased torque that is obtained when the outer diameter of a motor is made double by extending the depth of the motor, three times of the depth is needed. In the case of this embodiment, the outer rotor type motor was in a shape of ø50×30 mm. As the driving roller is ø25×290 mm, the cross sectional area is ¼ and the depth is about 10 times. Now, to make it easy to think, when judging based on the sectional area of the driving roller, a length of 6×30 mm is required for the depth from 2:3=4:X, X=6. That is, this means that a motor in ø50×30 mm and a motor in ø25×180 mm are able to generate the same torque. In this embodiment, from a 290 mm long driving roller, a motor in ø25×290 mm is able to have a torque of 1.6 times of that of a motor in ø25×180 mm. Thus, by housing a motor in a roller, it is possible to increase a motor torque without effecting a size of an apparatus.

Figure 50:
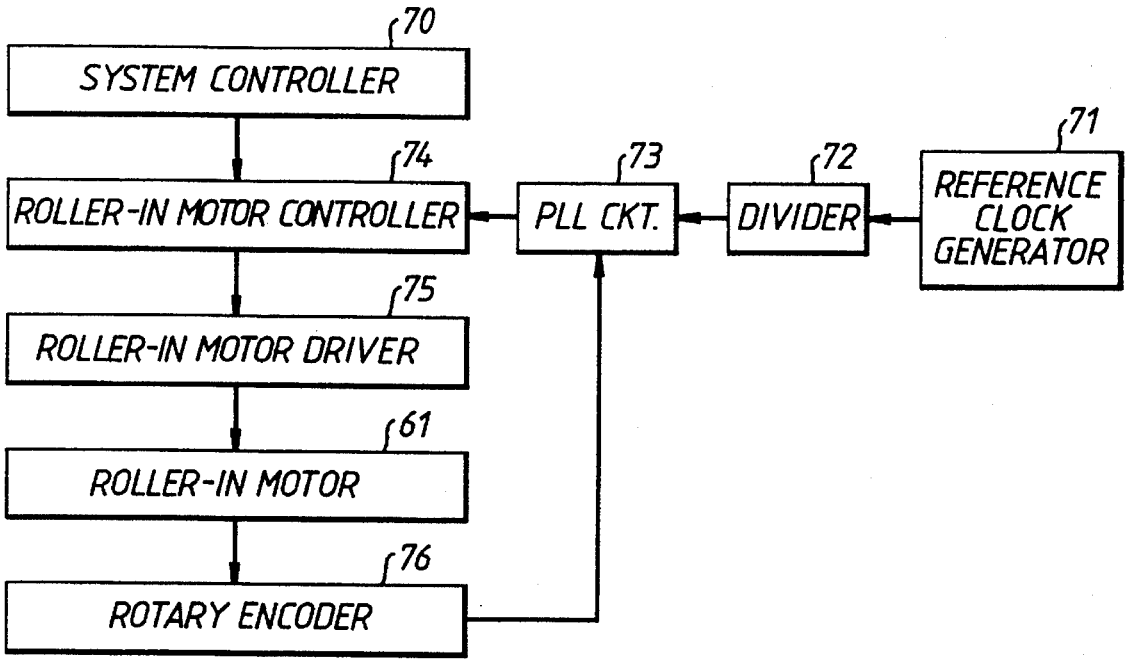
FIG. 50 is a block diagram for controlling the roller in-motor which is used in the conveyor belt unit shown in FIG. 44.

FIG. 50 shows a block diagram of the roller-in motor control. A system controller 70 is for controlling the entire apparatus. A reference clock generator 71 generates a reference clock and a divider 72 divides the reference clock from the reference clock generator 71. A PLL circuit 73 outputs driving pulses corresponding to a signal from the divider 72 and an encoder signal from the roller-in motor 61. A roller-in motor controller 74 controls the running of the roller-in motor by driving a roller-in motor driver 75 corresponding to the driving pulses from the PLL circuit 73. The divider 72 is used to generate clock widths that are easily controllable by the roller-in motor 61. A rotary encoder 76 as a rotary fluctuation detector is housed in the roller-in motor 61. The PLL control is to control driving control waveforms and output waveforms from the encoder 76 so that they agree with each other.

As described above, when an outer rotor type motor housing the motor body in the conveyor belt driving roller is used, it becomes possible to increase the motor torque without affecting the image forming apparatus. Further, differing from conventional motors, there is no occupying area at the outside of the conveyor belt and it becomes unnecessary to avoid the motor cross sectional area when processing jammed papers and there is a merit that image forming apparatus can be down sized.

According to this fourteenth embodiment, it is possible to eliminate an occupying area for an independent motor and easily increase the motor torque when roller-in type conveyor belt driving motors are adopted. Furthermore, it is not necessary to evade the conveyor belt unit largely when processing jammed papers. Thus, an image forming apparatus which does not become large in size.

Next, referring to FIGS. 51 through 60, a conveying means used in the image forming means shown in FIG. 1 as the fifteenth embodiment will be described.

Figure 51:
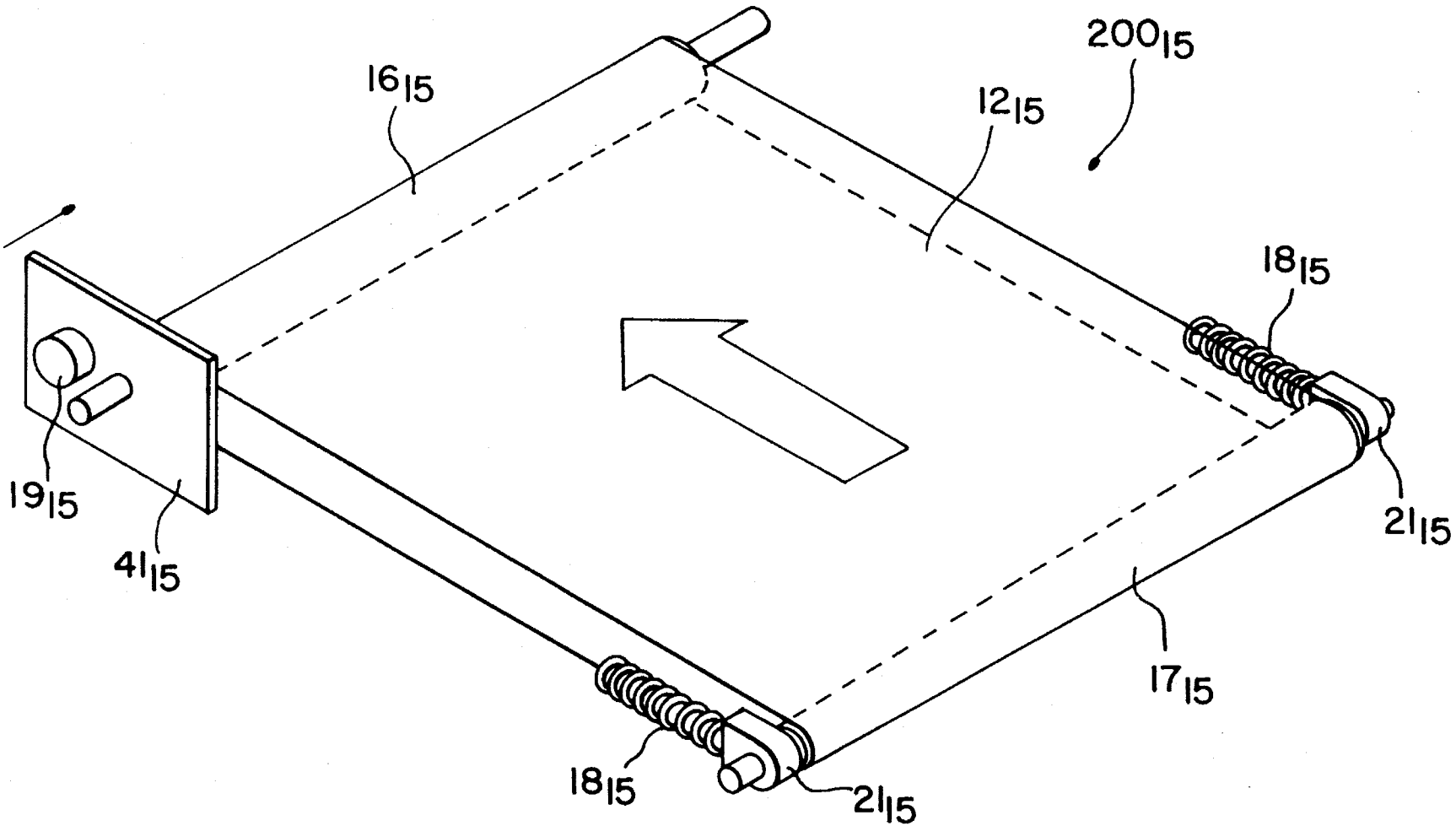
FIG. 51 is a perspective view showing a one-sided moving force measuring unit for measuring a one-sided moving force of a conveyor belt which is used on the image forming apparatus shown in FIG. 1.
Figure 52:
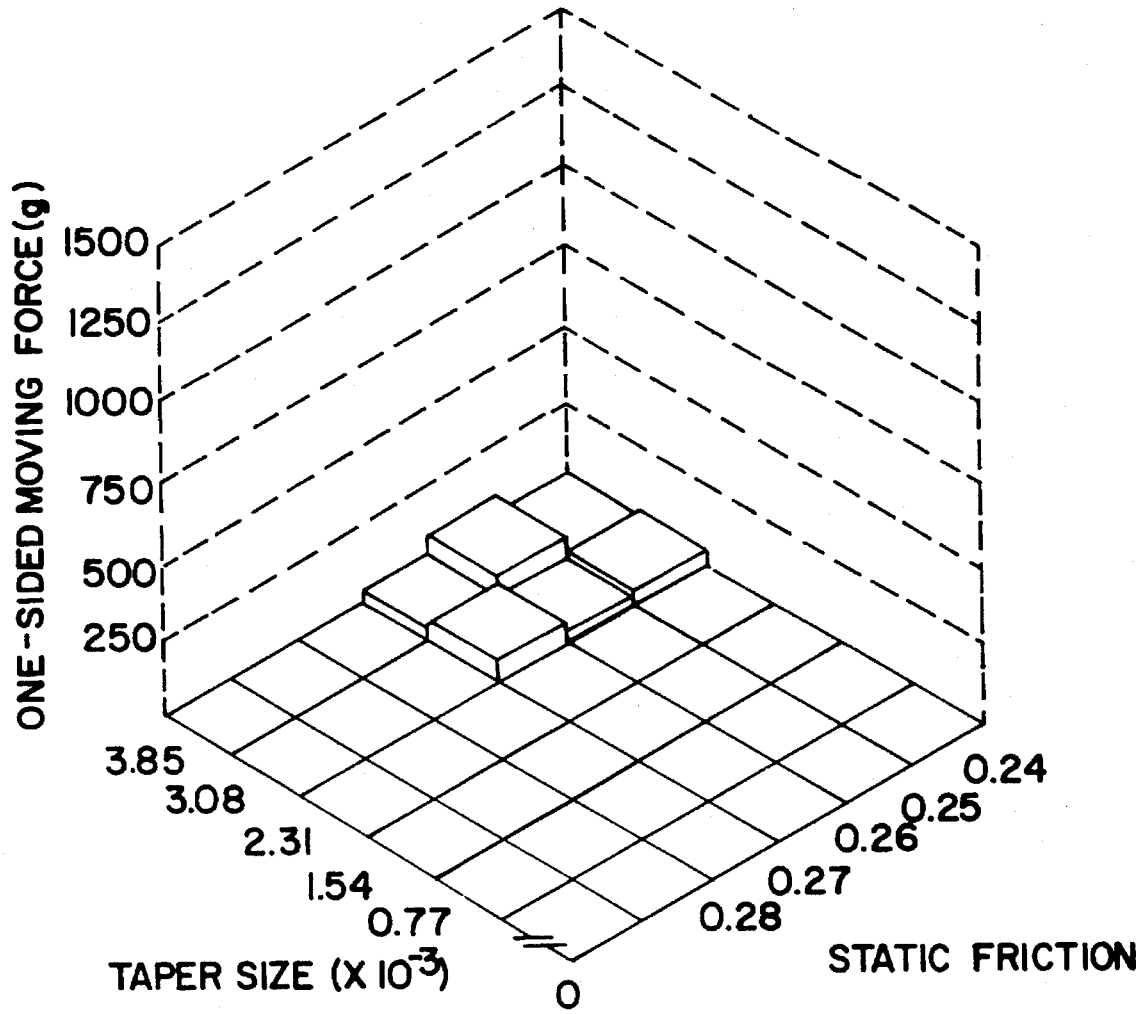
FIG. 52 is a diagram showing the results of the test which investigated the effects of taper sizes and coefficients of static friction of a conveyor belt with a load of 2.5 kg applied on the one-sided moving force of the conveyor belt using the one-sided moving force measuring unit as shown in FIG. 51.
Figure 53:
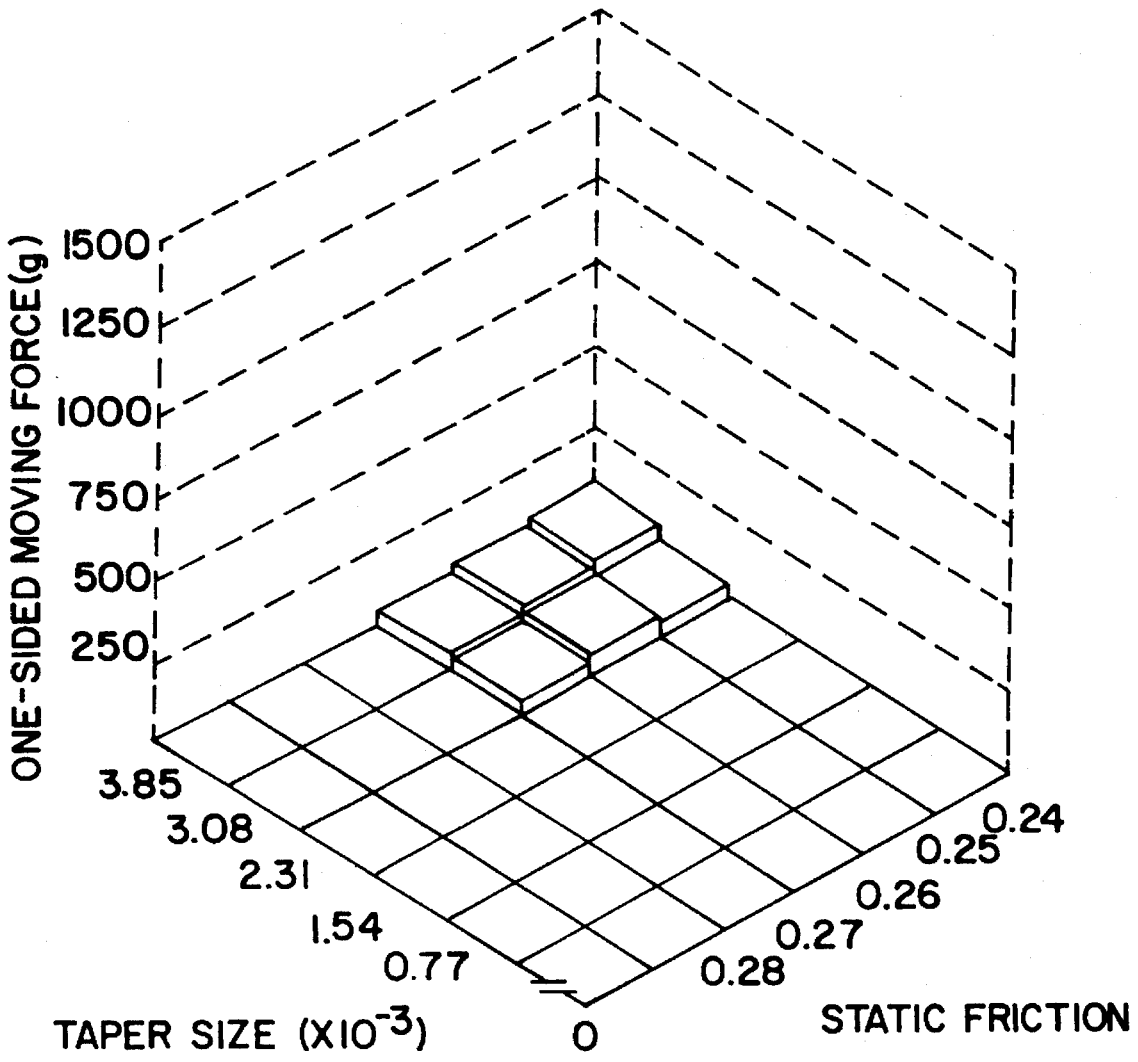
FIG. 53 is a diagram showing the results of the test which investigated the effects of taper sizes and coefficients of static friction of a conveyor belt with a load of 2.75 kg applied on the one-sided moving force of the conveyor belt using the one-sided force measuring unit shown in FIG. 51.
Figure 54:
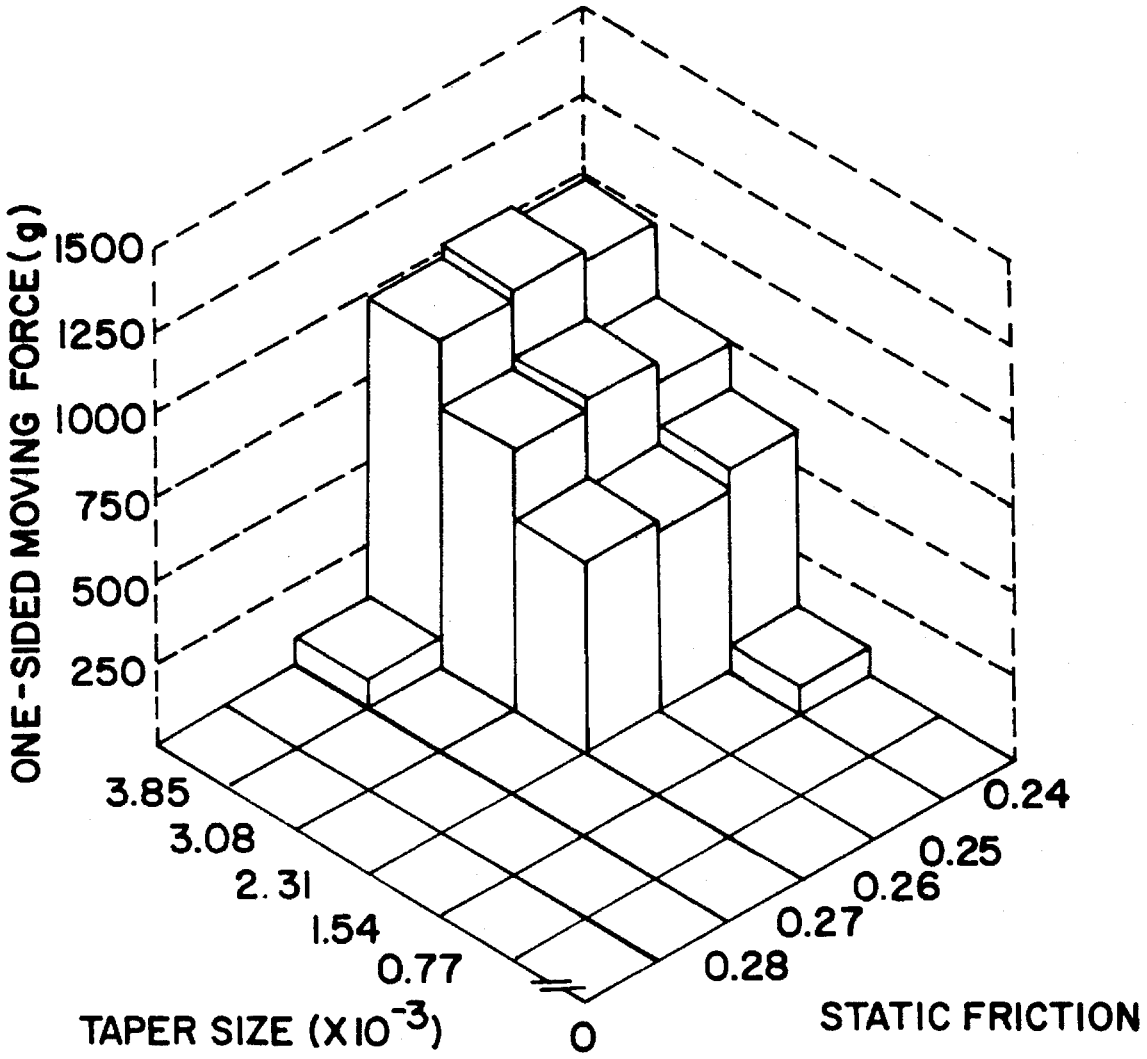
FIG. 54 is a diagram showing the results of the test which investigated the effects of taper sizes and coefficients of static friction of a conveyor belt with a load of 3.0 kg applied on the one-sided moving force of the conveyor belt using the one-sided force measuring unit shown in FIG. 51.
Figure 55:
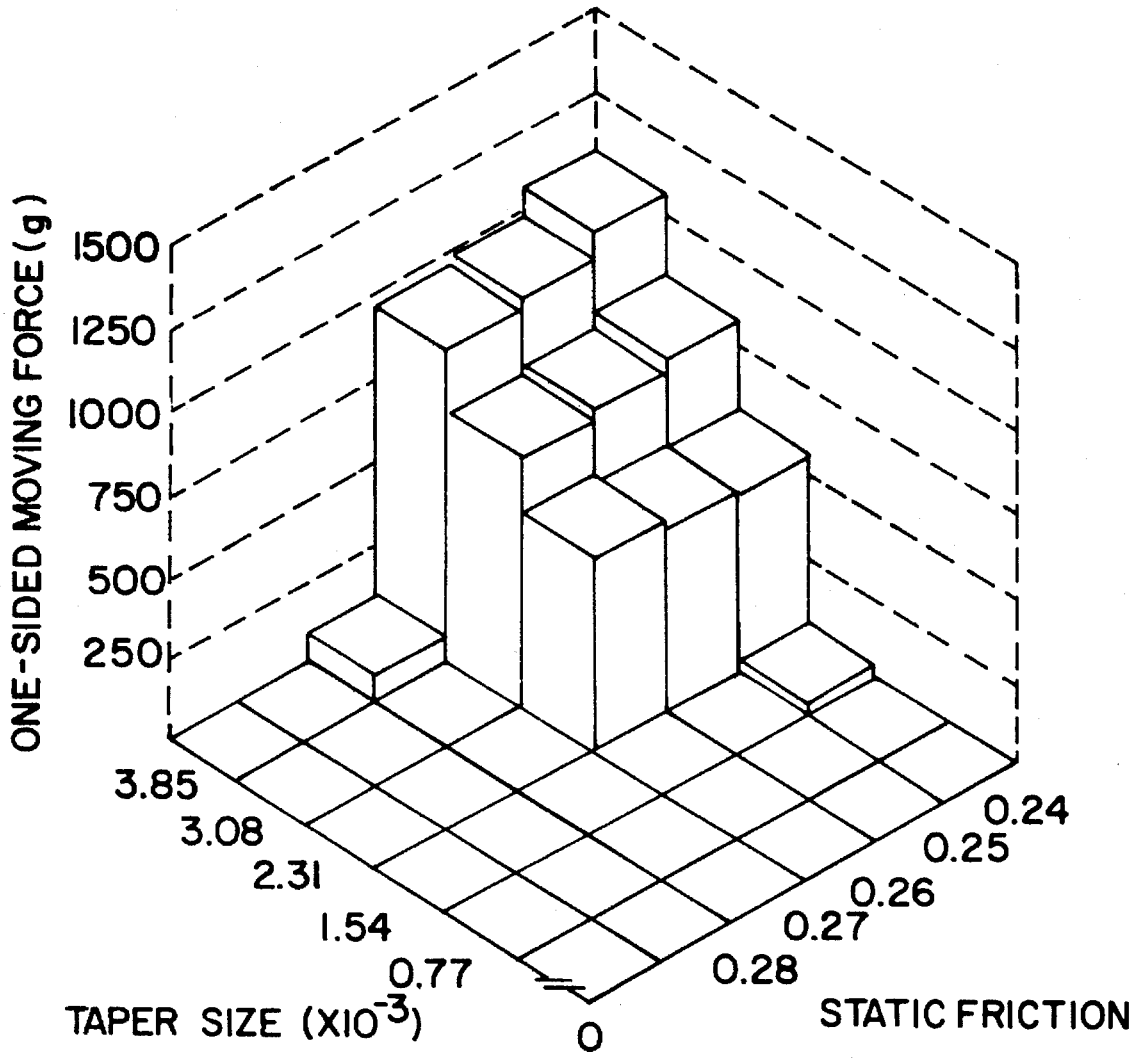
FIG. 55 is a diagram showing the results of the test which investigated the effects of taper sizes and coefficients of static friction of a conveyor belt with a load of 3.25 kg applied on the one-sided moving force of the conveyor belt using the one-sided force measuring unit shown in FIG. 51.
Figure 56:
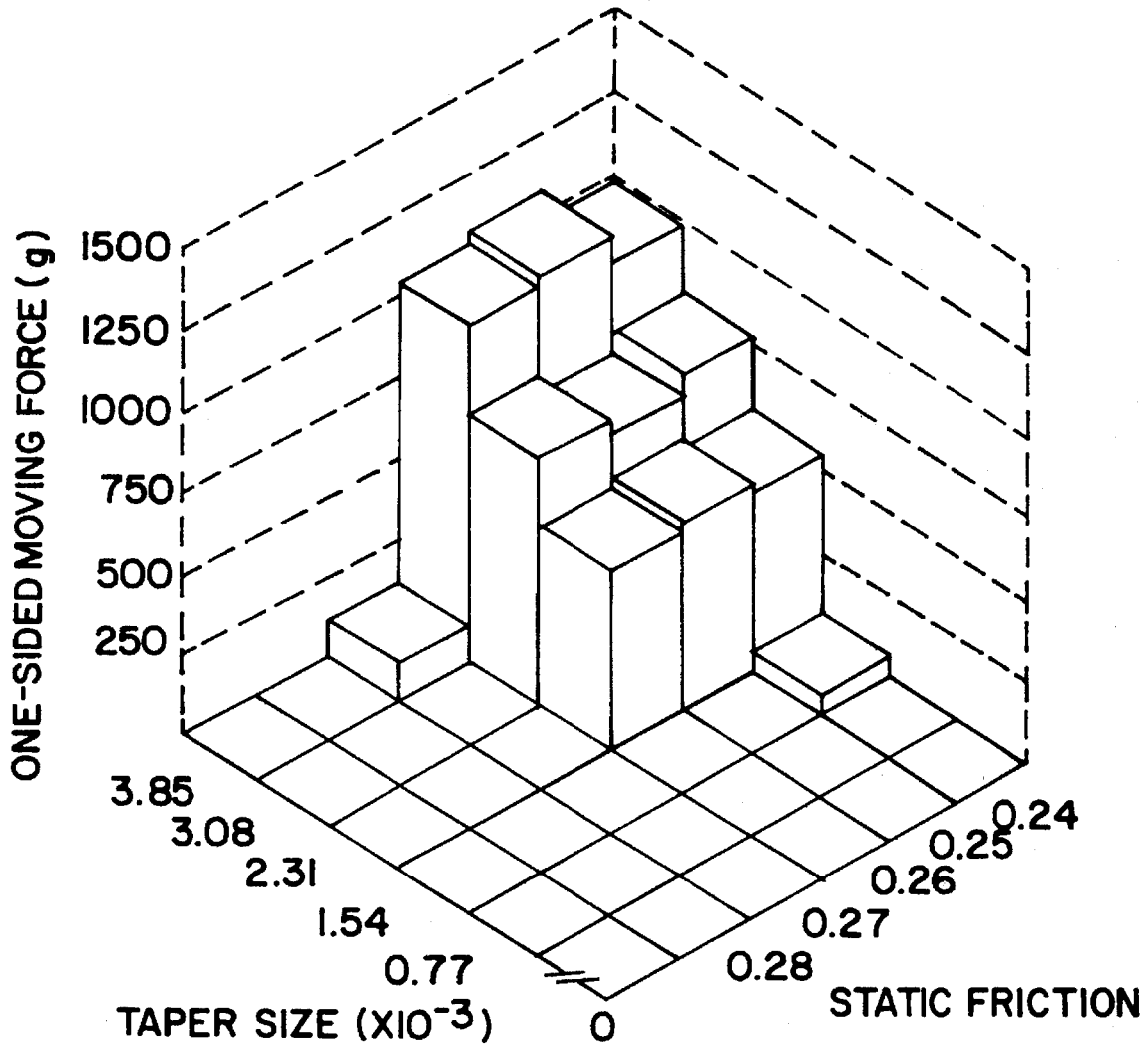
FIG. 56 is a diagram showing the results of the test which investigated the effects of taper sizes and coefficients of static friction of a conveyor belt with a load of 3.5 kg applied on the one-sided moving force of the conveyor belt using the one-sided force measuring unit shown in FIG. 51.

First, the inventor conducted a test to control the one-sided movement of the conveyor belt being moved with a tapered roller. The outline of the test apparatus used in this test is shown in FIG. 51.

A conveying means $\mathbf{200}_{15}$ comprises a conveyor belt $\mathbf{12}_{15}$ for conveying an image receiving medium, a driving roller $\mathbf{16}_{15}$ for driving the conveyor belt $\mathbf{12}_{15}$, a driven roller $\mathbf{17}_{15}$ having an inclined tapered surface, a regulation plate $\mathbf{41}_{15}$ arranged in the state movable in the direction parallel to the rotating center axis of the driving roller $\mathbf{16}_{15}$ and a one-sided moving force measuring sensor $\mathbf{19}_{15}$ for measuring one-sided moving force of the conveyor belt $\mathbf{12}_{15}$.

The endless type conveying belt $\mathbf{12}_{15}$ is put on the driving roller $\mathbf{16}_{15}$ and the tapered driven roller $\mathbf{17}_{15}$, and turned around by the rotation of the driving roller $\mathbf{16}_{15}$. The tapered driven roller $\mathbf{17}_{15}$ generates a tension on the conveying belt $\mathbf{12}_{15}$ as its bearing $\mathbf{21}_{15}$ is pushed outward by a driven roller compression spring $\mathbf{18}_{15}$ which is a tension applying means.

Now, if the driven roller $\mathbf{17}_{15}$ is a tapered roller, the conveyor belt $\mathbf{12}_{15}$ gradually skids toward the small diameter side of the tapered roller or the large diameter side of the tapered roller. In this test, as the regulation plate $\mathbf{41}_{15}$ is arranged at the small diameter side of the driven roller $\mathbf{17}_{15}$, if the conveyor belt $\mathbf{12}_{15}$ gradually skids toward the small diameter side of the driven roller $\mathbf{17}_{15}$, the one-sided moving force obtained by the action of the conveyor belt $\mathbf{12}_{15}$ against the regulation plate $\mathbf{41}_{15}$ is measured by the one-sided moving force measuring sensor $\mathbf{19}_{15}$. Further, the roller of the driven roller $\mathbf{17}_{15}$ has been designed in the length longer than the width of the conveyor belt $\mathbf{12}_{15}$ so that the taper effect will act on the overall width of the conveyor belt $\mathbf{12}_{15}$.

The slippage of the conveyor belt $\mathbf{12}_{15}$ is not necessarily taken place regardless of the taper size of the tapered driven roller $\mathbf{17}_{15}$. Further, the slippage of the conveyor belt $\mathbf{12}_{15}$ is also affected by the coefficient of friction of the tapered driven roller $\mathbf{17}_{15}$ with the conveyor belt $\mathbf{12}_{15}$. At the same time, it is also affected by the press contacting state of the tapered driven roller $\mathbf{17}_{15}$ and the conveyor belt $\mathbf{12}_{15}$, that is, a load applied on the conveyor belt.

So, in order to make these effects clear, the one-sided moving force was measured based on three parameters shown below:

(1) Coefficient of static friction of the conveyor belt $\mathbf{12}_{15}$ with the driven roller $\mathbf{17}_{15}$.
(2) Taper size of the driven roller $\mathbf{17}_{15}$.
(3) Load applied on the conveyor belt $\mathbf{12}_{15}$.

Now, definitions of the terms used will be clarified here.

The taper size is expressed in a value of a difference between the diameter D of the large diameter side of the driven roller $\mathbf{17}_{15}$ and the diameter d of the small diameter side divided by the length of the roller portion. That is, Taper T=(D–d)/L.

Further, change in coefficient of static friction was achieved by changing the surface condition of the driven roller $\mathbf{17}_{15}$. The applied load W of the conveyor belt $\mathbf{12}_{15}$ is a total value of sizes of the forces acting from the driven roller compression springs $\mathbf{18}_{15}$ at both sides of the conveyor belt $\mathbf{12}_{15}$ arranged to apply the tensions to the conveyor belt $\mathbf{12}_{15}$ as previously explained (the belt tension becomes W/2).

Further, the load applied on the conveyor belt was regulated by conversion of several kinds of the compression spring $\mathbf{18}_{15}$.

Now, sizes of respective parameters have been set as follows:

(1) Coefficient of friction:5 kinds of 0.24, 0.25, 0.26, 0.27 and 0.28.
(2) Taper size:5 kinds of $0.77\times10^{-3}$, $1.54\times10^{-3}$, $2.31\times10^{-3}$, $3.08\times10^{-3}$ and $3.85\times10^{-3}$
(3) Load applied to conveyor belt:5 kinds of 2.5 Kg, 2.75 Kg, 3.0 Kg, 3.25 Kg and 3.5 Kg The graphs showing these test results summarized are shown in FIGS. 52 through 56.

The load applied to the conveyor belt is shown in respective graphs as the load applied, and coefficient of static friction, taper size and size of one-sided moving force of the conveyor belt are shown in the x, y and z axes, respectively.

What can be seen from these graphs are as follows:

(1) When a load applied to the conveyor belt is noted, the conveyor belt $\mathbf{12}_{15}$ moves toward the small diameter side of the driven roller $\mathbf{17}_{15}$ at a load applied to the belt above 3 kg.
(2) When a coefficient of static friction is noted, the conveyor belt $\mathbf{12}_{15}$ moves toward the small diameter side of the driven roller $\mathbf{17}_{15}$ at a coefficient of static friction below 0.26.
(3) When a taper size of the driven roller $\mathbf{17}_{15}$ is noted, the conveyor belt moves toward the small diameter side of the tapered roller $\mathbf{16}_{15}$ at a taper size above $2.31\times10^{-3}$.
(4) When a load applied to the conveyor belt is noted, if it is above 3 kg, there is no change in the one-sided moving force pursuant to change in size of load applied to the belt and a nearly constant one-sided moving force is obtained.
(5) When a coefficient of static friction is noted, if it is below 0.26, there is no change in the one-sided moving force pursuant to change in size of coefficient of static friction and a nearly constant force is obtained.
(6) When a size of the driven roller $\mathbf{17}_{15}$ is noted, if it is above $2.31\times10^{-3}$, a change in the one-sided moving force corresponding to the change in taper size is obtained.

Now, as to the phenomenon of (4), it can be explained as follows. That is, as the driving and driven rollers do not contact the conveyor belt $\mathbf{12}_{15}$ closely if a load applied to the conveyor belt is less than 3 kg and the conveyor belt does not run stably, the one-sided moving direction of the conveyor belt toward the driven roller $\mathbf{17}_{15}$ cannot be controlled. On the other hand, if a load applied to the conveyor belt becomes 3 kg, the rollers closely contact the conveyor belt $\mathbf{12}_{15}$ and the effect of the driven roller $\mathbf{17}_{15}$ will depend on sizes of taper and coefficient of static friction. If a load applied to the conveyor belt exceeds 3 kg, as a stabilized close contacting (slipping) state has already been produced between the driving and driven rollers and the conveyor belt $\mathbf{12}_{15}$, size of the one-sided moving force does not change in consonance with size of a load applied to the belt.

Next, as to the phenomenon of (5), it can be explained as follows. That is, if a coefficient of static friction is above 0.26, no stabilized slipping state is produced between the conveyor belt $\mathbf{12}_{15}$ and the driven roller $\mathbf{17}_{15}$. If a coefficient of static friction becomes 0.26, the stabilized slipping state is produced between the conveyor belt $\mathbf{12}_{15}$ and the driven roller $\mathbf{17}_{15}$. This slip progresses toward the small diameter side of driven roller $\mathbf{17}_{15}$. If this coefficient of static friction is less than 0.26, as a stabilized slipping stage has already been produced, size of the one-sided moving force does not change in consonance with size of coefficient of static friction.

Further, as to the phenomenon of (6), it can be explained as follows. That is, up to the taper size $2.31\times10^{-3}$, a one-sided moving force original to the conveyor belt is larger than the taper size and is not controllable by the inclination of the taper. However, if the taper size becomes $2.31\times10^{-3}$, a force of the conveyor belt to slip on the tapered portion becomes strong by its one-sided moving force and the one-sided moving force is governed by the taper direction not by the one-sided moving direction original to the conveyor belt. If the taper size exceeds $2.31\times10^{-3}$, the slipping amount of the conveyor belt 12 becomes conspicuous in response to the taper size and a one-sided moving force corresponding to the taper size is obtained and the slip progresses toward the small diameter side of driven roller $\mathbf{17}_{15}$.

As described above in detail, when these results are summarized, if a taper size is made to above $2.31\times10^{-3}$, the conveyor belt $\mathbf{12}_{15}$ and a tapered roller which have a coefficient of static friction below 0.26 are used and a load applied to the conveyor belt is regulated preferably to above 3 kg, it becomes possible to control the one-sided moving direction of the belt $\mathbf{12}_{15}$ toward the small diameter side of the driven roller $\mathbf{17}_{15}$.

Next, to promote the stability to control the one-sided moving direction according to this system, a test was conducted using the TAGUCHI method.

This TAGUCHI Method is one test method of the quality control engineering and it is a test method for selecting parameters comprising an apparatus A for performing a motion B stably under a considerable operating environment to the optimum condition when, for instance, the apparatus A performs the motion B.

That is, this method has a feature to economically create a function that is strong against noise by taking noise, which makes a function worse, in positively when making an appraisal.

Taguchi Method makes use of a technique called "two-stage design by parameter." In the first-stage designing, a control factor and an error factor are extracted. These factors are assigned to an orthogonal array, according to which an experiment will be done to select an optimal combination of parameters. The optimal parameters thus selected at this stage mean their combination obtained from the viewpoint of at which level should be selected the respective factors as obtained from the experimental results at the first stage. That is, no experiment has been really performed by any actual combination of the parameters. Then a difference will be calculated out, from the experimental results at the first stage, between the optimal combination of the parameters and the gain given by a combination under actual conditions. The difference thus calculated will be taken as a criterion. At the second stage both the experiment by the combination of the parameters as actually chosen and the experiment under the combination of current conditions will be performed to calculate out the differential gain from these actual experimental results. If the estimated difference in the first gain and the differential gain coming out of the actual confirming experiment are almost equivalent to each other, one can make sure that the experiment had the reproducibility confirming that the parameters had been correctly chose. If, on the contrary, the difference is great between the estimated differential gain in the first case and the gain resulting from the actual confirming experiment, one can evaluate that the experiment has no reproducibility, that the combination has been made of the parameters susceptible to noise and finally that one could not obtain any optimal combination of parameters.

Figure 57:
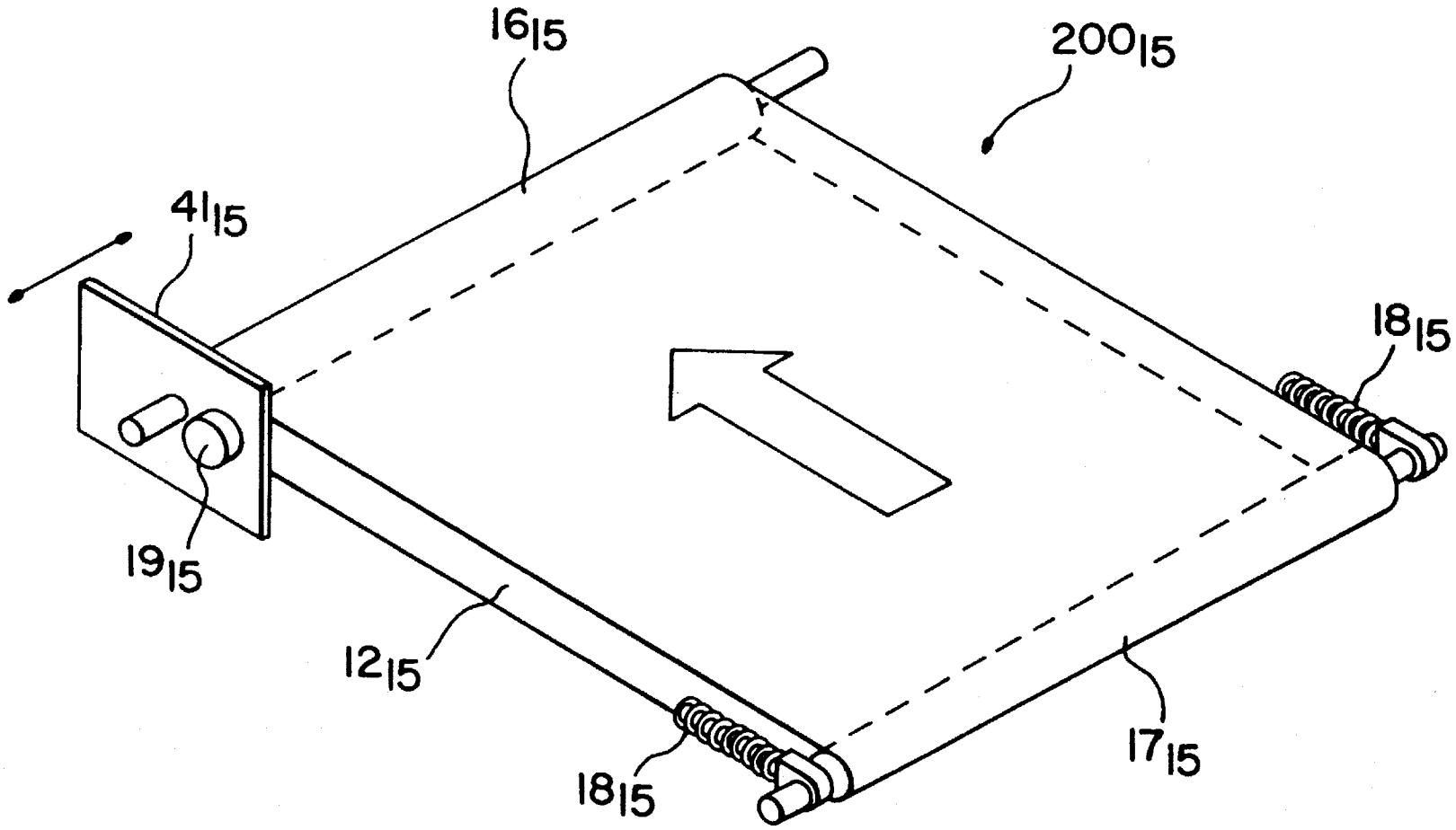
FIG. 57 is a perspective view showing an apparatus used in a test according to the TAGUCHI Method, which is an embodiment of the present invention.

The outline of the test apparatus is shown in FIG. 57. If the conveyor belt $\mathbf{12}_{15}$ moves toward the regulation plate $\mathbf{41}_{15}$ and pushes the regulation plate $\mathbf{41}_{15}$, this regulation plate pushes the fixed one-sided moving force measuring sensor $\mathbf{19}_{15}$ and thus, a force of the conveyor belt $\mathbf{12}_{15}$ to push the regulation plate $\mathbf{41}_{15}$ can be measured. The regulation plate $\mathbf{41}_{15}$ is in such a structure that it is possible to move in the direction perpendicular to the rotating shaft of the driven roller $\mathbf{17}_{15}$.

Parameters used in the test are as follows. Control factors are four kinds: (1) taper size, (2) load applied to the conveyor belt, (3) conveyor belt thickness and (4) applied load balance and values of respective factors are:

(1) Taper size=$0\times10^{-3}$, $2.31\times10^{-3}$ and $3.85\times10^{-3}$.

(2) Load applied to the conveyor belt=3.0, 3.5 and 4.0 kg.

(3) Conveyor belt thickness=75 and 100 μm.

(4) Applied load balance=10%, 20% and 30% increased at the large diameter side.

Further, error factors which cause noise were determined to be six kinds: (1) temperature and humidity, (2) the surface conditions of rollers, (3) variance in applied load, (4) parallelism of the photosensitive drum shafts, (5) parallelism of the transfer roller shafts and (6) difference in peripheral lengths of the conveyor belt, and values of respective factors were determined as follows:

(1) Temperature and humidity=high temperature and high humidity (30° C.–85%), low temperature and low humidity (10° C.–20%).

(2) The surface condition of the rollers=no toner contamination, with toner contamination.

(3) Dispersion of applied load=30% large at the small diameter side, 30% large at the large diameter side.

(4) Parallelism of the photosensitive drum shafts=0.2 mm upper stream at the small diameter side, 0.2 mm upper stream at the large diameter side.

(5) Parallelism of the transfer roller shafts=0.2 mm upper stream at the small diameter side, 0.2 mm upper stream at the large diameter side.

(6) Difference in the peripheral lengths of the belt=long at the small diameter side, long at the large diameter side.

Further, the conveyor belt $12_{15}$ in the different peripheral lengths of both edges was used in these tests. That is, when the peripheral lengths of both edges are L1 and L2 as shown in FIG. 12, wherein the sixth embodiment is presented, the peripheral lengths were set at L1>L2 in the sixth embodiment. In this test, a case wherein L1 was set to be larger than L2 (L1>L2) likewise the sixth embodiment and a case wherein L1 was set at smaller than L2 (L1<L2) were adopted. Therefore, "Smaller diameter side N short" described in the "f:Peripheral length difference of both edges of the belt" column in Tables 2 and 3 shows that the peripheral length L1 corresponding to the small diameter side of the driven roller $17_{15}$ is shorter than the peripheral length L2 corresponding to the large diameter side. "Small diameter side N Long" shows that the peripheral length L1 corresponding to the small diameter side of the driven roller $17_{15}$ is longer than the peripheral length L2 corresponding to the large diameter side.

Further, "Large diameter side upper stream" described in the Parallelism of the transfer roller shafts column shows the state that one end of each rotating shaft of the transfer rollers 5Y, 5M, 5C and 5BK (shown in FIG. 1) is one-sided to the direction of the large diameter side of the driven roller $17_{15}$. "Small diameter side upper stream" shows the state that one end of each rotating shaft of the transfer rollers 5Y, 5M, 5C and 5BK (shown in FIG. 1) is one-sided to the direction of the small diameter side of the driven roller $17_{15}$.

Further, "Large diameter side upper stream" described in Parallelism of the photosensitive drum shafts column shows the state that one end of each rotating shaft of the photosensitive drums 2Y, 2M, 2C and 2BK (shown in FIG. 1) is one-sided toward the large diameter side of the driven roller $17_{15}$. "Small diameter side upper stream" shows the state that one end of each rotating shaft of the photosensitive drums 2Y, 2M, 2C and 2BK (shown in FIG. 1) is one-sided toward the small diameter side of the driven roller $17_{15}$.

Now, allocating these control factors at orthogonality L18 and the error factors at orthogonality LB, 144 tests were conducted by direct product according to the orthogonal array table.

Further, a force pushing the regulation plate $41_{15}$ by the conveyor belt $12_{15}$ was used as the output values of the tests.

Now, the measured results are simplified and shown in Table 1.

TABLE 1

| Error factor | | | | | | | | | |
|---|---|---|---|---|---|---|---|---|---|
| | f: Peripheral length difference between both edges of belt | Small diameter side/short | Small diameter side/long | Small diameter side/long | Small diameter side/short | Small diameter side/short | Small diameter side/long | Small diameter side/long | Small diameter side/short |
| | e: Parallelism of roller shafts | Large diameter side upper stream | Small diameter side upper stream | Large diameter side upper stream | Small diameter side upper stream | Small diameter side upper stream | Large diameter side upper stream | Small diameter side upper stream | Large diameter side upper stream |
| | d: Parallelism of photosensitive drum shafts | Large diameter side upper stream | Small diameter side upper stream | Large diameter side upper stream | Small diameter side upper stream | Large diameter side upper stream | Small diameter side upper stream | Large diameter side upper stream | Small diameter side upper stream |
| | c: Variance in applied load | Small diameter side large | | Large diamater side large | | Large diameter in lare | | Small diameter side large | |
| | b: Surface condition of roller | With toner contamination | | No toner contamination | | With toner contamination | | No toner contamination | |
| | a: Temperature & humidity | High temperature/High humidity (30° C.—85%) | | | | Low termpature/Low humidity (10° C.–20%) | | | |

| | Control factor (L18) | | | | | | | | | | | | |
|---|---|---|---|---|---|---|---|---|---|---|---|---|---|
| No. | (1 Raw) C: Belt thickness | (2 Raw) A: Taper size | (3 Raw) B: Load applied to belt | (4 Raw) D: Appoied load balance | N1 | N2 | N3 | N4 | N5 | N6 | N7 | N8 |
| 1 | 75 μm | 0 | 3.0 kg | Large diameter side 10% increase | ◎ | X | ◎ | ◎ | X | X | ◎ | ◎ |
| 2 | 75 μm | 0 | 3.5 kg | Large diameter side 20% increase | ◎ | X | ◎ | ◎ | X | X | ◎ | ◎ |
| 3 | 75 μm | 0 | 4.0 kg | Large diameter side 30% increase | ◎ | X | ◎ | ◎ | X | X | ◎ | ◎ |
| 4 | 75 μm | $3.85 \times 10^{-3}$ | 3.0 kg | Large diameter side 10% increase | ◎ | X | ◎ | ◎ | X | X | ◎ | ◎ |
| 5 | 75 μm | $3.85 \times 10^{-3}$ | 3.5 kg | Large diameter side 20% increase | ◎ | X | ◎ | ◎ | X | X | ◎ | ◎ |
| 6 | 75 μm | $3.85 \times 10^{-3}$ | 4.0 kg | Large diameter side 30% increase | ◎ | X | ◎ | ◎ | X | X | ◎ | ◎ |
| 7 | 75 μm | $2.31 \times 10^{-3}$ | 3.0 kg | Large diameter side 20% increase | ◎ | X | ◎ | ◎ | X | X | ◎ | ◎ |
| 8 | 75 μm | $2.31 \times 10^{-3}$ | 3.5 kg | Large diameter side 30% increase | ◎ | X | ◎ | ◎ | X | X | ◎ | ◎ |
| 9 | 75 μm | $2.31 \times 10^{-3}$ | 4.0 kg | Large diameter side 10% increase | ◎ | X | ◎ | ◎ | X | X | ◎ | ◎ |
| 10 | 100 μm | 0 | 3.0 kg | Large diameter side 30% increase | ◎ | X | ◎ | ◎ | ◎ | X | ◎ | ◎ |
| 11 | 100 μm | 0 | 3.5 kg | Large diameter side 10% increase | ◎ | X | ◎ | ◎ | ◎ | X | ◎ | ◎ |
| 12 | 100 μm | 0 | 4.0 kg | Large diameter side 20% increase | ◎ | X | ◎ | ◎ | ◎ | X | ◎ | ◎ |
| 13 | 100 μm | $3.85 \times 10^{-3}$ | 3.0 kg | Large diameter side 20% increase | ◎ | X | ◎ | ◎ | ◎ | X | ◎ | ◎ |
| 14 | 100 μm | $3.85 \times 10^{-3}$ | 3.5 kg | Large diameter side 30% increase | ◎ | X | ◎ | ◎ | ◎ | X | ◎ | ◎ |
| 15 | 100 μm | $3.85 \times 10^{-3}$ | 4.0 kg | Large diameter side 10% increase | ◎ | X | ◎ | ◎ | ◎ | X | ◎ | ◎ |
| 16 | 100 μm | $2.31 \times 10^{-3}$ | 3.0 kg | Large diameter side 30% increase | ◎ | ◎ | ◎ | ◎ | ◎ | X | ◎ | ◎ |
| 17 | 100 μm | $2.31 \times 10^{-3}$ | 3.5 kg | Large diameter side 10% increase | ◎ | ◎ | ◎ | ◎ | ◎ | X | ◎ | ◎ |
| 18 | 100 μm | $2.31 \times 10^{-3}$ | 4.0 kg | Large diameter side 20% increase | ◎ | ◎ | ◎ | ◎ | ◎ | X | ◎ | ◎ |

As explained above, a one-sided moving force (unit:g) was used to show the output values in the actual tests. However, as the explanation will be specialized even when numerical values are presented, the results are not shown in numerical values of the measured one-sided moving force but are shown by whether the one-sided moving direction could be controlled. That is, if the one-sided moving direction occurred by the skid of the conveyor belt $12_{15}$ toward the small diameter of the driven roller $17_{15}$ can be controlled when the conveyor belt was conveyed under the parameter conditions shown in the orthogonal array table, the one-sided moving force is measured as a result. In this case, the results are shown by ◎ (a double circle) mark in Table 2.

On the other hand, if the conveyor belt $12_{15}$ does not move toward the small diameter side of the driven roller $17_{15}$ when the conveyor belt is conveyed under the parameter conditions shown in the orthogonal array table, the one-sided moving force is not measurable as a result. In this case, the results are shown with an X mark in the table 1.

Next, a dispersion analysis Table of applied load balance that was calculated base on the one-sided moving force measured values obtained in this test is shown as Table 2.

TABLE 2

| Control factor | f: Degree of freedom | S: Square total | V: Variance | ρ %: Rate of contribution |
|---|---|---|---|---|
| Applied load balance | 2 | 37.05 | 18.53 | 17.98 |

In this Table 2, the contribution rate is 17.98% and it can be seen that the influence rate is high.

Figure 58:
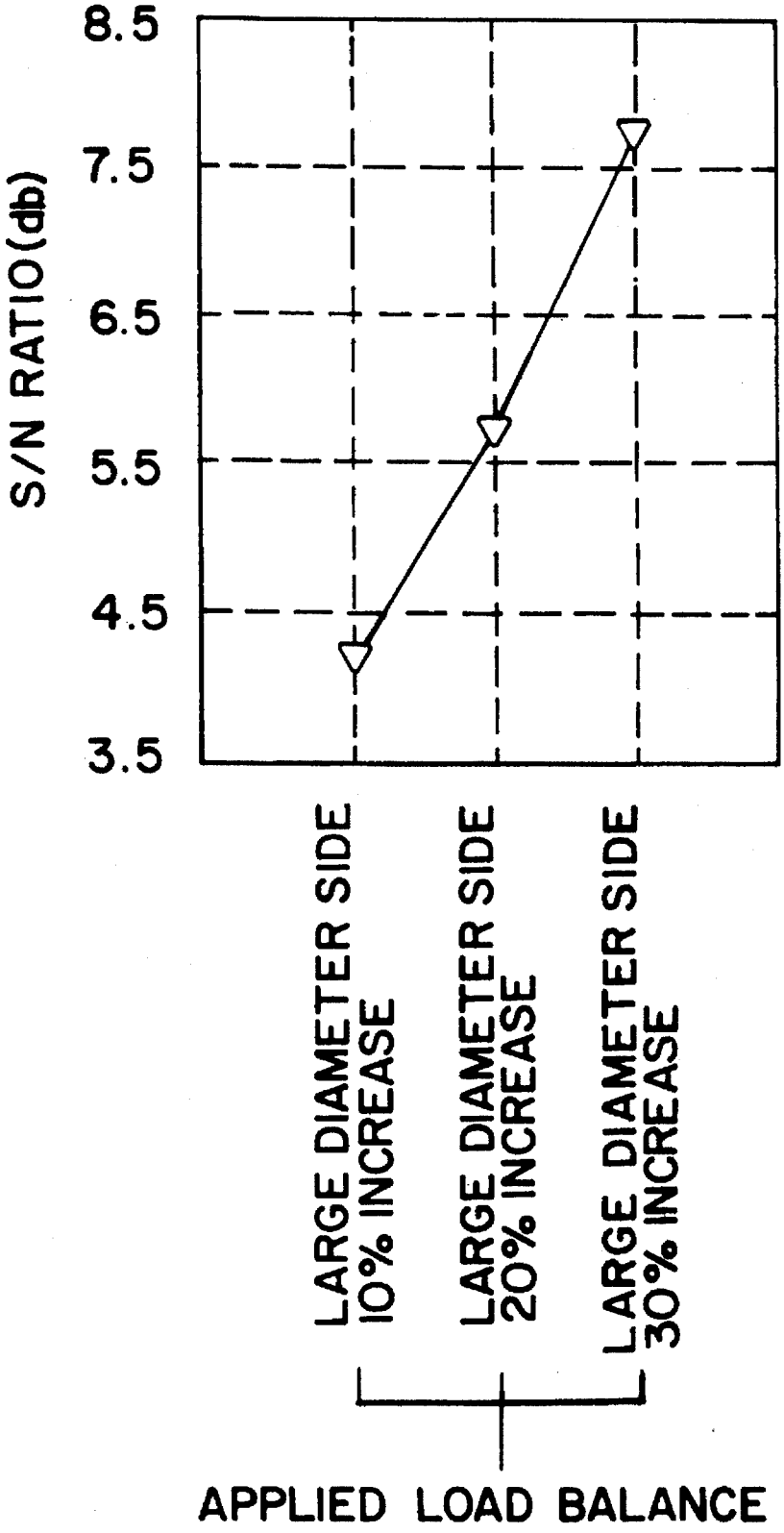
FIG. 58 is a diagram showing the effects of factors in the results of the tests (S/N ratio) using the apparatus shown in FIG. 57.

Next, the effects of factors of the applied load balance calculated based on the one-sided moving force measured by this test are shown in FIG. 58. In this graph, the x-axis shows sizes of parameters of the applied load balance and the y-axis shows the calculated results of S/N radio. That is, this graph shows that the more S/N ratio is high, the more stability is high.

S/N ratio or Signal-to-noise ratio involves the quantification of the stability of respective functions. It is defined by the formula below that represents the ratio of function (request output signal) to noise. A large SN ratio implies a great function (request output signal) or a little noise, or both, which ensures a stable state. Conversely, a small SN ratio means a small function (request output signal) or a large noise, or both, which signifies an unstable status.

S/N ratio=Function (request output signal)/noise diameter side. As seen in FIG. 58, this is the lowest value in the test conducted this time and it has been known that better conditions are obtainable if the balance is increased by 20% and 30%.

Estimated gain under the optimum condition:11.371 db

Estimated gain under the current condition:6.192 db

From the above figures, a difference between the gains is: A difference in gains under the current and the optimum conditions = 11.371 − 6.192 = 5.179 db
10logX = 5.179
where,
$X = 10^{0.5179} = 3.30$ That is, it can be seen that the reliability can be improved to 3.3 times of that under the current condition if the optimum condition (the state with the applied load balance increased 10% at the large diameter side) is adopted.

Next, a checking tests were conducted under both the optimum condition and the current condition. This test is to check if the estimated reliability improvement can be really achieved.

The measured results are simplified likewise Table 1 shown above and presented as Table 3.

TABLE 3

| | | | | | | | | | |
|---|---|---|---|---|---|---|---|---|---|
| Error factor | f: Peripheral length difference between both edges of belt | Small diameter side/short | Small diameter side/long | Small diameter side/long | Small diameter side/short | Small diameter side/short | Small diameter side/long | Small diameter side/long | Small diameter side/short |
| | e: Parallelism of transfer roller shafts | Large diameter side upper stream | Small diameter side upper stream | Large diameter side upper stream | Small diameter side upper stream | Small diameter side upper stream | Large diameter side upper stream | Small diameter side upper stream | Large diameter side upper stream |
| | d: Paralellism of photosenstive drum shafts | Large diameter side upper stream | Small diameter side upper stream | Large diameter side upper stream | Small diameter side upper stream | Large diameter side upper stream | Small diameter side upper stream | Large diameter side upper stream | Small diameter side upper stream |
| | c: Variance in applied load | Small diameter side large | | Large diamater side large | | Large diameter side large | | Small diameter side large | |
| | b: Surface condition of roller | With toner contamination | | No toner contamination | | With toner contamination | | No toner contamination | |
| | a: Temperature & humidity | High temperature/High humidity (30° C. - 85%) | | | | Low termpature/Low humidity (10° C. - 20%) | | | |

| | Control factor (L18) | | | | | | | | | | | |
|---|---|---|---|---|---|---|---|---|---|---|---|---|
| No. | (1 Row) C: Belt thickness | (2 Row) A: Taper size | (3 Row) B: Load applied to belt | (4 Row) D: Applied load balance | N1 | N2 | N3 | N4 | N5 | N6 | N7 | N8 |
| Optimum | 100 μm | $2.13 \times 10^{-3}$ | 3.5 kg | Rear 10% increase | ⊙ | ⊙ | ⊙ | ⊙ | ⊙ | ⊙ | ⊙ | ⊙ |
| Current | 100 μm | 0 | 3.0 kg | 0 | X | X | ⊙ | ⊙ | ⊙ | X | ⊙ | X |

Then, gains obtainable under the current condition and the optimum condition were calculated. Further, the applied load balance was calculated by selecting a case wherein the applied load balance was increased by 10% at the large As explained above, the one-sided moving force (unit:g) was used for indicating output values in the actual tests. However, as the explanation will become the specialized one even when numerical values are presented, it is shown whether the one-sided moving direction could be controlled instead of results of obtained one-sided moving force expressed in numerical values. That is, when the conveyor belt $12_{15}$ was moved under the parameter conditions shown in the orthogonal array table, the conveyor belt $12_{15}$ is moved toward the small diameter side of the driven roller $17_{15}$, and the one-sided moving force is measured as the result. In this case, the results are shown by ◎ (a double circle) mark in Table 3.

Next, the gains obtained under the current condition and the optimum condition in this checking tests were calculated. Further, the calculation was made by selecting the applied load balance increased by 10% at the large diameter side. This is the lowest value in the test of this time as seen in FIG. 58 and it has been known that better conditions can be obtained if the applied load balance is increased by 20% and 30%.

Gain under the optimum condition:18.93 db

Gain under the current condition:12.04 db

From the above figures, a difference between them is:

A difference between gains under the current condition and the optimum condition = 18.93 db − 12.04 db = 6.89 db $10\log X = 6.89$ Therefore, $X = 10^{0.5179} = 4.9$ That is, it was confirmed that the high reliability of 4.9 times of that under the current condition (without applied load balance), which is larger than the estimated reliability improving rate 3.3 time, can be obtained.

As described above in detail, when the results are summarized, it becomes possible to control the one-sided moving direction of the conveyor belt $12_{15}$ so that the conveyor belt $12_{15}$ is one-sided stably toward the small diameter side of the driven roller $17_{15}$ if the taper size is made more than $2.31\times10^{-3}$, the conveyor belt $12_{15}$ and the driven roller $17_{15}$ of coefficient of static friction 0.26 or less are used, the applied load at the large diameter side is increased by more than 10% of the applied load at the small diameter side and preferably, a load applied to the conveyor belt is set at more than 3 kg.

Further, it is preferable to apply load to the conveyor belt $12_{15}$ at less than 6 kg. If more than 6 kg load is applied to the conveyor belt $12_{15}$, a coefficient of friction between the conveyor belt $12_{15}$ and tapered driven roller $17_{15}$ increases so that the conveyor belt $12_{15}$ tends to skid toward the large diameter side of the tapered driven roller $17_{15}$. Further, if more than 6 kg load is applied to the conveyor belt $12_{15}$, the conveyor belt $12_{15}$ will be broken since the applied load is too large for the conveyor belt $12_{15}$. Therefore, it is preferable to apply a load to the conveyor belt $12_{15}$ at 3 to 6 kg, and to control the one-sided moving of the conveyor belt $12_{15}$ so that the conveyor belt $12_{15}$ is moved toward the small diameter side of the tapered driven roller $17_{15}$.

Now, the control of a zigzag running and one-sided moving direction and the zigzag running control method using a zigzag running regulation plate involved in the fifteenth embodiment will be explained.

Figure 59:
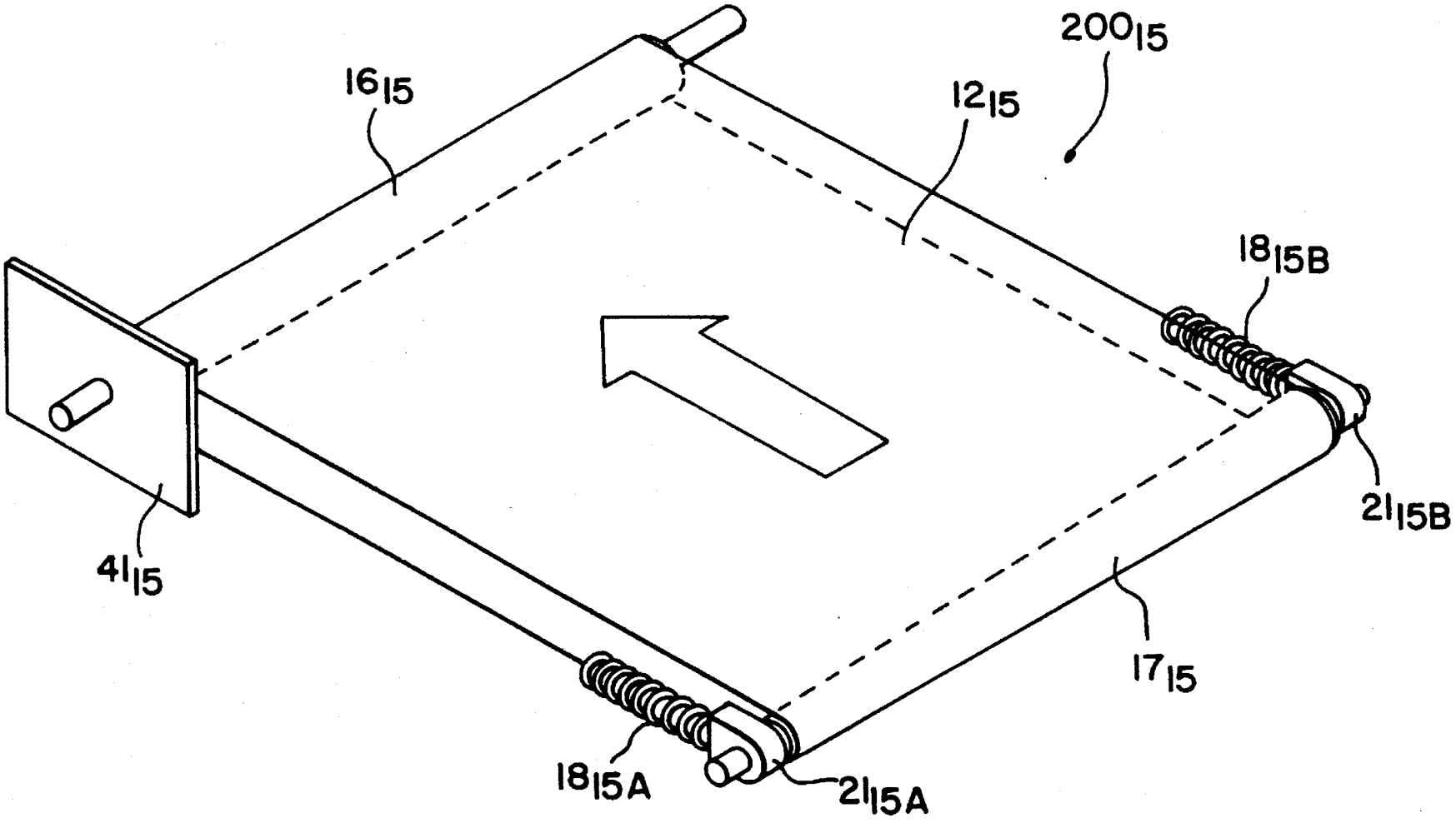
FIG. 59 is a perspective view showing a regulation plate type conveyor belt conveying apparatus, which is an embodiment of the present invention.
Figure 60:
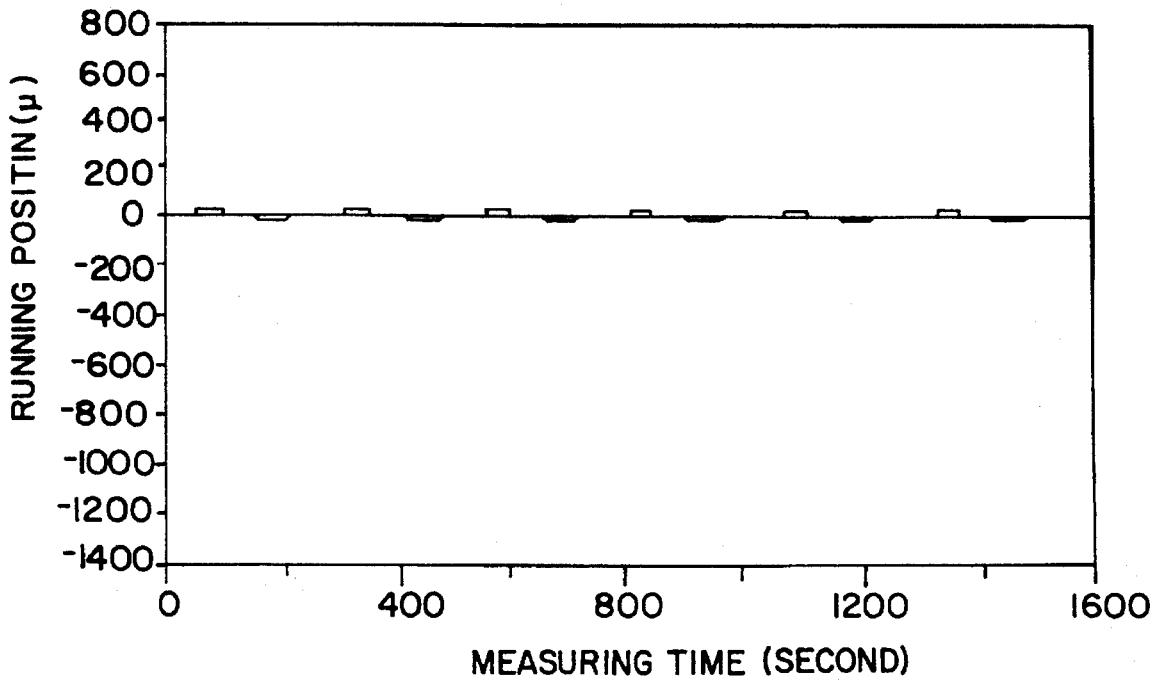
FIG. 60 is a diagram showing the one-sided and zigzag moving volume when the regulation plate shown in FIG. 59 was used.

As explained above, it is possible to stably control the one-sided moving direction of the conveyor belt $12_{15}$ using the driven roller $17_{15}$ comprising a tapered roller satisfying the above conditions and the applied load balance. According to this tapered roller system, the one-sided moving direction of the conveyor belt $12_{15}$ will become at the small diameter side of the driven roller $17_{15}$. As a method to control the zigzag movement using this nature, there is a system using the regulation plate $41_{15}$ as shown in FIG. 59. The conveying means $200_{15}$ shown in FIG. 59 comprises the conveyor belt $12_{15}$ for conveying an image receiving medium, the driving roller $16_{15}$ for driving the conveyor belt $12_{15}$, the tapered driven roller $17_{15}$ both ends of which diameters differs and the regulation plate $41_{15}$ which is a zigzag moving regulation plate. The endless shape conveyor belt $12_{15}$ is put on the driving roller $16_{15}$ and the tapered driven roller $17_{15}$ to be pulled around by the rotation of the tapered driven roller $17_{15}$ driven in accordance with the rotation of the driving roller $16_{15}$. As shown in FIG. 57, driven roller holders $21_{15A}$ and $21_{15B}$ of the tapered driven roller $17_{15}$ are pressed outward. This gives a tensile force to the conveyor belt $12_{15}$. As explained above, a compression spring $18_{15A}$ pressing the small diameter side driven roller holder $21_{15A}$ and a compression spring $18_{15B}$ pressing the large diameter side driven roller holder $21_{15B}$ of the tapered driven roller $17_{15}$ have been given with a difference of the belt compression force more than 10%. In the case of this embodiment, as the large diameter side of the tapered driven roller $17_{15}$ is arranged at the inner part in FIG. 59 and the small diameter side is arranged at this side, the compression spring $18_{15B}$ pressing the driven roller holder $21_{15B}$ at the large diameter side of the tapered driven roller $17_{15}$ is given with a compression force 10% higher than the compression spring $18_{15A}$ pressing the driven roller holder $21_{15A}$ at the small diameter side of the tapered driven roller $17_{15}$. Further, this tapered driven roller $17_{15}$ has a taper size more than $2.31\times10^{-3}$ and as described above, its small diameter side of the tapered roller is at this side in FIG. 59 and the large diameter side is at the inner part. Further, the roller surface of this tapered driven roller $17_{15}$ has been machined so that a coefficient of static friction between the tapered driven roller $17_{15}$ and the conveyor belt $12_{15}$ will become less than 0.26. Further, the compression springs $18_{15A}$ and $18_{15B}$ have been adjusted so that a total applied load at this side and the inner side in FIG. 59 will become more than 3 kg. On the other hand, the regulation plate $41_{15}$ has been arranged in the fixed state at this side of the driving roller $16_{15}$ (at the small diameter side of the tapered driven roller $17_{15}$ and the less applied load side of the conveyor belt) in FIG. 59.

The state of the conveyor belt $12_{15}$ in the construction described above when operated is as follows. When the conveyor belt $12_{15}$ is conveyed by the rotation of the driving roller $16_{15}$, the conveyor belt $12_{15}$ is gradually one-sided to the small diameter side of the tapered driven roller $17_{15}$, that is, to this side in FIG. 59. When the one-sided movement of the conveyor belt $12_{15}$ progresses, it contacts the regulation plate $41_{15}$ which is arranged in the fixed state at this side of the driving roller $16_{15}$ in FIG. 59 and is conveyed while constantly sliding. As the regulation plate $41_{15}$ is fixed in the stationary state, when the conveyor belt $12_{15}$ has one-sided for a certain amount, a force to press the regulation plate $41_{15}$ and a reaction generated therefrom are balanced against each other and the one-sided movement is stopped. On the other hand, as the zigzag running force of the conveyor belt $12_{15}$ is generally less than its one-sided moving force, the zigzag running force is included in the one-sided moving force and the reaction force when these forces are balanced and the zigzag running of the conveyor belt is not taken place. The test was conducted to measure the zigzag and one-sided movements of the conveyor belt $12_{15}$ in the construction described above and the result is shown in FIG. 60.

That is, the one-sided moving direction of the conveyor belt $12_{15}$ can be controlled by the regulation plate $41_{15}$ arranged at the small diameter side of the tapered driven roller $17_{15}$. By this means, it becomes possible to suppress the progress of the one-sided movement and zigzag running of the conveyor belt.

As described above, when the taper size is set at more than $2.31\times10^{-3}$, the conveyor belt $12_{15}$ and the tapered driven roller $17_{15}$ having a coefficient of static friction 0.26 or less are used, preferably applied load at the large diameter side is increased by 10% more than that of the small diameter side and further, preferably applied load to the conveyor belt is increased to above 3 kg, it becomes possible to control the one-sided moving direction of the conveyor belt $12_{15}$ so that it moves stably toward the small diameter side of the tapered driven roller $17_{15}$. Further, when the regulation plate $41_{15}$ is provided at the small diameter side of the tapered driven roller $17_{15}$ at the same time, it becomes possible to suppress the one-sided movement and the zigzag running of the conveyor belt with the high reliability.

The conveying means $200_{15}$ concerning the fifteenth embodiment will be further described.

Now, the rotating shafts of plural photosensitive drums 2Y, 2M, 2C and 2BK shown in FIG. 1 have been constructed parallel with each other. Further, the rotating shaft of the driving roller $16_{15}$ has been arranged parallel to the rotating shafts of plural photosensitive drums 2Y, 2M, 2C and 2BK.

On the other hand, the rotating shaft of the tapered shape driven roller $17_{15}$ has not been constructed parallel to the rotating shafts of the photosensitive drums 2Y, 2M, 2C and 2BK and the driving roller $16_{15}$. If the rotating shaft of the driven roller $17_{15}$ is parallel to the rotating shaft of the driving roller $16_{15}$ which is kept parallel to the rotating shafts of the photosensitive drums, as the driven roller $17_{15}$ is in the tapered shape, the ridge line of the large diameter side of the driven roller $17_{15}$ does not become parallel to the ridge line of its small diameter side and therefore, a difference is produced in the distances that are formed by both ridge lines with the photosensitive drums. Concretely, if the ridge line formed by the large diameter side of the driven roller $17_{15}$ with the driving roller $16_{15}$ is so constructed that it is kept contacted with the photosensitive drums, when the rotating shaft of the driving roller $16_{15}$ is positioned parallel to the rotating shaft of the driven roller $17_{15}$, the ridge line formed by the small diameter side of the driven roller $17_{15}$ and the driving roller $16_{15}$ does not contact the photosensitive drums. This is because the driven roller $17_{15}$ is in the tapered shape having a difference at both ends of the roller to its diameter. As the conveyor belt $12_{15}$ is put over the driving and driven rollers along this ridge line, an image receiving medium conveyed by the conveyor belt $12_{15}$ while being adsorbed does not contact the photosensitive drums at its part (the small diameter side) and as a result, is not able to transfer a toner image formed on the photosensitive drums even when transfer bias is applied.

So, the driven roller $17_{15}$ has been so constructed that it does not have the rotating shaft parallel to the driving roller $16_{15}$. When assuming that the large diameter of the driven roller $17_{15}$ is D, the small diameter is d and the roller length is L, this driven roller $17_{15}$ is kept in the state wherein the large diameter side is inclined to the lower side by an angle θ which is obtained from the following expression:

$$\tan\theta=\{(D-d)/2\}/L$$

When the rotating shaft of the driven roller $17_{15}$ is positioned parallel to the rotating shaft of the driving roller $16_{15}$, the inclination θ of the upper roller ridge at the photosensitive drum side of the driven roller $17_{15}$ is obtained as follows. First, a difference (D−d) between the roller diameter D at the large diameter side and the roller diameter d at the small diameter side becomes a difference in the direction perpendicular to the driven roller $17_{15}$. Then, when the roller length of the driven roller $17_{15}$ is assumed to be L, $\tan\theta=\{(D-d)/2\}/L$ is obtained as an upper inclination of the driven roller $17_{15}$. Now, when the rotating shaft of the driven roller $17_{15}$ and the rotating shaft of the driving roller $16_{15}$ are arranged parallel to each other, the large diameter side of the driven roller $17_{15}$ is inclined toward the upper side by an angle θ that is obtained above. So, if the large diameter side of the driven roller $17_{15}$ is arranged by inclining to the lower side, the upper surface of the driving roller $16_{15}$ and the upper surface of the driving roller $16_{15}$ become parallel to the plane surface formed at the transfer position of the photosensitive drum (parallel with the plane surface formed by the rotating shaft of the photosensitive drum) and an image receiving medium conveyed by the conveyor belt $12_{15}$ proportional to this plane surface contacts each of the photosensitive drums at respective transfer positions and a good toner picture without improper transfer is obtained.

Next, a test was conducted for the difference in the effect by Young's modulus in the conveying direction of the conveyor belt $12_{15}$ (Young's modulus in the direction to be pressed by the regulation plate) based on the test result described above. This test was conducted according to the test method shown in FIG. 59 using the conveyor belts $12_{15}$ with Young's modulus changed and the state of the sliding edges of the conveyor belts $12_{15}$ when the belts were run 300,000 times while kept contacting the regulation plate $41_{15}$ were compared. The results of this test are shown in Table 4. Further, ○ (circle) mark in the table shows the belt $12_{15}$ caused no problem and X mark shows the belt $12_{15}$ caused such problems as crack, deformation, etc. on the sliding edge.

TABLE 4

| Young's modulus | 100 | 150 | 200 | 250 | 300 | 350 | 400 | 450 |
|---|---|---|---|---|---|---|---|---|
| Result | X | X | ○ | ○ | ○ | ○ | ○ | ○ |

When Young's modulus was 100 kg/mm$^2$, a phenomenon wherein the sliding edge of the belt $12_{15}$ was turned up and elongated was caused as a result of sliding with the regulation plate $41_{15}$. As a result of this phenomenon, the conveyor belt $12_{15}$ ran in a zigzag direction because of the turned up edge although it was checked by the regulation plate $41_{15}$ and in an extreme example, the belt $12_{15}$ was broken. Further, when Young's modulus was 150 kg/mm$^2$, a phenomenon was also caused, wherein the sliding edge of the belt $12_{15}$ was turned up and elongated as a result of sliding with the regulation plate $41_{15}$.

On the other hand, in the case of Young's modulus 200 kg/mm$^2$, burr, chip, etc. were not produced on the edge sliding with the regulation plate $41_{15}$ and a good running was obtained. From this test result, it may be said that the proper Young's modulus in the direction perpendicular to the conveying direction of the belt $12_{15}$ is above 200 kg/mm$^2$.

Further, Young's modulus of this conveyor belt $12_{15}$ is that of material comprising single layer belts, coated multi-layer shaped belts, multi-layer structures including adhesive layers and is not an individual Young's modulus of materials comprising the belt $12_{15}$.

Next, a test for difference in the effect depending on difference in width of the belt $12_{15}$ was conducted based on the test results described above. The width of the belt $12_{15}$ is a length of the belt $12_{15}$ in the direction perpendicular to the conveying direction of the belt $12_{15}$.

This test was conducted according to the test method shown in FIG. 59 using the belts $12_{15}$ in different widths for checking whether the one-sided movement of the belt $12_{15}$ is effectively controlled to the direction of the regulation plate $41_{15}$ shown at this side in FIG. 59.

The results of this test are shown in Table 5. Further, ○ (circle) mark in the table shows no problem and X mark shows the one-sided movement direction of the conveyor belt $12_{15}$ being couldn't effectively.

TABLE 5

| Width of the conveyor belt (mm) | 10 | 20 | 30 | 40 | 50 | 60 | 70 | 200 | 300 | 500 |
|---|---|---|---|---|---|---|---|---|---|---|
| Result | X | X | X | X | ○ | ○ | ○ | ○ | ○ | ○ |

When the belt width was less than 40 mm, the one-sided moving direction of the belt $12_{15}$ couldn't be controlled effectively because of the narrow area of the driven roller $17_{15}$ acting on the belt $12_{15}$. On the other hand, in the case of the belt of which width is more than 50 mm, the test was conducted for the belt width of every 10 mm above 50 mm up to 500 mm and as a result, the one-sided moving direction could be controlled effectively. This result indicates that the one-sided moving direction of the belt is controllable when it is running under the conditions described above regardless of the belt width if the area of the driven roller $17_{15}$ acts on the belt $12_{15}$.

According to this test results, it may be said that the proper length of the belt $12_{15}$ in the direction perpendicular to its running direction (the belt width) is more than 50 mm.

Figure 61:
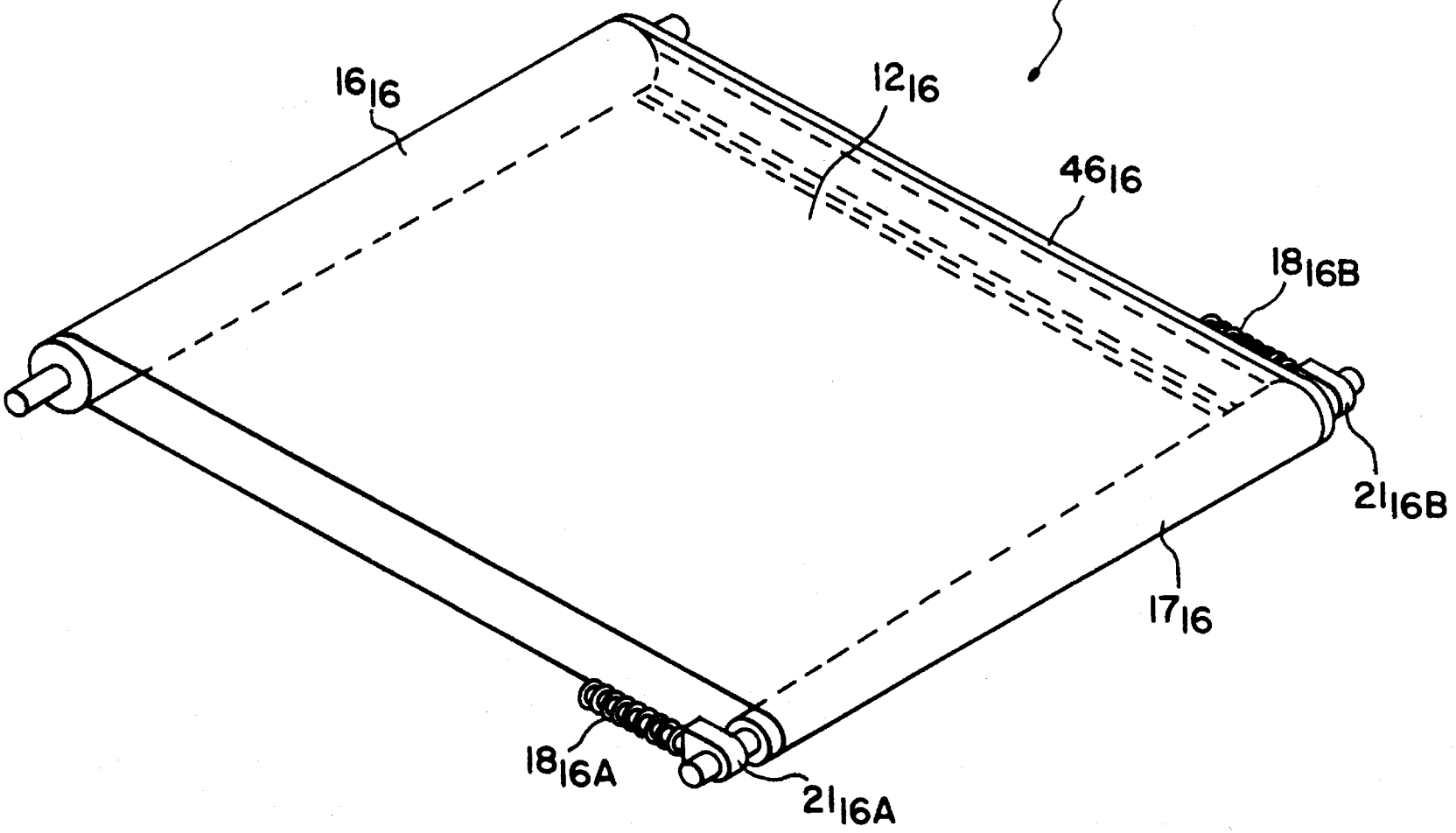
FIG. 61 is a perspective view showing the regulation belt type conveyor belt conveying apparatus which is another embodiment of the present invention.

Next, referring to FIGS. 61 through 63B, the control of the one-sided moving direction in the sixteenth embodiment and a conveying means $200_{16}$ using a regulation belt, which is a zigzag running regulation member provided to the conveyor belt, will be described. As described above in detail, it is possible to control the one-sided moving direction of the conveyor belt using the tapered driven roller which has the same condition as the tapered driven roller $17_{15}$ in the fifteenth embodiment and the conveyor belt applied load balance. According to this system using the tapered driven roller and the conveyor belt applied load balance, the conveyor belt is one-sided toward the small diameter side of the tapered driven roller. As a method to suppress the zigzag running, there is a system to use a regulation belt as shown in FIG. 61. The conveying means $200_{16}$ comprises a conveyor belt $12_{16}$ for conveying an image receiving medium, a driving roller $16_{16}$ for driving the conveyor belt $12_{16}$, a driven roller $17_{16}$ having an inclined tapered surface and a regulation belt $46_{16}$ provided at the large diameter side of the tapered driven roller $17_{16}$ in one united body with the conveyor belt $12_{16}$. The regulation belt $46_{16}$ is in the same construction as that in the sixth, seventh and eighth embodiments described above.

The endless type conveying belt $12_{16}$ is put on the driving roller $16_{16}$ and the tapered driven roller $17_{16}$, and turned around by the rotation of the driving roller $16_{16}$. Tapered roller holders $21_{16A}$ and $21_{16B}$ of the tapered driven roller $17_{16}$ are pressed outward by compression springs $18_{16A}$ and $18_{16B}$. This gives a tensile force to the conveyor belt $12_{16}$. The compression spring pressing the driven roller holder $21_{16A}$ at the small diameter side of the tapered driven roller $17_{16}$ and the compression spring $18_{16B}$ pressing the driven roller holder $21_{16B}$ at the large diameter side of the tapered driven roller $17_{16}$ are given with a more than 10% difference of belt compression force. In the case of this sixteenth embodiment, as the large diameter side of the tapered driven roller $17_{16}$ is arranged at the inner part in FIG. 61 and the small diameter side is arranged at this side in FIG. 61, the compression spring $18_{16}$ pressing the driven roller holder $21_{16B}$ at the large diameter side of the tapered driven roller $17_{16}$ has a compression force 10% higher than the compression spring $18_{16A}$ pressing the driven roller holder $21_{16A}$ at the small diameter side. Further, this tapered driven roller $17_{16}$ is in the taper size more than $2.31\times10^{-3}$ and its small diameter side is at this side in FIG. 61 and the large diameter side is at the inner part. Further, the roller surface of this tapered roller has been machined so that coefficient of static friction between the tapered driven roller $17_{16}$ and the conveyor belt $12_{16}$ will become less than 0.26. Further, the compression springs $18_{16A}$ and $18_{16B}$ have been adjusted so that a total applied load at the this side and the inner side in the figure becomes more than 3 kg. On the other hand, the regulation belt $46_{16}$ has been provided in one united body with the conveyor belt $12_{16}$ at the large diameter side of the tapered driven roller $17_{16}$.

The state of the conveyor belt $12_{16}$ in this construction when operated is as follows.

When the conveyor belt $12_{16}$ is conveyed by the rotation of the belt driving roller $16_{16}$, the conveyor belt gradually moves toward the small diameter side of the tapered driven roller $17_{16}$, that is, one-sided to this side progressively by the tapered driven roller $17_{16}$ and the compression spring $18_{16B}$ with the applied load balance added. When the conveyor belt $12_{16}$ is one-sided progressively, the regulation belt $46_{16}$ provided at the inner part in the figure in a one united body with the conveyor belt $12_{16}$ contacts the large diameter side end of the tapered driven roller $17_{16}$ and the conveyor belt is conveyed while constantly sliding. As the regulation belt $46_{16}$ has been provided in one united body with the conveyor belt $12_{16}$, if the one-sided movement of the conveyor belt $12_{16}$ progresses by a certain amount, the regulation belt $46_{16}$ is balanced with the force at the large diameter side end of the tapered driven roller $17_{16}$ and the one-sided movement is stopped.

Figure 62:
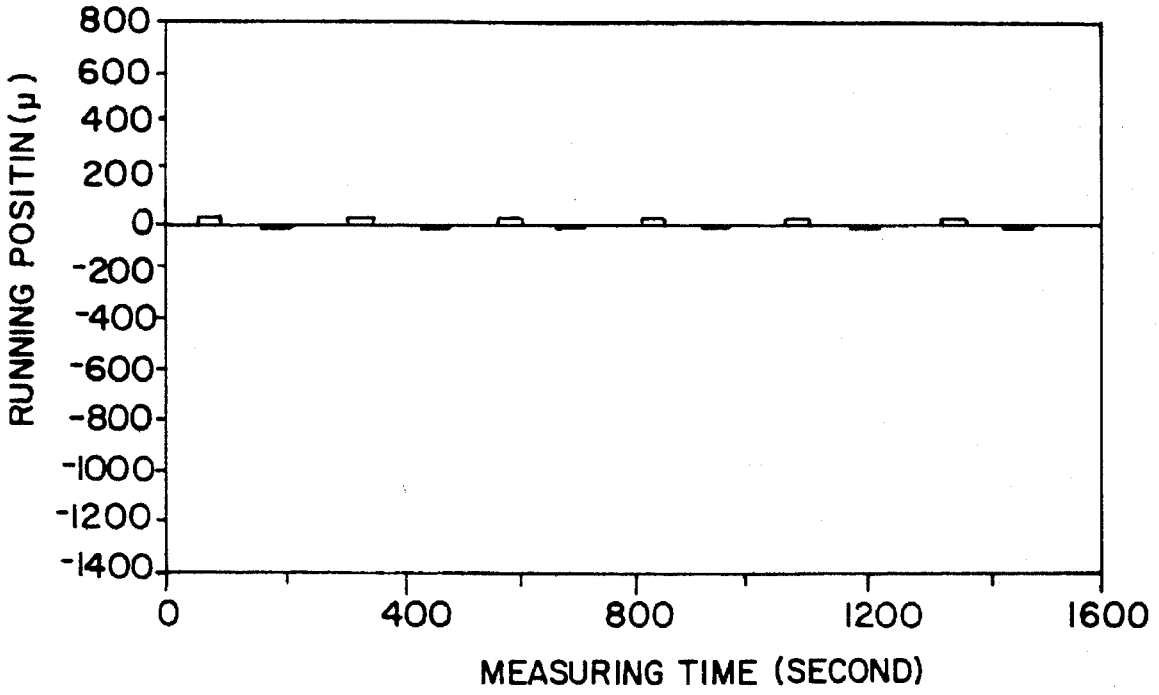
FIG. 62 is a diagram showing the one-sided and zigzag moving volume when the regulation belt type conveyor belt conveying apparatus shown in FIG. 61.

On the other hand, as the zigzag running force of the conveyor belt $12_{16}$ is generally smaller than the one-sided moving force of the conveyor belt $12_{16}$, when it is balanced with the one-sided moving force, the zigzag running force is included in the action and the reaction of the one-sided moving force and no zigzag running of the conveyor belt is taken place. The zigzag and one-sided moving amount of the conveyor belt $12_{16}$ in the above construction were measured and the results are shown in FIG. 62.

That is, when the regulation belt $46_{16}$ is constructed in one united body with the conveyor belt $12_{16}$ and arranged at the large diameter side of the tapered driven roller $16_{16}$ and the applied load balance of the compression spring $18_{16B}$ at the large diameter side of this tapered driven roller $17_{16}$ is largely distributed, it becomes possible to control the one-sided moving direction of the conveyor belt $12_{16}$. As a result, it become possible to control the progress of the one-sided moving and the zigzag running of the conveyor belt $12_{16}$.

Figure 63A:
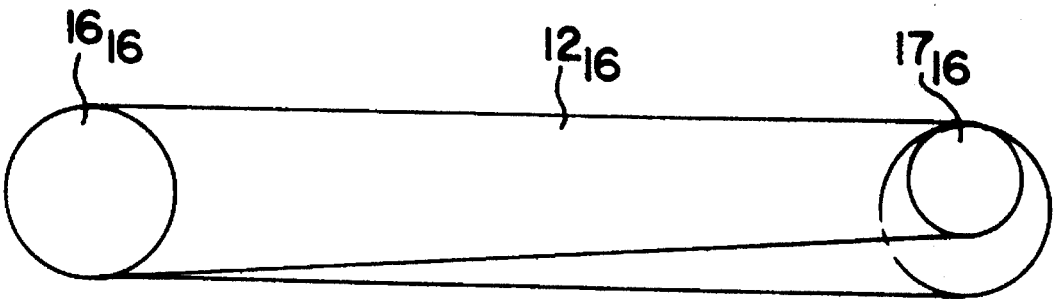
FIG. 63A is a front view showing the state of the driving roller and the driven roller of the belt conveying apparatus shown in FIG. 61.
Figure 63B:
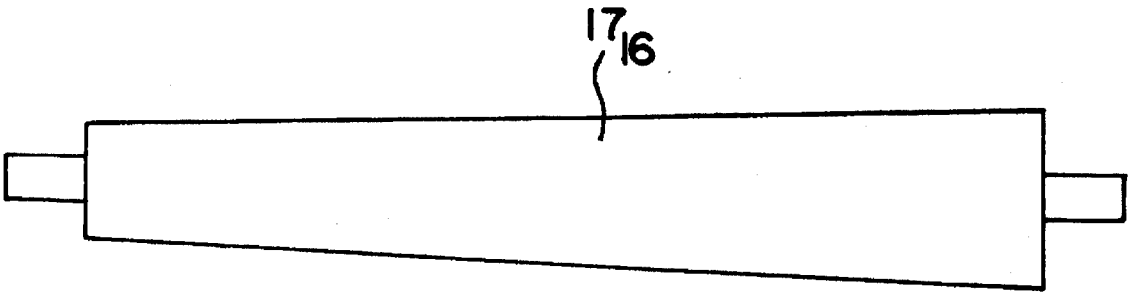
FIG. 63B is a side view showing the state of the driving roller and the driven roller of the belt conveying apparatus shown in FIG. 61.

Further, when this tapered driven roller $17_{16}$ is used, it is provided by tilting toward the driving roller $16_{16}$ by ½ of the distance between the diameters of the large diameter side and the small diameter side thus the small diameter side of the conveyor belt $12_{16}$ contacts to the photosensitive drums. This is because if the rotating center axes of the driving roller $16_{16}$ and the tapered driven roller $17_{16}$ are set parallel to each other, the small diameter side of the tapered driven roller $17_{16}$ does not contact the photosensitive drums, causing the improper transfer. This state is shown in FIGS. 63A and 63B.

As explained above, when the taper size is selected at above $2.31\times10^{-3}$, the conveyor belt $\mathbf{12}_{16}$ and the tapered driven roller $\mathbf{17}_{16}$ having the coefficient of static friction 0.26 are used, the applied load at the large diameter side is increased by 10% more than that at the small diameter side and a load applied to the conveyor belt is set preferably at above 3 kg, it becomes possible to control the one-sided moving direction of the conveyor belt $\mathbf{12}_{16}$ so that it is one-sided stably toward the small diameter side of the tapered driven roller $\mathbf{17}_{16}$. Further, when the regulation belt $\mathbf{46}_{16}$ is constructed in one united body with the conveyor belt $\mathbf{12}_{16}$ at the large diameter side of the tapered driven roller $\mathbf{17}_{16}$, it becomes possible to suppress the one-sided movement and the zigzag running of the conveyor belt $\mathbf{12}_{16}$ simultaneously with high reliability.

What is claimed is:

1. An image forming apparatus, comprising:

means for forming an image on an image carrier means;

a conveyor belt for conveying an image receiving medium to the image carrier means;

means, having a first roller which has a diameter that is different at both ends and a taper size T expressed by T=(D−d)/L, wherein D is the diameter at the large diameter side, d is the diameter at the small diameter side and L is the length of the first roller, wherein T is more than $2.31\times10^{-3}$ and a coefficient of static friction is less than 0.26, and a second roller which is opposing to the first roller, for moving the conveyor belt in a prescribed direction by rotating the first and the second rollers in a state where the conveyor belt is put over the first and the second rollers; and means for transferring the image formed on the image carrier means onto the image receiving medium.

2. An image forming apparatus as claimed in claim 1 further comprising a regulation member for regulating the one-sided movement of the conveyor belt while sliding one end side of the conveyor belt that is positioned at the small diameter side of the first roller.

3. An image forming apparatus as claimed in claim 1 further comprising a regulation guide member provided in one united body with the edge side of the conveyor belt positioned at the large diameter side of the first roller for regulating the one-sided movement of the conveyor belt while sliding on the large diameter portion of the first roller when the conveyor belt is running.

4. An image forming apparatus as claimed in claim 1, wherein the image carrier means includes a plurality of image carriers and the conveyor belt sequentially conveys the image receiving medium to the plurality of image carriers.

5. An image forming apparatus as claimed in claim 1, wherein the first roller has a rotating shaft of which the large diameter side has been tilted by an angle θ shown by the following expression against the plane being parallel to the moving direction of the conveyor belt and including the rotating center shaft of the image carrier means:

$$\tan\theta=\{(D-d)/2\}/L.$$

6. An image forming apparatus as claimed in claim 1, wherein the Young's modulus of the conveyor belt in the direction perpendicular to the moving direction of the conveyor belt is more than 200 kg/mm$^2$.

7. An image forming apparatus as claimed in claim 1, wherein the length (the belt width) of the conveyor belt in the direction perpendicular to the moving direction of the belt is more than 50 mm.

8. An image forming apparatus, comprising:

means for forming an image on an image carrier means;

a conveyor belt for conveying an image receiving medium to the image carrier means;

means, having a first roller which has a diameter that is different at both ends and a taper size T expressed by T=(D−d)/L, wherein D is the diameter at the large diameter side, d is the diameter at the small diameter side and L is the length of the first roller, wherein T is more than $2.31\times10^{-3}$ and a coefficient of static friction is less than 0.26, and a second roller which is opposing to the first roller, for moving the conveyor belt in a prescribed direction by rotating the first and the second rollers in a state where the conveyor belt is put over the first and the second rollers;

means for applying a load set at more than 3 kg to the conveyor belt; and means for transferring the image formed on the image carrier means onto the image receiving medium.

9. An image forming apparatus, comprising:

means for forming an image on an image carrier means;

a conveyor belt for conveying an image receiving medium to the image carrier means;

means, having a first roller which has a diameter that is different at both ends and a taper size T expressed by T=(D−d)/L, wherein D is the diameter at the large diameter side, d is the diameter at the small diameter side and L is the length of the first roller, wherein T is more than $2.31\times10^{-3}$ and a coefficient of static friction is less than 0.26, and a second roller which is opposing to the first roller, for moving the conveyor belt in a prescribed direction by rotating the first and the second rollers in a state where the conveyor belt is put over the first and the second rollers;

means for transferring the image formed on the image carrier means onto the image receiving medium; and a first and a second tension applying means for applying a tension to the conveyor belt by giving a force to the small diameter side and the large diameter side of the first roller, wherein the force given to the small diameter side is smaller than the force given to the larger diameter side.

10. An image forming apparatus as claimed in claim 9, wherein a difference between the tensile forces given by the first and the second tension applying means is a value obtained from the following expression:

$$\{(Pa-Pb)/Pb\}\times100\geqq10$$

(where, Pa is a size of load applied by the first tension applying means, Pb is a size of load applied by the second tension applying means, wherein Pa>Pb).

11. A conveying apparatus, comprising:

a conveyor belt for conveying an image receiving medium on which an image, which is transferred from an image carrier, is carried to the image carrier; and means, having a first roller which has a diameter that is different at both ends and a taper size T expressed by T=(D−d)/L, wherein D is the diameter at the large diameter side, d is the diameter at the small diameter side and L is the length of the first roller, wherein T is more than $2.31\times10^{-3}$ and a coefficient of static friction is less than 0.26, and a second roller which is opposing to the first roller, for moving the conveyor belt in a prescribed direction by rotating the first and the second rollers in a state where the conveyor belt is put over the first and the second rollers.

12. A conveying apparatus as claimed in claim 11, wherein the first roller has a rotating shaft of which the large diameter side has been tilted by an angle θ shown by the following expression against the plane being parallel to the moving direction of the conveyor belt and including the rotating center shaft of the image carrier:

$$\tan\theta=\{(D-d)/2\}/L.$$

13. A conveying apparatus as claimed in claim 11, wherein the Young's modulus of the conveyor belt in the direction perpendicular to the moving direction of the conveyor belt is more than 200 $kg/mm^2$.

14. A conveying apparatus as claimed in claim 11, wherein the length (the belt width) of the conveyor belt in the direction perpendicular to the moving direction of the belt is more than 50 mm.

15. A conveying apparatus as claimed in claim 11 further comprising means for applying a load set at more than 3 kg to the conveyor belt.

16. A conveying apparatus as claimed in claim 15 further comprising a first tension applying means for applying a tension to the conveyor belt by giving a force to the large diameter side of the first roller and a second tension applying means for applying a tension to the conveyor belt by giving a force to the small diameter side of the first roller, wherein the force of the first applying means is larger than that of the second applying means.

17. A conveying apparatus as claimed in claim 11 further comprising a regulation member for regulating the one-sided movement of the conveyor belt while sliding one end side of the conveyor belt that is positioned at the small diameter side of the first roller.

18. A conveying apparatus as claimed in claim 11 further comprising a regulation guide member provided in one united body with the edge side of the conveyor belt positioned at the large diameter side of the first roller for regulating the one-sided movement of the conveyor belt while sliding on the large diameter portion of the first roller when the conveyor belt is running.

19. An image forming apparatus, comprising:

means for forming an image on an image carrier;

a conveyor belt for conveying an image formed on the image carrier; and means, having a first roller which has a diameter that is different at both ends and a taper size T expressed by T=(D−d)/L, wherein D is the diameter at the large diameter side, d is the diameter at the small diameter side and L is the length of the first roller, wherein T is more than $2.31\times10^{-3}$ and a coefficient of static friction is less than 0.26, and a second roller which is opposing to the first roller, for moving the conveyor belt in a prescribed direction by rotating the first and the second rollers in a state where the conveyor belt is put over the first and the second rollers.

20. A conveying apparatus, comprising:

a conveyor belt for conveying an image formed on an image carrier; and means, having a first roller which has a diameter that is different at both ends and a taper size T expressed by T=(D−d)/L, wherein D is the diameter at the large diameter side, d is the diameter at the small diameter side and L is the length of the first roller, wherein T is more than $2.31\times10^{-3}$ and a coefficient of static friction is less than 0.26, and a second roller which is opposing to the first roller, for moving the conveyor belt in a prescribed direction by rotating the first and the second rollers in a state where the conveyor belt is put over the first and the second rollers.

* * * * *